US006868244B2

(12) United States Patent
Koide

(10) Patent No.: US 6,868,244 B2
(45) Date of Patent: Mar. 15, 2005

(54) IMAGE FORMING APPARATUS WITH REDUCED VARIATION OF ROTATION SPEED OF IMAGE CARRIER

(75) Inventor: Hiroshi Koide, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/741,185

(22) Filed: Dec. 22, 2003

(65) Prior Publication Data

US 2004/0131386 A1 Jul. 8, 2004

Related U.S. Application Data

(62) Division of application No. 10/198,658, filed on Jul. 18, 2002.

(30) Foreign Application Priority Data

Jul. 18, 2001 (JP) ..... 2001-218042
Sep. 17, 2001 (JP) ..... 2001-281754

(51) Int. Cl.[7] ..... G03G 15/00; G03G 21/00

(52) U.S. Cl. ..... 399/167; 310/46; 310/153; 399/75; 399/88

(58) Field of Search ..... 399/75, 159, 162, 399/167, 88, 37; 318/254, 138, 161; 310/114, 46, 152–154, 156

(56) References Cited

U.S. PATENT DOCUMENTS 4,217,508 A * 8/1980 Uzuka ..... 310/46
4,531,828 A 7/1985 Hoshino ..... 347/118
4,835,582 A * 5/1989 Kasahara et al. ..... 399/167
4,947,209 A * 8/1990 Maeno et al. ..... 399/78
5,428,426 A * 6/1995 Inomata et al. ..... 399/167
6,141,515 A * 10/2000 Takeda et al. ..... 399/167
6,173,141 B1 1/2001 Sakagami et al. ..... 399/167
6,278,857 B1 8/2001 Monji et al. ..... 399/301
6,369,532 B2 * 4/2002 Koenen et al. ..... 310/153 X
6,429,564 B1 * 8/2002 Uemura et al. ..... 310/153
6,507,713 B2 * 1/2003 Koide ..... 399/167 X
6,591,747 B2 7/2003 Buch et al. ..... 101/211
6,614,140 B2 * 9/2003 Uemura et al. ..... 310/153 X
2002/0085086 A1 * 7/2002 Koide ..... 347/262

FOREIGN PATENT DOCUMENTS

JP 63-113477 A 5/1988
JP 05-053381 * 3/1993
JP 6-274077 A 9/1994
JP 9-179445 7/1997
JP 10-333398 12/1998
JP 11-59947 3/1999
JP 2000-162846 6/2000
JP 2000-227738 8/2000
JP 2000-242057 A 9/2000
JP 2001-337561 * 7/2001

* cited by examiner

*Primary Examiner*—Sophia S. Chen
(74) *Attorney, Agent, or Firm*—Oblon, Spivak, McClelland, Maier & Neustadt, P.C.

(57) ABSTRACT

An image forming apparatus that reduces an influence of the variation of rotation speed of an image carrier, which is ascribable to, e.g., the eccentricity of a driven transmission member mounted on the image carrier, on the misregister of different colors. Further, the apparatus reduces the influence of the load variation of the image carrier acting on a transfer medium drive member on the misregister of different colors.

3 Claims, 37 Drawing Sheets

IMAGE FORMING APPARATUS WITH REDUCED VARIATION OF ROTATION SPEED OF IMAGE CARRIER

CROSS-REFERENCE TO RELATED APPLICATIONS

The present patent document is a divisional of U.S. application Ser. No. 10/198,658, filed Jul. 18, 2002, and in turn claims priority to JP 2001-218042 filed Jul. 18, 2001, and JP 2001-281754, filed Sep. 17, 2001, the entire contents of each of the above-identified applications being hereby incorporated herein by reference.

BACKGROUND OF THE INVENTION

1. Field of the Invention

The present invention relates to a copier, printer, facsimile apparatus or similar image forming apparatus. More particularly, the present invention relates to an image forming apparatus capable of reducing the influence of the variation of rotation speed of an image carrier, which is ascribable to, e.g., the eccentricity of a driven transmission member mounted on the image carrier, on the misregister of different colors as well as the influence of the load variation of the image carrier acting on transfer medium drive means on the misregister of different colors.

2. Description of the Background Art

Today, to meet the increasing demand for color copies and color prints, an ink jet image forming apparatus is predominant in a low-speed range while an electrophotographic image forming apparatus is predominant in a medium- and a high-speed range. Particularly, a tandem color image forming apparatus including a plurality of photoconductive drums or image carriers arranged side by side in the direction of sheet feed is suitable for high-speed applications. On the other hand, an intermediate image transfer type image forming apparatus includes an intermediate image transfer body implemented as a belt and configured such that an image formed on the belt is transferred to a sheet.

Japanese Patent Laid-Open Publication No. 10-246995, for example, discloses a tandem color image forming apparatus including four photoconductive drums arranged in a direction in which a sheet carried on a conveying belt moves. An optical scanning unit scans each of the drums with a light beam in accordance with image data in the main scanning direction, thereby forming a latent image on the drum. In this manner, latent images are formed on all of the four drums. A developing unit storing toner of particular color, i.e., cyan, magenta, yellow or black develops preselected one of the latent images. The resulting toner images are sequentially transferred from the drums to the sheet one above the other by chargers, completing a full-color image on the sheet. The sheet with the full-color color image is driven out of the apparatus after the toner image has been fixed on the sheet.

As stated above, in the tandem color image forming apparatus, toner images of different colors are formed on the drums in parallel and complete a full-color image only if the sheet is passed through consecutive image transfer positions only one time. The tandem color image forming apparatus is therefore feasible for high-speed color image formation.

In the tandem color image forming apparatus, a specific drive system for driving the drums is configured such that the drive force of a pulse motor, which is not subjected to feedback control, is transmitted to a driven gear or driven transmission member mounted on the shaft of the individual drum. When such a drive system is used for accurate drum drive, it is likely that the speed variation of the individual drum brings about the misregister of pixel positions transferred to the sheet, belt or similar transfer medium, resulting in the misregister of colors in the full-color image.

The major causes of the drum speed variation are (1) the variation of rotation speed of each gear or similar drive transmission member included in a drive transmission system between the drive motor and the driven member of the drum shaft, and (2) the eccentricity of the drum shaft or that of the driven gear as well as the cumulative tooth pitch error of the driven gear. The speed variation of the drum ascribable to the cause (1) tends to occur at a period shorter than a period of time necessary for the drum to make one rotation. On the other hand, the speed variation of the drum ascribable to the cause (2) tends to occur at a period coincident with the above period of time.

Japanese Patent No. 2,929,671, for example, teaches a method of obviating the drum speed variation ascribable to the cause (1). Assume that oscillation included in the variation of the drum angular velocity has a frequency fi, and that a fundamental frequency dependent on a period of time necessary for the drum to rotate over an angle θ1 about its axis O from an exposure position to an image transfer position is fo. Then, the method taught in the above document makes fi/fo an integer. More specifically, assuming that the above oscillation has a period T, and that the above period of time is τ, then the method makes τ/T an integer. Therefore, even when the drum angular velocity varies due to the oscillation fi ascribable to, e.g., the eccentricity of the gear, images can be brought into register on the transfer medium.

However, when it comes to the drum speed variation ascribable to the cause (2), the method described above cannot satisfy a condition that makes the parameter fi/fo or τ/T an integer. It is therefore difficult to obviate the misregister of colors ascribable to the drum speed variation.

In the tandem color image forming apparatus, the variation of torque ascribable to the torque ripple or the cogging of the drive motor assigned to the drum is magnified by a speed reduction ratio implemented by the drive transmission system before it is transferred to the driven gear of the drum. To solve this problem, Japanese Patent Laid-Open Publication No. 10-63059 proposes a color image forming apparatus using a transmission mechanism that reduces the speed of a drive motor with gears, and mounting a large flywheel on the shaft of a drum that is the subject of control. With this configuration, the apparatus reduces oscillation generated in, e.g., the drive transmission system. However, although the flywheel may reduce high-frequency oscillation ascribable to, e.g., gears, it cannot easily reduce drum speed variation ascribable to the eccentricity of gears constituting the drive transmission system. As a result, the rigidity of the drive transmission system is lowered to make accurate control difficult to execute.

Japanese Patent Laid-Open Publication No. 63-11967, for example, discloses an image forming apparatus constructed to obviate the misregister of images transferred from the drums to the transfer medium. In this image forming apparatus, at least two of a plurality of drums share a single drive means. The drums are positioned such that a period of time necessary for a conveying belt to move between image transfer positions assigned to nearby drums corresponds to a distance equal to the integral multiple of the period of the drive irregularity of the shared drive means. This kind of apparatus is effective so long as, when the drive irregularities are applied to the drums in the same phase, all the drums are driven by, e.g., a single drive motor, i.e., the speed variation of a gear mounted on the output shaft of the drive motor is transferred to all of the drums. However, because consideration is not given to the influence of a difference in phase between the speed variations of driven gears mounted on the drums, it is difficult to obviate color misregister ascribable to the speed variation of the individual drum resulting from the eccentricity or the cumulative tooth pitch error of the driven gear, which is mounted on the drum shaft.

Further, the apparatus taught in the above Laid-Open Publication No. 63-11967 or Japanese Patent No. 2,929,671 can match the drums with respect to the image position against the speed variation of the individual drum, which is ascribable to the eccentricity or the cumulative tooth pitch error of the gear of the drive transmission system that is not directly connected to the drum shaft. However, when speed variation occurs at each of the drums, slips ascribable to the speed variations are superposed at the consecutive image transfer positions. This is likely to bring about the thickening of lines or similar defects.

Japanese Patent Laid-Open Publication No. 8-160690, for example, proposes an image forming apparatus using a direct drive system including an ultrasonic motor. The ultrasonic motor makes the transmission gear and driven gear unnecessary and thereby obviates the drum speed variation ascribable to the gear of the drive transmission system and the driven gear of the drum. The ultrasonic motor, however, has the following disadvantage well known in the art. In the ultrasonic motor, a rotor is held in contact with a stator. Therefore, the rotary body of the ultrasonic motor must be configured to be freely rotatable when the drum is replaced, thereby protecting the motor from damage. This is also true when a sheet jamming a printer or a copier should be removed. The ultrasonic motor therefore increases the cost of the apparatus.

While a core motor with coils wound round the slot yoke of a stator or a pulse motor is a common motor that can be directly connected to the drum, such a motor involves, e.g., cogging. If the core motor or the pulse motor is directly connected to the drum, cogging, for example, directly translates into the speed variation of the drum. To solve this problem ascribable to cogging, the drive system may use an outer rotor type coreless motor in order to reduce the high-frequency speed variation with an inertia effect available with this kind of motor. However, it is difficult with this drive scheme to obviate the influence of a transitional load variation occurring when, e.g., a sheet rushes into contact with the drum.

In the tandem color image forming apparatus, assume that the drum speed varies due to the eccentricity of the drum shaft or the eccentricity or the cumulative tooth pitch error of the driven gear or that the drum itself is eccentric. Then, a difference between the drum peripheral speed and the speed of the intermediate image transfer belt or a difference between the drum peripheral speed and the conveying belt and sheet speed varies at the image transfer position. The resulting friction acting between the drum and the intermediate image transfer belt or between the drum and the conveying belt and sheet at the image transfer position varies. Consequently, a load acting on the intermediate image transfer belt or the drive system assigned to the conveying belt varies, causing the speed of such a belt to vary.

Japanese Patent Publication No. 6-13373 teaches a sheet conveying device constructed to reduce the influence of the eccentricity of a drive roller, which drives a conveying belt, on color misregister. To achieve this purpose, the distance of a sheet path between nearby drums is selected to be the integral multiple of a distance by which a sheet is conveyed for one rotation of the drive roller. By applying this sheet conveying device to an image forming apparatus, it is possible to obviate color misregister ascribable to the speed variation of the conveying belt resulting from the eccentricity of the drive roller. However, the sheet conveying device does not give consideration to the speed variation of the drum ascribable to the eccentricity or the cumulative tooth pitch error of the driven gear coaxial with the drum shaft or the eccentricity of the drum itself. Further, the above document does not teach specifically any condition that reduces color misregister when a driven transmission member is interposed between the drive roller and a drive source for saving power to be consumed by a drive system assigned to the drive roller.

Technologies relating to the present invention are also disclosed in, e.g., Japanese Patent Laid-Open Publication Nos. 9-179445, 10-333398, 11-59947, 2000-162846, and 2000-227738.

SUMMARY OF THE INVENTION

It is a first object of the present invention to provide an image forming apparatus capable of reducing the speed variation of an image carrier, which includes a driven transmission member, for one rotation period to thereby reduce image misregister on a transfer medium.

It is a second object of the present invention to provide an image forming apparatus capable of obviating misregister on a transfer medium even when a plurality of image carriers each have a speed variation for one rotation period.

It is a third object of the present invention to provide an image forming apparatus capable of controlling, when use is made of an outer rotor type motor as a drive source for an image carrier, the image carrier with higher accuracy to thereby insure high-quality images free from misregister.

It is a fourth object of the present invention to provide an image forming apparatus capable of accurately driving an image carrier or similar rotary body even when a load varies due to, e.g., the variation of environment to thereby insure high-quality images free from image misregister.

It is a fifth object of the present invention to provide an image forming apparatus capable of reducing, even when a plurality of image carriers each are rotating with a particular peripheral speed variation, image misregister ascribable to the variation.

It is a sixth object of the present invention to provide a tandem image forming apparatus capable of insuring high-quality images by minimizing, when a relative speed occurring in a difference between the peripheral speed of an image carrier and the moving speed of a transfer medium at an image transfer position due to a difference in radius between image carriers increases, the distortion of an image transferred to the transfer medium, thereby obviating image misregister ascribable to an increase in relative speed and therefore the variation of a load acting on the transfer medium In accordance with the present invention, an image forming apparatus includes a rotatable image carrier to which a driven transmission member is affixed. A drive source generates a drive force for driving the image carrier. A drive transmitting device transmits the drive force to the driven transmission member while a relaying member connects the driven transmission member and image carrier. A driven transmission member mount portion is configured to selectively cancel the fixation of the driven transmission member to the image carrier to thereby allow the driven transmission member to move along a plane perpendicular to its axis. An image carrier mount portion is configured to allow the image carrier and a sensing member responsive to an absolute rotation angle and a rotation speed to be selectively mounted thereon.

Also, in accordance with the present invention, an image forming apparatus includes a plurality of image carriers implemented as drums. An image carrier drive unit drives each image carrier independently of the others. Image forming units each form an image on the surface of a particular image carrier. A transfer medium drive unit causes a transfer medium to move via image transfer positions assigned to the image carriers. Image transferring units each transfer an image from a particular image carrier to the transfer medium. A drive controller controls the image carrier drive unit and transfer medium drive unit and includes a device for obtaining radius information representative of the radiuses of the image carriers. The drive controller determines, based on the drum radius information, angular velocities that match the mean peripheral speeds of the image carriers, as measured at the image transfer positions, and executes drive control by using the angular velocities as set speeds.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Preferred embodiments of the image forming apparatus in accordance with the present invention will be described hereinafter. The embodiments to be described each are implemented as a tandem color printer having resolution as high as 2,400 dpi (dots per inch) or 1,200 dpi by way of example. A first to a fourth embodiment are directed toward the first to fifth objects stated earlier.

First Embodiment

Figure 1:
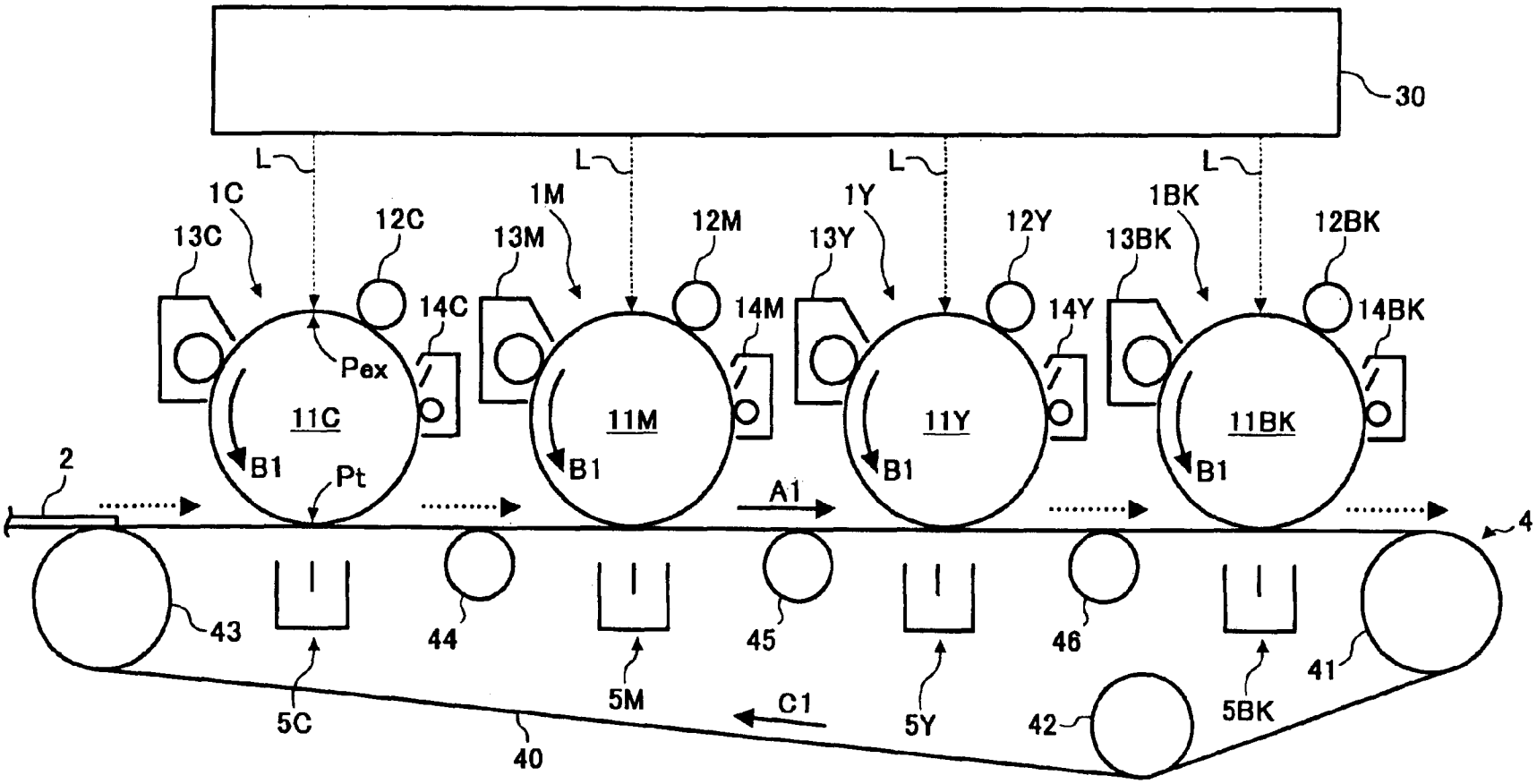
FIG. 1 is a view showing a first embodiment of the image forming apparatus in accordance with the present invention.

Referring to FIG. 1 of the drawings, a tandem color printer includes four toner image forming sections 1Y (yellow), 1M (magenta), 1C (cyan) and 1BK (black) for forming images with yellow toner, magenta toner, cyan toner and black toner, respectively. The image forming sections 1Y through 1BK are sequentially arranged from the upstream side toward the downstream side in a direction A in which a sheet or transfer medium (recording medium) 2 is conveyed. The image forming section 1Y includes a photoconductive drum or image carrier 11Y rotatable in a direction B1, a charge roller 12Y for uniformly charging the surface of the drum 11Y, a developing unit 13Y for developing a latent image formed on the drum 11Y, and a drum cleaning unit 14Y for cleaning the drum 11Y after the transfer of a toner image to the sheet 2.

The other image forming sections 1M, 1C and 1BK are identical in configuration with the image forming section 1Y except for the color of toner to use; identical structural elements are simply distinguished by suffices M, C and BK. The image forming section 1Y through 1BK are arranged such that axes of the drums 11Y through 11BK thereof are parallel to each other and positioned at a preselected pitch in the direction A1.

An optical writing unit or exposing means 30 scans the charged surfaces of the drums 11Y through 11BK with laser beams L in accordance with image data, thereby forming latent images on the drums 11Y through 11BK. The sheet or transfer medium 2 is fed from a sheet cassette, not shown, to an image transferring unit 4 via a registration roller pair (not shown). The image transferring unit 4 includes an endless conveying belt (simply belt hereinafter) 40 for conveying the sheet 2 via consecutive image transfer positions assigned to the image forming sections 1Y through 1BK. A fixing unit, not shown, fixes toner images of different colors transferred from the drums 11Y through 11BK to the sheet 2 one above the other, i.e., a full-color image. The sheet 2 carrying the fixed full-color image thereon is driven out to a print tray (not shown). The image forming sections 1Y through 1BK and optical writing unit 30 constitute image forming means in combination.

The optical writing unit 30 includes lasers, a polygonal mirror, an f-theta lens and mirrors although not shown specifically. Each laser beam L scans the surface of associated one of the drums 11Y through 11BK, which are in rotation, in accordance with image data at a preselected exposure position Pex.

The belt 40 of the image transferring unit 4 is passed 20 over a drive roller or drive member 41, a tension roller 42, and a driven roller 43 and driven in a direction C1 at a preselected timing. The tension roller 42 applies a preselected degree of tension to the belt 40. Press rollers 44, 45 and 46 press the belt 40 against the drums 11Y through 11BK with preselected pressure. Corona chargers 5Y, 5M, 5C and 5BK for image transfer are positioned between the opposite runs of the belt 40. The corona chargers 5Y through 5BK each apply an image transfer charge to the belt 40 at an image transfer position Pt opposite to the exposure position Pex with respect to the associated drum, thereby transferring a toner image from the drum to the sheet 2.

In the image forming section 1C, for example, the charge roller 12C uniformly charges the surface of the drum 11C. The optical writing unit 30 scans the charged surface of the drum 11C with the laser beam L in accordance with image data to thereby form a latent image on the drum 11C. The developing unit 13C develops the latent image with cyan toner for thereby producing a cyan toner image. At the image transfer position Pt, the cyan toner image is transferred from the drum 11C to the sheet 2 being conveyed by the belt 40 via the transfer position Pt. After the image transfer, the drum cleaning unit 14C cleans the surface of the drum 11C. Subsequently, discharging means, not shown, discharges the surface of the drum 11C to thereby prepare it for the next image forming cycle. Such image formation is executed with the other drums 11M through 11BK as well in synchronism with the movement of the sheet 2.

The sheet fed from the sheet cassette is conveyed to the registration roller pair by rollers along guides not shown. The registration roller pair once stops the sheet and then conveys it toward the image transferring unit 4 at a preselected timing. In the image transferring unit 4, the belt 40 conveys the sheet 2 via the transfer positions Pt of the image forming sections 1Y through 1BK. At this instant, the toner images of different colors are transferred from the drums 11Y through 11BK to the sheet 2 one above the other, completing a full-color image on the sheet 2. The sheet with the full-color image is driven out of the printer via the route mentioned previously.

Hereinafter will be described the construction and assembling method of a drum drive unit or image carrier driving means configured to obviate the misregister of images, or colors, on the sheet 2. As for description common to the structural elements assigned to different colors, the suffixes Y, M, C and BK are sometimes omitted, as needed.

Considering the register of toner images of different colors on the sheet 2, it is necessary to reduce the variation of the rotation speed of the individual drum 11. More specifically, although the eccentricity and the scatter of the diameter of the drum 11 are not avoidable for production and assembly reasons, misregister does not occur if the rotation speed of the drum 11 does not vary. That is, so long as the rotation speed of the drum 11 is constant, the peripheral speed of the drum 11 is the same at both of the exposure position Pex and transfer position Pt. Further, assume that the moving speed of the belt 40 is the same as the peripheral speed of the drum 11 when the drum 11 has an ideal configuration. Then, pixels constituting an image on the sheet 2 have the same positional shift and pixel density, as taught in, e.g., Kido and Iijima "Studies on Slip Transfer Mechanism", Fuji Xerox Technical Report, No. 13.

In light of the above, the illustrative embodiment configures the drum drive unit such that the rotation speed of the drum 11 does not vary despite the eccentricity and the scatter of the radius of the drum 11.

Figure 2A:
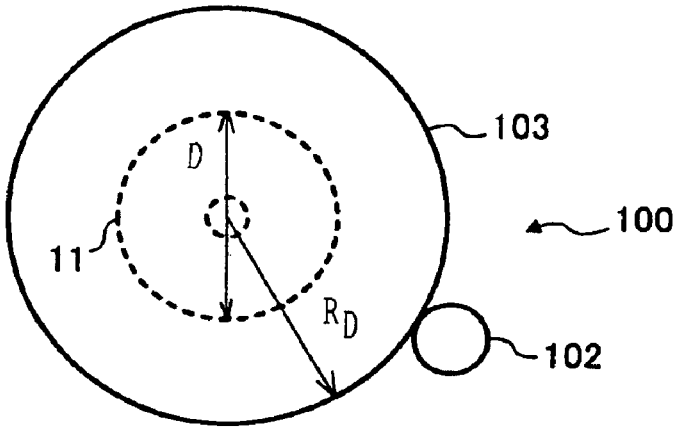
FIG. 2A is a front view showing a drum drive unit included in the illustrative embodiment.
Figure 2B:
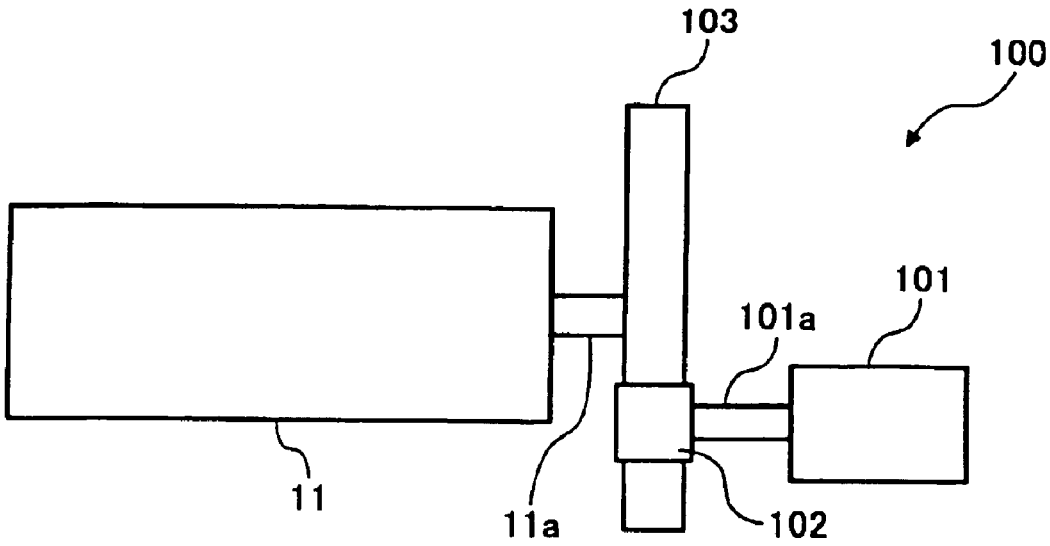
FIG. 2B is a side elevation showing the drum drive unit.

As shown in FIGS. 2A and 2B, the drum drive unit, generally 100, includes a drive motor or drive source 101 having an output shaft 101*a* on which a drive gear 102 is mounted. The rotation of the drive motor 101 is transmitted to the drum 11 via the drive gear or drive member 102 and a driven gear or driven transmission member 103, which is coaxial with the shaft 11*a* of the drum 11. This kind of driveline is often used because energy available with the drive motor 10*s* can be efficiently used. Various kinds of gears are applicable to the drive gear 102 and driven gear 103.

In the drive system including the driven gear 103, as shown in FIGS. 2A and 2B, the rotation speed of the drum 11 is apt to vary due to the eccentricity and cumulative tooth pitch error of the driven gear 103.

Generally, use is made of a system in which even if the drum 11 has eccentricity or the scatter of a radius, color misregister does not occur so long as the angular velocity of the drum 11 and the moving speed of the belt 40 are constant. The prerequisite with such a system is that a given portion of the surface of the drum 11 has the same angular velocity at both of the exposure position Pex and transfer position Pt. If the distance between the axis of the drum 11 and the exposure position Pex is greater than the mean radius of the drum 11 due to the eccentricity of the drum 11, then the peripheral speed of the drum 11 increases and extends exposed pixels (latent image). However, because the peripheral speed of the drum 11 is high even when such pixels are transferred to the sheet 2, the pixels are shortened if the moving speed of the belt 40 is constant, i.e., the length of the pixels does not vary. This holds when the angular velocity of the drum 11 does not vary.

However, in the drum drive unit shown in FIGS. 2A and 2B, even if the drive motor 101 rotates at a constant speed, any eccentricity or any cumulative tooth pitch error of the driven gear 103, which is coaxial with the drum 11, causes the rotation speed of the drum 11 to vary.

The combined variation $\epsilon$ of the eccentricity and cumulative tooth pitch error of the driven gear 103 influences color misregister with an influence coefficient $\kappa$ expressed as:

$$\kappa=(R_{OD}/R_D)\{\cos Po-2\cos(\Theta_{ET}+Po)\cos(2\Theta_{ET}+Po)\} \quad \text{Eq. (1)}$$

where $R_{OD}$ denotes the radius of the drum 11, $R_D$ denotes the radius of the driven gear 103, and Po denotes a phase difference between the angular position of the combined variation $\epsilon$ of the driven gear 103 and the exposure angular position. The influence coefficient $\kappa$ is representative of the influence of the combined variation $\epsilon$ on the amount of color misregister $\Delta$; there holds a relation of $\Delta=\kappa\epsilon$. Because the cumulative tooth pitch error, for example, brings about color misregister like the eccentricity, the combined variation $\epsilon$ is the combined vector of such errors and eccentricity with the phase difference in the direction of rotation being taken into account.

Figure 3:
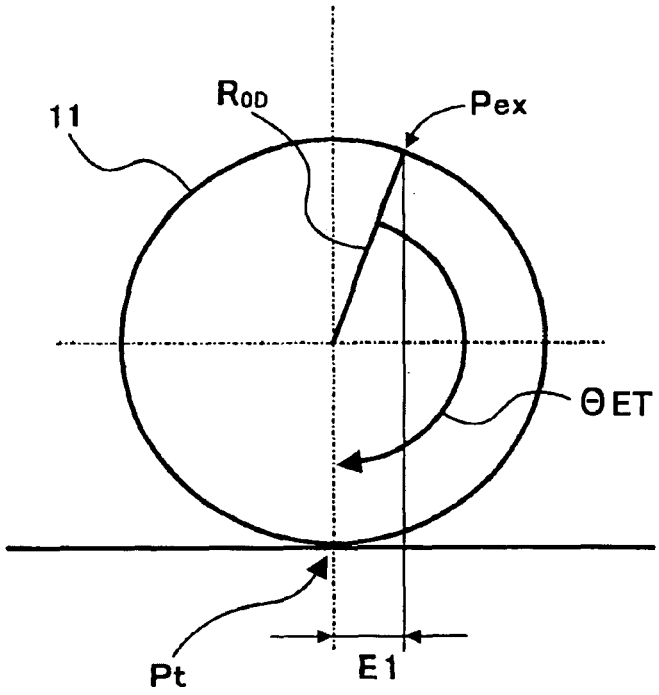
FIG. 3 shows a relation between an exposition position Pex and an image transfer position Pt assigned to a photoconductive drum included in the illustrative embodiment.

In the Eq. (1), $\Theta_{ET}$ is representative of an angle between the exposure position Pex and the transfer position Pt (see FIG. 3) and is expressed as:

$$\Theta_{ET}=(\pi/2)+\arccos(E1\ R_{OD}) \quad \text{Eq. (2)}$$

For example, assuming that $\Theta_{ET}$ is 2.90 and $R_{OD}/R_D$ is ⅓, then the Eq. (1) is rewritten as:

$$\kappa=(⅓)\{\cos Po-2\cos(2.90+Po)+\cos(2\times2.90+Po)\} \quad \text{Eq. (3)}$$

Figure 4:
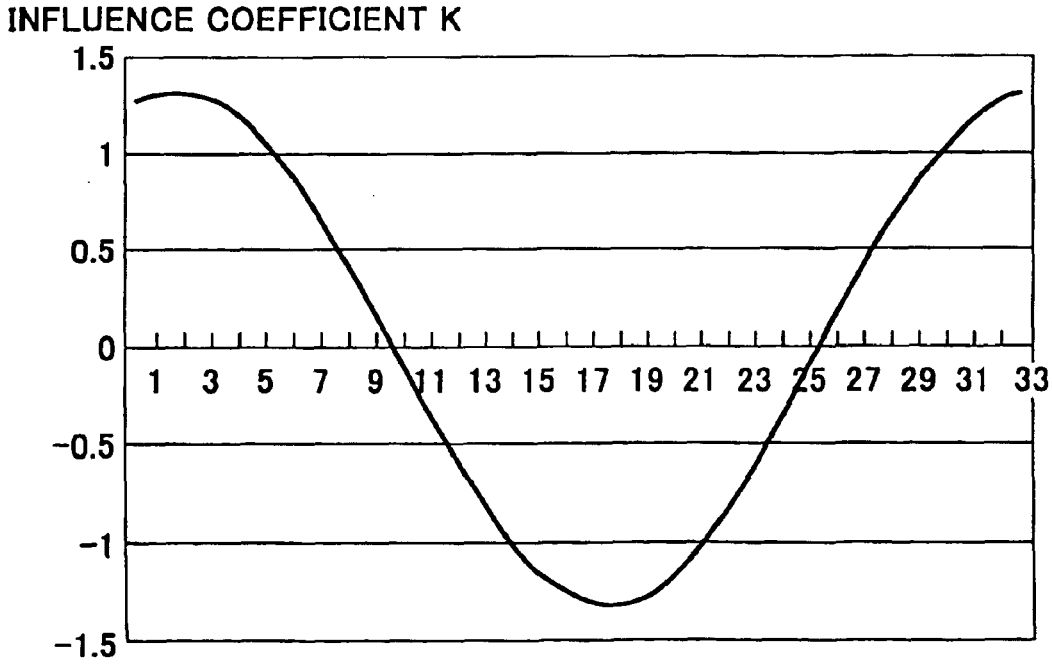
FIG. 4 is a graph showing an influence coefficient $\kappa$ with which the combined variation $\epsilon$ of a drum driven gear, which brings about the speed variation of the drum, influences color misregister.

The Eq. (3) is represented by a graph in FIG. 4. In FIG. 4, the abscissa indicates the phase difference Po between the combined variation $\epsilon$ of the driven gear 103 and the exposure angular position at the moment of exposure. The relation between the phase difference Po and the scale of the abscissa is represented by:

$$\text{scale}=\text{phase difference } Po(\text{rad})\times5 \quad \text{Eq. (4)}$$

or $$Po(\text{rad})=\text{abscissa scale}/5 \quad \text{Eq. (5)}$$

As shown in FIG. 4, the amount of color misregister (phase error) varies at a period corresponding to one rotation of the driven gear 103; the maximum influence coefficient $\kappa$ is 1.3. More specifically, the ratio of the radius $R_D$ of the driven gear 103 to the radius $R_{OD}$ of the drum 11 is selected to be 3:1 in order to reduce the influence of the combined variation $\epsilon$ of the driven gear 103 to one-third. However, the variation phase of the rotation speed ascribable to the combined variation e of the driven gear 103 differs substantially by $\pi$ between the exposure position Pex and the transfer position Pt, so that the influence of the difference n7 substantially quadruples the amount of color misregister and eventually makes $\kappa$ 1.3. It is therefore necessary to reduce the combined variation $\epsilon$. To implement high image quality, the driven gear 103 must be machined and assembled with high accurately. If the accurate machining of the driven gear 103 is impracticable in the aspect of cost, then the size of the combined variation e can be confined in an allowable range by the following method of assembling the driven gear 103.

Figure 5:
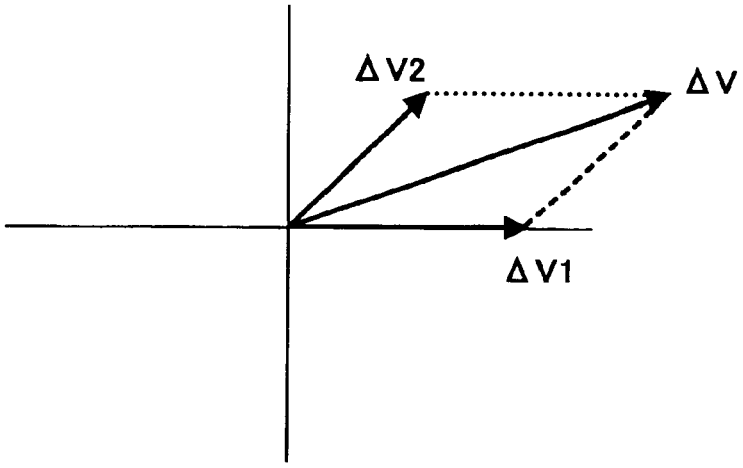
FIG. 5 is a graph showing the speed variation vector of the driven gear.

The rotation speed of the driven gear 103 varies in a sinusoidal manner due to the eccentricity of the cumulative tooth pitch error thereof. For example, as shown in FIG. 5, a rotation speed variation vector $\Delta V1$ ascribable to eccentricity and a rotation speed variation vector $\Delta V2$ ascribable to cumulative tooth pitch error are combined to appear as a combined rotation speed variation vector $\Delta V$. While the drum 11 is generally replaced when its service life ends, the driven gear 103 is usually not dismounted from the printer.

Figure 6:
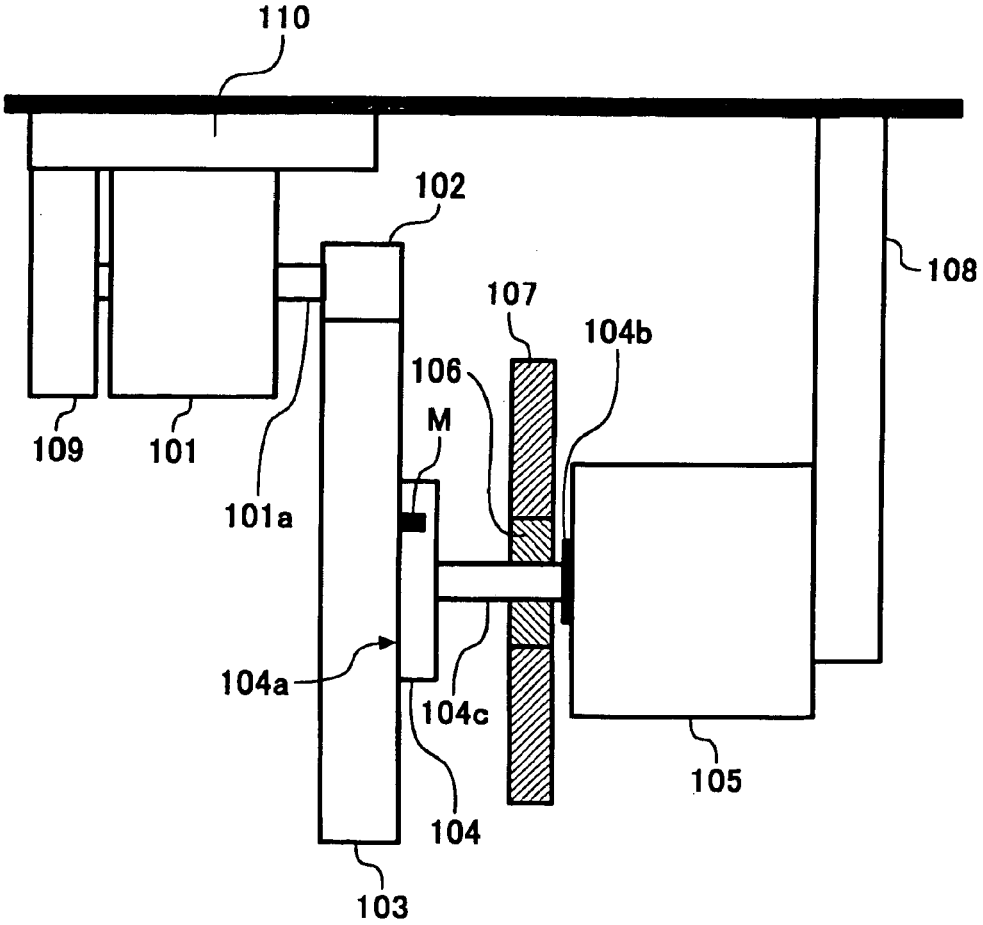
FIG. 6 shows a system included in the illustrative embodiment for adjusting the position of the driven gear.

In light of the above, as shown in FIG. 6, the drum drive unit of the illustrative embodiment is configured such that the driven gear 103 can be adjusted on the production line. As shown, the drum drive unit includes an auxiliary roller member 104 playing the role of a relaying member connecting the driven gear or driven transmission member 103 and drum 11. The auxiliary roller member 104 includes a gear mount portion or driven member mount portion 104*a* on which the driven gear 103 is mounted and a drum mount portion or image carrier mount portion 104*b* on which the drum 11 is mounted. The gear mount portion 104*a* is configured such that the driven gear 103 can be selectively unfixed and bidimesionally moved along a plane perpendicular to the axis of the driven gear 103. The drum mount portion 104*b* allows the drum 11 and an encoder or rotation sensing member 105 to be mounted thereto. The encoder 105 plays the role of absolute rotation angle sensing means.

A shaft 104*c* connecting the two mount portions 104*a* and 104*b* is supported by a support member 107 via a bearing 106. The encoder 105 is mounted on a support portion 108 included in the printer body. An encoder 109 is mounted on the output shaft 101*a* of the drive motor 101. The drive motor 101 is mounted on a position adjusting device 110 that allows the position of the drive motor 101 to be adjusted in accordance with the adjustment of the driven gear 103.

In the drum drive unit having the above configuration, the driven gear 103 is adjusted by the following procedure. In a first step, the driven gear 103 is temporarily adhered to the surface of the gear mount portion 104*a* by adhesive such that the former can be easily removed from the latter. Subsequently, a mark is put on the driven gear 103 at the same angular position as a mark M provided on the auxiliary roller member 104 beforehand and representative of a reference angular position. The driven gear auxiliary roller 104 is then positioned such that the mark M aligns with a mark provided on the support member 107 and representative of a reference position or home position.

In a second step, the encoder 105 capable of sensing an absolute angle is mounted to the drum mount portion 104*b* of the auxiliary roller member 104. Subsequently, the drive gear 102 having a small radius is brought into mesh with the driven gear 103, which is the subject of adjustment. With the encoder 105, it is possible to detect the variation of rotation speed of the driven gear 103 ascribable to eccentricity or a cumulative tooth pitch error. The drive gear 102 is mounted on one end of the output shaft 101*a* of the drive motor 101 and driven at a constant speed.

An encoder 109 is mounted on the other end of the output shaft 101*a* of the drive motor 101, so that the speed of the drive motor 101 is controlled in accordance with the output of the encoder 109. If the radius of the drive gear 102 is sufficiently smaller than the radius of the driven gear 103 (e.g. one-tenth), then the variation of the rotation speed of the drive gear 102 ascribable to, e.g., eccentricity lies in a sufficiently high frequency side, compared to the variation of the rotation speed of the driven gear 103. It follows that the component of the output of the encoder 105 derived from the variation of the rotation speed of the drive gear 102 can be canceled by a low-pass filter. The position adjusting device 110 is used to adjust the position of the entire driveline, which includes the drive gear 102 and drive motor 101, in accordance with the adjusted position of the driven gear 103.

Figure 7:
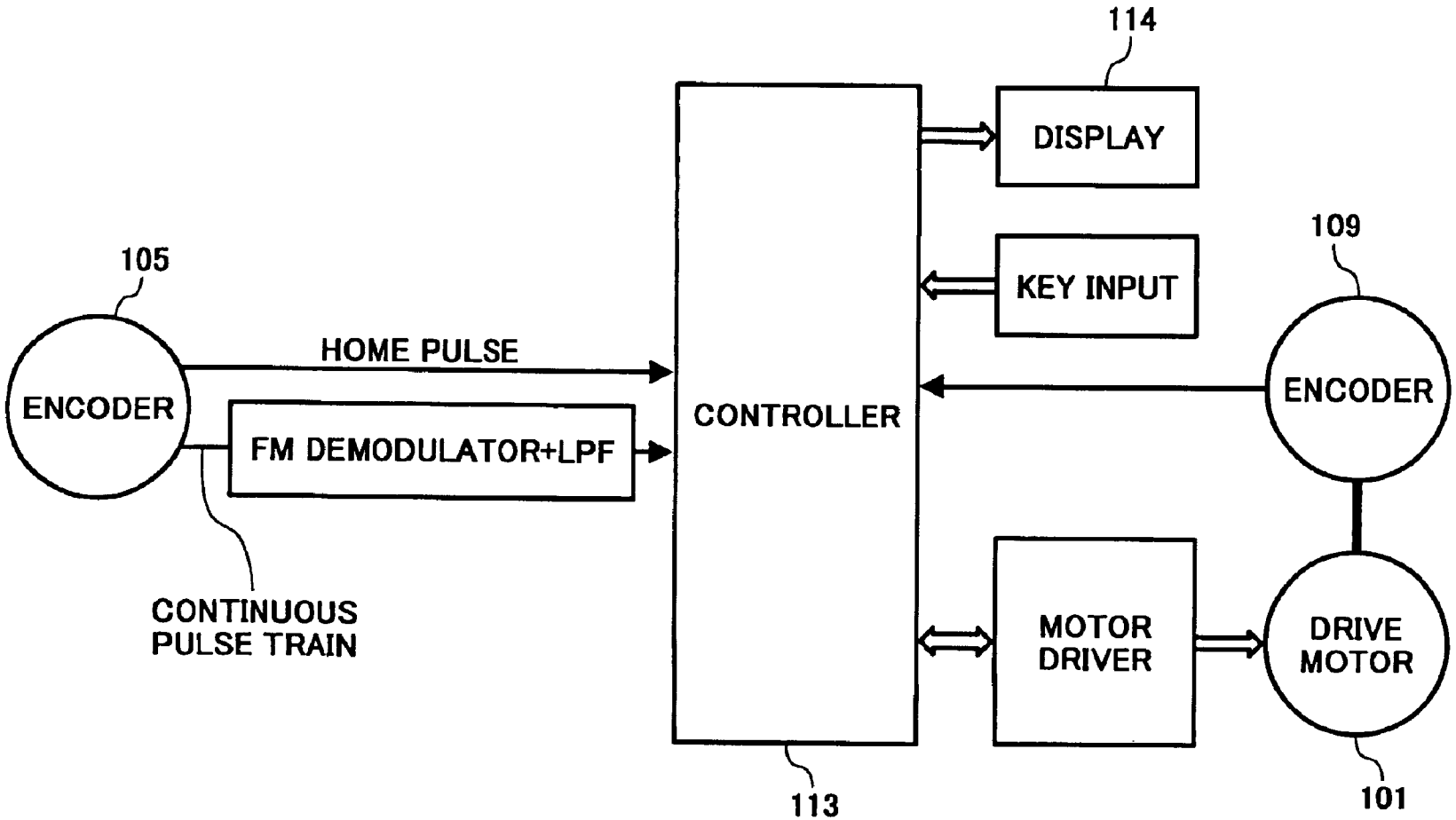
FIG. 7 is a block diagram schematically showing a speed variation detecting system.

In a third step, a sensing system shown in FIG. 7 senses the home position angle $\Theta_H$ of the mark M. Subsequently, while the driven gear 103 is rotated at a constant speed, the sensing system demodulates a pulse train output from the encoder 105 by FM (Frequency Modulation) to thereby determine the size of the combined variation $\epsilon$ and the absolute angle $\Theta_V$ of the maximum variation $\epsilon$ of the driven gear 103.

Figure 8B:
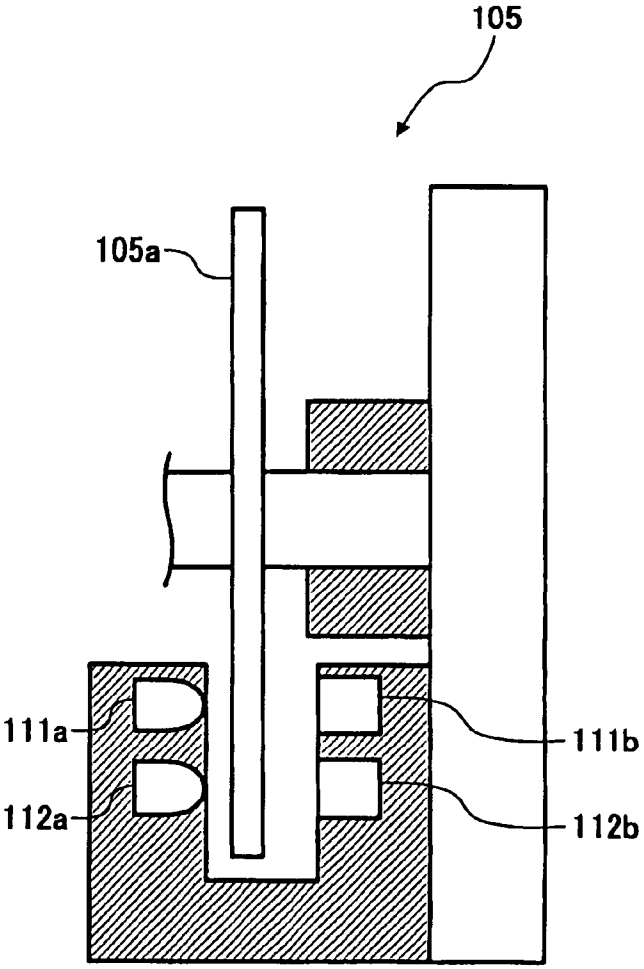
FIG. 8B is a sectional side elevation showing part of the encoder.
Figure 8A:
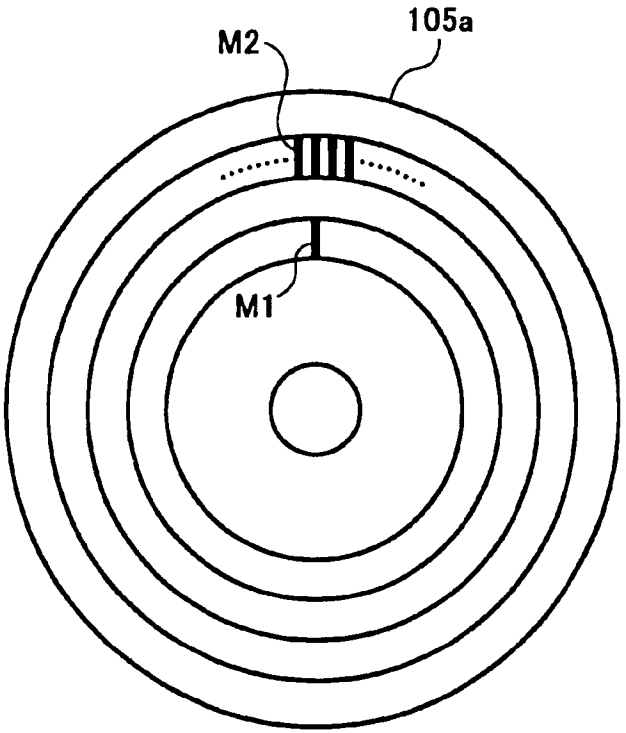
FIG. 8A is a front view showing an encoder disk forming part of an encoder.

FIGS. 8A and 8B show a specific configuration of the encoder 105. As shown, the encoder 105 includes an encoder disk 105*a* implemented as a transparent member and provided with a mark M1 and a series of marks M2. The mark M1 is representative of a home position and outputs a single pulse for one rotation of the encoder disk 105*a* while the series of marks M2 output a continuous pulse train. More specifically, a transmission type mark sensor made up of a light emitting device 111*a* and a light-sensitive device 111*b* senses the mark M1 representative of the home position. A transmission type mark sensor made up of a light emitting device 112*a* and a light-sensitive device 112*b* senses the series of marks M2. The continuous pulse train is counted until a pulse corresponding to the mark M1 has been sensed, thereby sensing the home position angle $\Theta_H$. While the size $\epsilon$ of the maximum combined variation measured by the encoder 105, of course, varies with the eccentricity or the cumulative tooth pitch error of the driven gear 103, it varies due to the structure of the encoder 105 itself, too. In light of this, a relation between the variation of the driven gear 103 including the maximum combined variation $\epsilon$ ascribable to, e.g., eccentricity, the amplitude of measured data and the rotation speed of the drive motor 101 is determined beforehand. This allows a target variation to be set and allows the position of the driven gear 103 to be so adjusted as not to exceed the target variation.

In a fourth step, a controller 113 included in the sensing system, FIG. 7, produces a sum $\Theta a$ of the home position angle $\Theta_H$ and absolute variation angle $\Theta_V$ and then executes measurement with a principle to be described hereinafter. The controller 113 then shows on a display 114 an adjustment angle $\Theta\epsilon$ from the previously mentioned mark in the direction of adjustment together with the amount of adjustment $\epsilon$. In FIG. 6, while the drive motor 101 is in rotation at a constant speed, the minimum rotation speed variation of the driven gear 103 appears when the maximum combined variation $\epsilon$ arrives at a line connecting a point where the drive gear 102 and driven gear 103 contact each other and the axis of the driven gear 103. More specifically, the peripheral speed at the point where the drive gear 102 and driven gear 103 contact each other is constant. Therefore, taking eccentricity as an example, the distance from the axis of the driven gear 103 to the above point of contact is maximum, so that the rotation speed of the driven gear 103 is minimum.

After the mark M has aligned with the reference position or home position mark of the support member 107, a command is input to the controller 113 via a key input section in order to cause the controller 113 to start rotating the drive motor 101. Assume that the series of marks M2 are counted from the time when the drive motor 101 starts rotating to the time when the home position mark M1 is sensed, thereby determining an angle $\Theta_H$. Also, assume that the series of marks M2 are counted from the home position mark M1 where the minimum rotation speed variation appears, thereby determining an angle $\Theta_V$. Then, when the mark M is moved by the angle $\Theta a$ ($=\Theta_V+\Theta_H$) in the direction of rotation of the drive motor 101, the maximum combined variation $\epsilon$ appears at the point of contact of the drive gear 102 and driven gear 103. Therefore, assuming that the home position mark of the support member 107 has an absolute angle of 0° and that the above point of contact has an absolute angle of 90° in the direction of rotation of the drive motor 101, then the maximum combined variation $\epsilon$ lies at an angular position $\Theta c=90°-\Theta a$ as measured from the mark M. It follows that the axis of the driven gear 103 should only be shifted in the direction opposite to the angular position $\Theta c$ from the mark M, i.e., in the direction of an angle $\Theta\epsilon=\Theta c-180°$.

In a fifth step, the rotation of the drive roller 101 is stopped. Subsequently, the driven gear 103 is removed from the auxiliary roller member 104 and then moved by the measured size $\epsilon$ of the rotation speed variation in a direction rotated from the mark of the driven gear 103, which has been put in the first step, by the angle $\Theta\epsilon$ indicated on the display 114, in the direction of rotation of the drive motor 101. The driven gear 103 is then again temporarily adhered to the auxiliary roller member 104.

In a sixth step, the third and fourth steps are repeated to see if the measured rotation speed variation $\epsilon$ is smaller than a preselected standard value. Thereafter, the driven roller 103 is adhered to the auxiliary roller member 104. If the measured variation $\epsilon$ is greater than the standard value, then the first step and successive steps are repeated; in this case, the driven roller 103 does not have to be removed from the auxiliary roller member 104.

The first step to the sixth step are executed with all of the four driven gears 103 for thereby reducing color misregister when a full-color image is formed.

Second Embodiment

Figure 9:
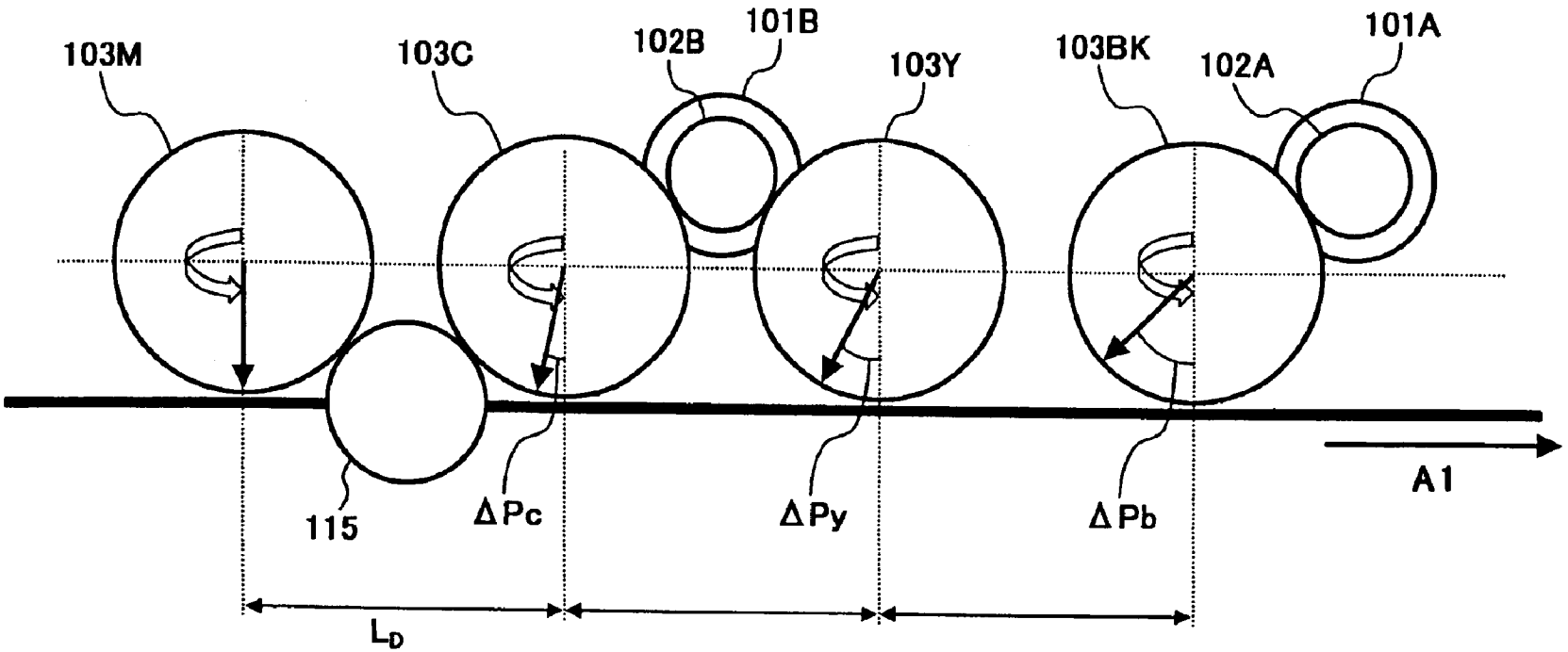
FIG. 9 is a view showing a drum drive unit included in a second embodiment of the present invention and demonstrating a principle with which the illustrative embodiment matches the phases of drum speed variations.

A second embodiment is identical with the first embodiment except for the drum drive unit. The second embodiment does not reduce the rotation speed variation of the driven gear itself, but matches the phases of the rotation speed variations of the driven gears ascribable to, e.g., eccentricity. FIG. 9 shows the drum drive unit of the illustrative embodiment and indicates the principle of phase matching unique to the illustrative embodiment. Before the drum drive unit is mounted to the printer body, adjustment is effected with an encoder of the type sensing an absolute angle mounted in place of the drum.

As shown in FIG. 9, the drum drive unit includes a drive motor 101A assigned to the BK drum and a drive motor 101B shared by the M, C and Y drums. A driven gear member 103C associated with the C drum 11C (C drive gear 103C hereinafter) transmits the rotation of the drive motor 101B to a driven gear 103M associated with the M drum 11M (M driven gear 103M hereinafter) via an idler 115. Gear members 103C and 103M are separated by a distance $L_D$. Why two drive motors 101A and 101B are used is that in a 10 black-and-white mode only the drive motor 101A is driven while the other drums 11M through 11Y are released from the belt 40 by mechanisms not shown. Therefore, even if the phases of rotation speed variations of the four driven gears 103 are matched on the production line, the phases are brought out of matching when only a driven gear 103BK associated with th BK drum (BK driven gear 103BK hereinafter) is moved. Consequently, when the drive motors 101A and 1018 are driven to execute a full-color mode later, color misregister occurs.

How the illustrative embodiment matches the phases of rotation speed variations ascribable to the driven gears 103 in accordance with the output of an encoder will be described hereinafter. While an encoder, of course, senses an absolute rotation angle, the resolution of the encoder (number of pulses for a single rotation) is so selected as to be sufficiently higher in frequency than the rotation speed variation of the driven gear 103. Assuming that the number of pulses output from the encoder for a single rotation is $R_N$ and that the rotation angle frequency of the encoder is $\omega N$, then the output frequency fe of the encoder is expressed as:

$$fe=R_N\times\omega_N/(2\pi)+\Delta fo\times\sin(\omega_N\times t+\phi o)+\Delta f1\times\sin(\alpha r\times\omega_N\times t+\phi 1)+\Delta f_H\times\sin(\alpha_H\times\omega_N\times t+\phi H)+\ldots \quad \text{Eq. (6)}$$

where $\Delta fo$ denotes the amplitude of rotation speed variation ascribable to the eccentricity or the cumulative tooth pitch error of the driven gear 103, $\Delta f2$ denotes the amplitude of rotation speed variation ascribable to the eccentricity or the cumulative tooth pitch error of the idler associated with the M drum, $\Delta f_H\times\sin(\alpha_H\times\omega_N\times t+\phi_H)+\ldots$ denotes a high-frequency rotation speed variation ascribable to the drive motor or the drive gear, $\alpha r$ denotes a gear ratio between the driven gear and the idler gear, $\alpha_H$ denotes a frequency ratio between the high-frequency variation component and the driven gear, and $\phi o$, $\phi 1$ and $\phi_H$ denote the phases of the rotation speed variation components.

Therefore, the components of the Eq. (6) except for the first term of the right member are representative of the rotation speed variation components of the gear and other members. It follows that by demodulating the encoder output by FM, it is possible to obtain the output of the right member of the Eq. (6) not including the first term as a carrier. High-frequency components should only be canceled by a filter.

The phase of the rotation speed variation of each driven gear is adjusted by the following procedure. In FIG. 9, assume that the drum 11 has a rotation angular velocity $\omega o$, that the belt 40 moves at a linear velocity $V_b$, that the drum 11 has a radius $R_D$, and the distance between nearby drums 11 (drum distance hereinafter) is $L_D$. Then, the peripheral speed $V_D$ of the drum 11 is expressed as:

$$V_D=R_D\times\omega o \quad \text{Eq. (7)}$$

A period of time T necessary for the belt 40 to move the drum distance $L_D$ is produced by:

$$T=L_D/Vb \quad \text{Eq. (8)}$$

A toner image transferred from the M drum 11M to the sheet 2 meets a toner image to be transferred from the C drum 11C in a period of time t=T. Therefore, when t is zero, the virtual angular position of the C drum 11C is expressed as:

$$\theta c=\omega oT=\omega o\times L_D/Vb=(L_D/R_C)\cdot(V_D/Vb)=2\pi+\Delta P \quad \text{Eq. (9)}$$

Adjustment of Driven Gears

The illustrative embodiment executes the following processing to adjust the phases of rotation speed variations ascribable to positional deviations derived from the eccentricity or the cumulative tooth pitch errors of the driven gears 103M, 103C, 103Y and 103BK. In FIG. 9, assume that the phase of the positive peak angle of rotation speed variation ascribable to the positional deviation of the driven gear 103M with respect to a reference angular position is zero. Then, the positive peak angle phases $\Delta Pc$, $\Delta Py$ and $\Delta Pb$ of the other driven gears 103C, 103Y and 103BK are respectively expressed as:

$$\Delta Pc=\Delta P \quad \text{Eq. (10)}$$

$$\Delta Py=2\times\Delta P \quad \text{Eq. (11)}$$

$$\Delta Pb=3\times\Delta P \quad \text{Eq. (12)}$$

When the maximum positional deviation ascribable to the eccentricity or the cumulative tooth pitch error of the driven gear 103BK arrives at the point of contact of the driven gear 103BK and drive gear 102A during one rotation of the drive motor 101A, the speed of the drum 103BK is minimum. It is to be noted that setting the relative phase difference between the drums suffices, and therefore phase matching can be based on the positive peak angle of rotation speed variation.

Adjustment of M Driven Gear 103M

The phase vector of rotation angle variation particular to the M drive gear 103M is the sum of the phase vector of the rotation angle variation of the C driven gear 103C and that of the rotation angle variation of the M driven gear 103M itself. In a strict sense, the above phase vector includes the phase of the rotation speed variation of the idler 115 as well. However, the frequency of the rotation speed variation of the M driven gear 103 can be sensed without regard to the idler 115 if a ratio between the number of teeth (radius) of the idler 115 and that of the driven gear 103M is sufficiently small (e.g. 1:10).

Although the number of teeth of the idler 115 may be equal to the number of teeth of the M driven gear M, such a relation causes even the rotation speed variation of the idler 115 to appear as the rotation speed variation of the M driven roller 103M. If the number of teeth of the idler 115 is closed to, but different from, the number of teeth of the M driven roller 103 (e.g. 1:2), then there arises a problem that the peak position phase of the rotation speed variation of the M drum 11M is shifted (the variation amplitude varies in the peak phase). Two different methods are available for the adjustment of the drum drive unit. In a first method, an exclusive drive motor 101C for measurement is mounted to the M driven gear 103M in place of the drive motor 101A without the idler 115 being mounted. In this condition, the positive peak phase of the rotation speed variation of the M drum 11M is measured. As for the M driven gear 103M and C driven gear 103C, the amplitude of rotation speed variation is measured, too. This is because the phase of the rotation speed variation of the M driven gear 103M is susceptible to the C driven gear 103C, and therefore the phase vectors of their rotation speed variations must be combined to produce the rotation speed variation of the M drum 11M. In a second method, the output waveform of the encoder is analyzed without modifying the configuration shown in FIG. 9.

Figure 10:
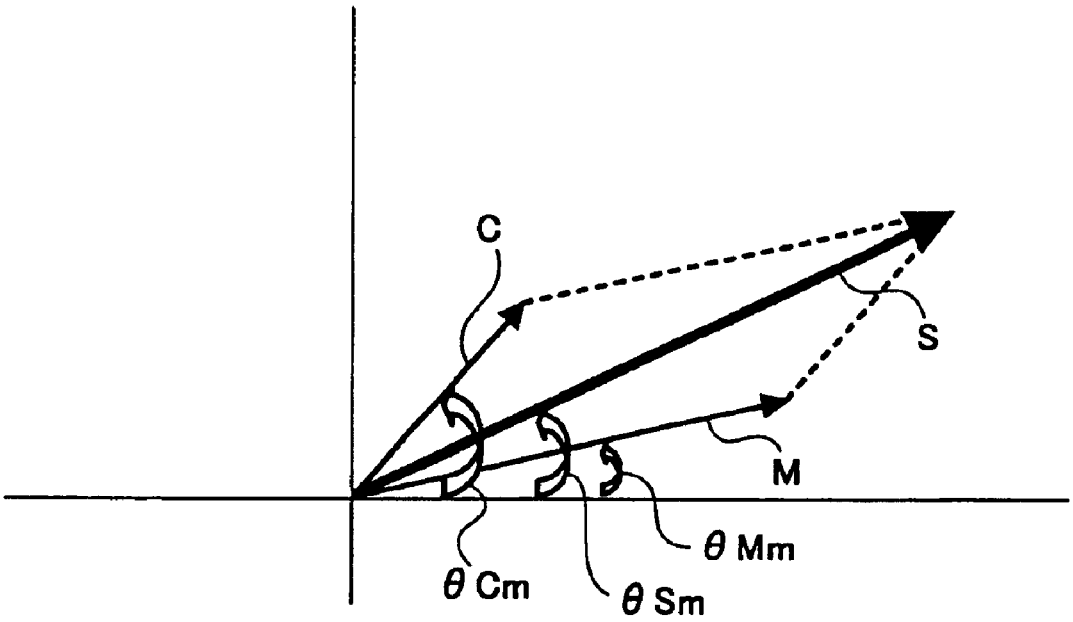
FIG. 10 is a graph showing the speed variation vector of a driven gear.

The principle of the first method mentioned above will be described with reference to FIG. 10. As shown, the positive peak values of the rotation speed variations of the M driven gear 103M and C driven gear 103C have phase vectors C and M, respectively. The combined vector S×expjθSm of the two phase vectors C and M is produced by Eqs. (13) through (16):

$$S^2 = M^2 + C^2 - 2MC\cos\{\pi - (\theta Cm - \theta Mm)\} = M^2 + C^2 + 2MC\cos(\theta Cm - \theta Mm) \quad \text{Eq. (13)}$$

$$s=\{M^2+C^2+2MC\cos(\theta Cm-\theta Mm)\}^{1/2} \quad \text{Eq. (14)}$$

$$S\cos\theta Sm=M\cos\theta Mn+C\cos\theta Cm \quad \text{Eq. (15)}$$

$$\theta Sm=\arccos\{(M/S)\cos\theta Mn+(C/S)\cos\theta Cm\} \quad \text{Eq. (16)}$$

Adjustment is therefore executed such that the phase of the combined vector S×expjθSm derived from the Eqs. (14) and (16) with respect to the reference angular position of the M driven gear 103M becomes zero. More specifically, assuming that θCm is located at ΔPc, FIG. 9, then the set positive peak angle of the speed variation of the M driven gear 103M is selected such that the phase of the combined vector S×expjθSm with respect to the reference angular position of the M driven gear 103M is zero.

The principle of the second method mentioned earlier will be described with reference to FIG. 11. As shown, phase vectors at the positive peak values of the rotation speed variations of the M driven gear 103M and C driven gear 103C constitute a combined vector MCexpj(θMCm). The rotation speed variation of the idler 115 has a vector Iexpj{θIm(t)}. The combined vector SI(t)expj{θSIm(t)} of the two vectors MCexpj(θMCm) and Iexpj{θIm(t)} is produced by the following Eqs. (17) through (20):

$$SI^2 = MC^2 + I^2 - 2MC \times I\cos\{\pi - \{\theta MCm - \theta Im(t)\}] = MC^2 + I^2 + 2MC \times I\cos\{\theta MCm - \theta Im(t)\} \quad \text{Eq. (17)}$$

$$SI=[MC^2+I^2+2MC\times I\cos\{\theta MCm-\theta Im(t)\}]^{1/2} \quad \text{Eq. (18)}$$

$$SI\cos\{\theta SIm(t)\}=MC\cos\theta MCm+I\cos\{\theta Im(t)\} \quad \text{Eq. (19)}$$

$$\theta SIm(t)=\arccos\{(MC/SI)\cos\theta MCm+(I/SI)\cos\{\theta Im(t)\}\} \quad \text{Eq. (20)}$$

Figure 11:
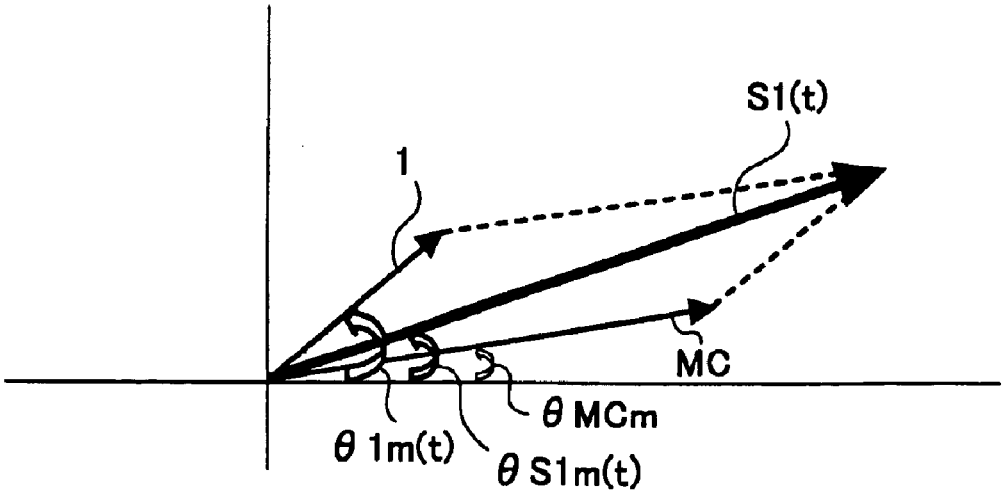
FIG. 11 is a graph showing the speed variation of the driven gear.

On the coordinates shown in FIG. 11, the rotation speed variation vector of the idler different in rotation period from the driven tears is rotating.

As the Eq. (18) indicates, the maximum amplitude SI is obtained when θMCm is equal to θIm(t). Therefore, to determine the combined phase vector MCexpj(θMCm) while maintaining the idler 115 in mesh with the M driven gear 103M and C drive gear 103C, it suffices to determine the maximum value of the overall combined phase vector and measure the absolute angle θSIm(t) corresponding to the maximum value. That is, despite the presence of the idler 115, it suffices to effect measurement by paying attention to the positive peak values of the variations.

The above adjustment is a measure for preventing the total positional deviation of the positional deviations occurring at the individual drums from increasing. When such phase adjustment is effected, the total positional deviation (color misregister) δh is equal to a difference δh between the maximum positional deviation δh(max) and the minimum positional deviation δh(min), i.e., δh=δh(max)−δh(min). When the minimum positional deviation δh(min) is zero, the maximum positional deviation δh(max) occurs.

A specific assembling and adjusting method will be described hereinafter. While the rotation speed variation of the individual driven gear 103 is ascribable to eccentricity, cumulative tooth pitch error and so forth, such factors are combined to constitute the variation of a single driven gear. However, as for the M drum 11M, FIG. 9, the variation of the C drum 11C is added to the variation of the M drum 11M. Taking this into account, the foregoing description showed a first adjusting method that measures the variations of the individual driven gears 103 one by one and then effects adjustment in accordance with the results of calculation, and a second adjusting method that totally measures variations inclusive of the idler 115 and then effects adjustment. The following description will concentrate on the second adjusting method.

Figure 12:
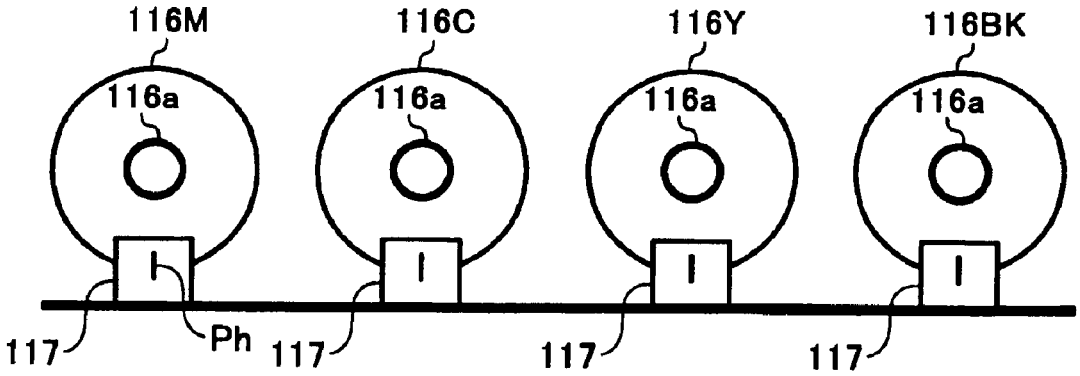
FIG. 12 demonstrates how the rotation positions of individual driven gears are adjusted.

Adjustment is executed with the drum drive unit not including the drums, but including the idler 115 and driven gears 103. As shown in FIG. 12, there are prepared four encoders 116M, 116C, 116Y and 116BK of the type sensing an absolute angle and each including a receptor 116*a* to which the shaft of the associated driven gear 103 can be connected, and a jig including mount portions for mounting the encoders. Home sensing angles (phases) assigned to four encoder home positions 117 are identical.

Figure 13:
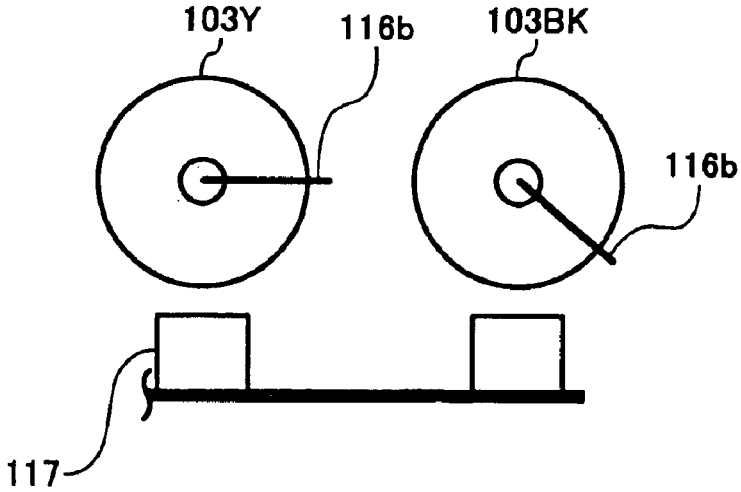
FIG. 13 demonstrates how the home position of a driven gear assigned to black and that of a driven gear assigned to yellow are adjusted.

In FIG. 9, the phase of the BK drive motor 101A and that of the other drive motor 101B are usually controllable independently of each other. More specifically, only the BK drive motor 101A is driven in a black-and-white mode, so that they should be prevented from being shifted on the production line after the phase adjustment of the driven gears to be described hereinafter. It is therefore necessary to sense the home position of the individual driven gears even when pulse motors are used to drive the driven gears. For this purpose, as shown in FIG. 13, a mechanism in which the BK driven gear 103BK and Y driven gear 103Y each are provided with a light intercepting bars 116*b* responsive to a home position is arranged in the printer. The bars 116*b* both are located at respective home positions when in expected positions. Therefore, when the black-and-white mode ends and is switched to a color print mode, a controller rotates the two drive motors 101A and 101B and brings the two bars 116*b* to the home positions. In the color print mode to follow such control, the individual drums 11 rotate in the adjusted phases. While the positions of the two optical sensors 117 are set in the above specific case, the positions do not have to be identical with each other. Of course, the optical sensing system may be replaced with, e.g., a magnetic sensing system.

A specific procedure for the adjustment is as follows. In a first step, the shafts of the driven gears 103 included in the drum drive unit are set on adjustment equipment. In a second step, to determine the reference rotation angle of each driven gear 103, a reference mark is put on each driven gear 103 corresponding to a home sensing position Ph shown in FIG. 12.

Figure 14:
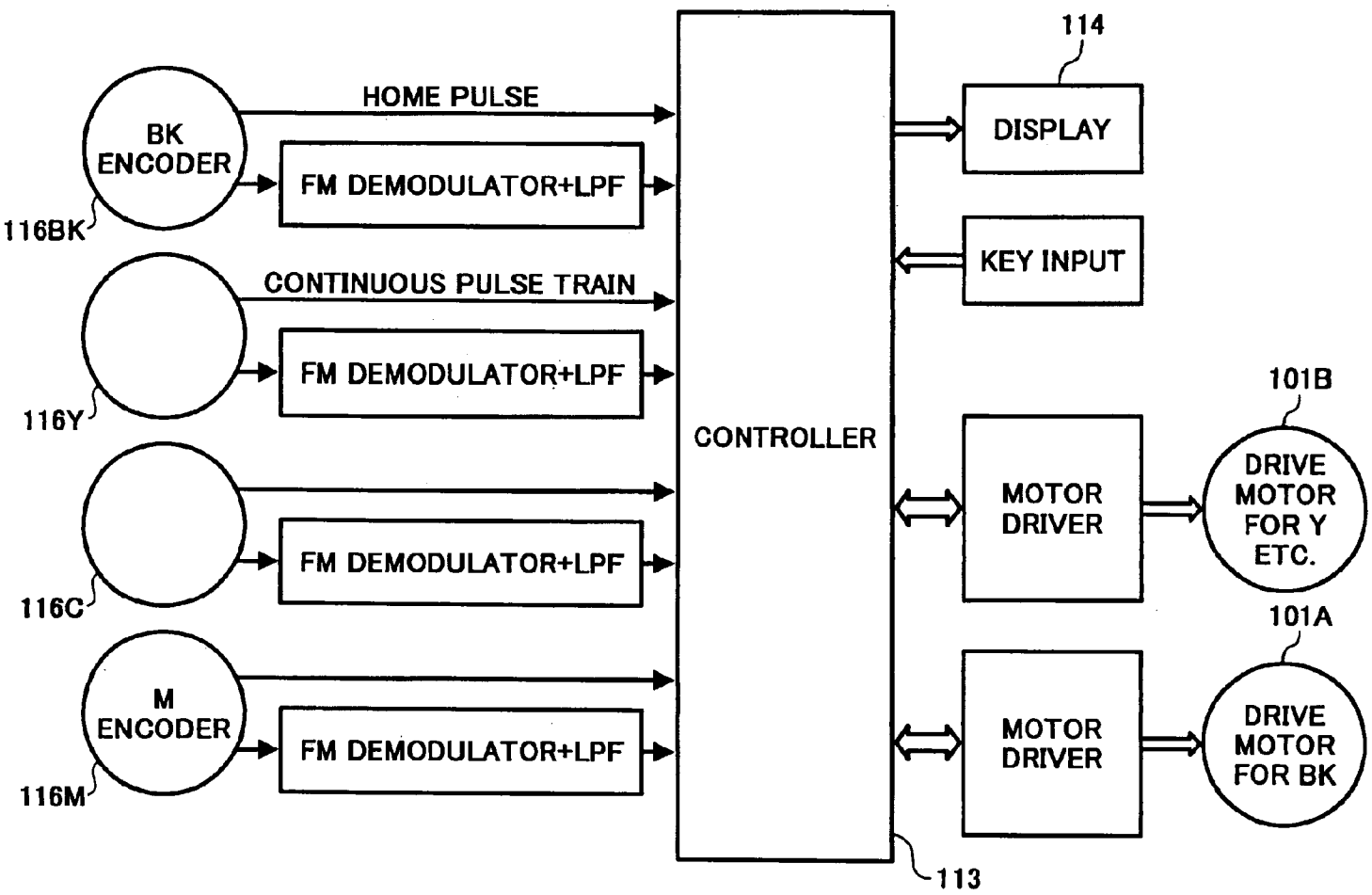
FIG. 14 is a schematic block diagram showing a system for controlling the drive of drums.

In a third step, a controller or drive control means 113 shown in FIG. 14 and included in the adjustment equipment starts driving the drive pulse motors 101A and 101B slowly to a preselected speed in the same direction as during printing such that the pulse motors 101A and 101B do not lose synchronism. At this instant, the controller 113 determines how absolute positions on the encoders 116M through 116BK were positioned relative to the home sensing positions Ph at the first stop position. More specifically, after the start of rotation, the controller 113 counts pulses output from each encoder to thereby measure an angle Θci at which the home position mark is sensed at the home sensing position Ph, thereby determining an absolute angle Θoi (=2π−Θci) where the home position mark was positioned. This step is not necessary when use is made of encoders of the type outputting absolute position information and therefore allowing the initial angles of still positions to be immediately determined.

In a fourth step, after preselected rotation, the FM waves of the encoder outputs each are demodulated to determine the absolute angle ΘDmi (e.g. i=0 for the M drum and i=1 for the C drum) corresponding to the maximum amplitude. At this instant, rotation angle variations ascribable to members other than the driven gears and idler are canceled by low-pass filters, as shown in FIG. 14.

In a fifth step, the controller 113 calculates the phase adjusting position of each drive gear, i.e., the correction angle Θci as measured from the reference mark position (in the direction opposite to the rotation of the driven gear). For this calculates, there may be used either one of Eqs. (21) through (24) and Eqs. (25) through (28):

$$M \text{ driven gear: } \Theta c0=-\Theta o0+\Theta Dm0 \quad \text{Eq. (21)}$$

$$C \text{ drive gear: } \Theta c1=-\Theta o1+\Theta Dm1+\Delta P \quad \text{Eq. (22)}$$

$$Y \text{ driven gear: } \Theta c2=-\Theta o2+\Theta Dm2+2\times\Delta P \quad \text{Eq. (23)}$$

$$BK \text{ driven gear: } \Theta c3=\Theta+\Theta Dm3+3\times\Delta P \quad \text{Eq. (24)}$$

$$M \text{ driven gear (initial position): } \Theta c0=0 \quad \text{Eq. (25)}$$

$$C \text{ driven gear: } \Theta c1=\Theta o0-\Theta Dm0-\Theta o1+\Theta Dm1+\Delta P \quad \text{Eq. (26)}$$

$$Y \text{ driven gear: } \Theta c2=\Theta o0-\Theta Dm0-\Theta o2+\Theta Dm2+2\times\Delta P \quad \text{Eq. (27)}$$

$$BK \text{ driven gear: } \Theta c3=\Theta o0-\Theta Dm0-\Theta o3+\Theta Dm3+3\times\Delta P \quad \text{Eq. (28)}$$

The above specific equations reduce the number of adjusting steps. If the level of the MF demodulated signal is low, then the controller 113 should only determine that the correction angle cannot be determined, because accuracy lies in the allowable range.

In a sixth step, the driven gear to be adjusted in position or the idler 115 and drive gear 102 mounted on the motor output shaft are dismounted, adjusted, and again mounted. In the specific procedure, the subject driven gear is not dismounted during adjustment. After the idler gear 115 and drive gear 102 have been dismounted, the reference mark position put on each driven gear, which is now freely rotatable, is shifted from the home position of the associated home position sensor 117 by the adjustment angle Θci determined in the fifth step. Subsequently, the idler 115 and drive gear 102 are again mounted.

In a seventh step, two bars 116*b* shown in FIG. 13 are mounted in alignment with the light intercepting portions of the associated home position sensors 117. This work is performed by affixing the driven gears 103 so as to prevent them from moving. It is to be noted that such means shown in FIG. 13 is not necessary if the drum control system includes encoders mounted on the shaft of the driven roller 103BK and the shaft of any one of the other driven gears 103Y, 103C and 103M and capable of sensing an absolute angle. More specifically, an effect similar to the effect of the bars 116*b* is achievable if a phase difference between the absolute values of such two encoders is measured after the phase matching of the driven rollers 103 and stored in a flash ROM (Read Only memory) included in the controller of the printer on the production line. That is, at the beginning of the color print mode following the black-and-white mode, the controller detects the outputs of the encoders, drives the motors in such a manner as to set up the stored phase difference to thereby match the phases, and then performs rotation control.

In an eighth or last step, the controller 113 determines whether or not the adjusted values are corrected, i.e., whether or not the phase difference between the drive gear variations of nearby drums is ΔP.

A method of effecting the above adjustment inside the printer will be described hereinafter. The indirect drive system configured to drive the driven gears 103 with motors is more efficient that the direct drive system that directly connects motors to the drum shafts, but is susceptible to the eccentricity or the cumulative tooth pitch error of the individual driven gear 103, as stated earlier. To reduce the influence of such factors of each drive gear 103, a rotary encoder capable of sensing an absolute value as well is mounted on the shaft of the driven gear 103 and senses the rotation speed variation with the previously stated principle. At the time of phase correction, a mechanism, not shown, releases the assembly including the belt 40 from the drums 11 to thereby free the drums 11 from loads during rotation. At this instant, when each drive motor 101 is implemented as a pulse motor, it is rotated at a constant speed in synchronism with a preselected frequency. When use is made of a DC motor, the counter electromotive force of the motor is sensed for causing the motor to rotate at a constant speed. To detect a rotation speed variation, FM demodulators and low-pass filters are attached to a controller, as in the configuration shown in FIG. 14.

However, the above method needs four motor drivers and four drive motors in the configuration shown in FIG. 14.

More specifically, the controller 113 built in the printer receives information output from the low-pass filters via the FM demodulators while detecting angular position information output from the encoders, thereby detecting variation angular positions. For the adjustment on the production line, a reference mark is used, as stated earlier. By contrast, for the adjustment inside the printer, an encoder capable of sensing an absolute angle is mounted on the individual driven gear 103 coaxially with the drive motor 101 and driven gear 103, so that the controller 113 can obtain information on the absolute angular position of a rotation speed variation vector. The controller 113 then positions the driven gears 103 such that their phases have a relation indicated by arrows in FIG. 9. In the print mode to follow, the controller 113 drives the four drive motors 101 while maintaining the above relation.

The drive control system shown in FIG. 14 includes four motor drivers and four drive motors although they are represented by two motor drives and two drive motors. The encoders 116 and controller 113 play the role of cumulative rotation angle measuring means for measuring the cumulative rotation angle of the individual drive gear 103 from a preselected timing or absolute angle measuring means at the same time. When the black-and-white mode that drives only the BK drum is switched to the color print mode that drives all of the drums, the above control system can match the variation phases of the driven gears 103 without resorting to the implementation shown in FIG. 13. Further, the motor drivers and controller 113 play the role of rotation position adjusting means for adjusting the rotation position of the individual drum at the same time.

Figure 15:
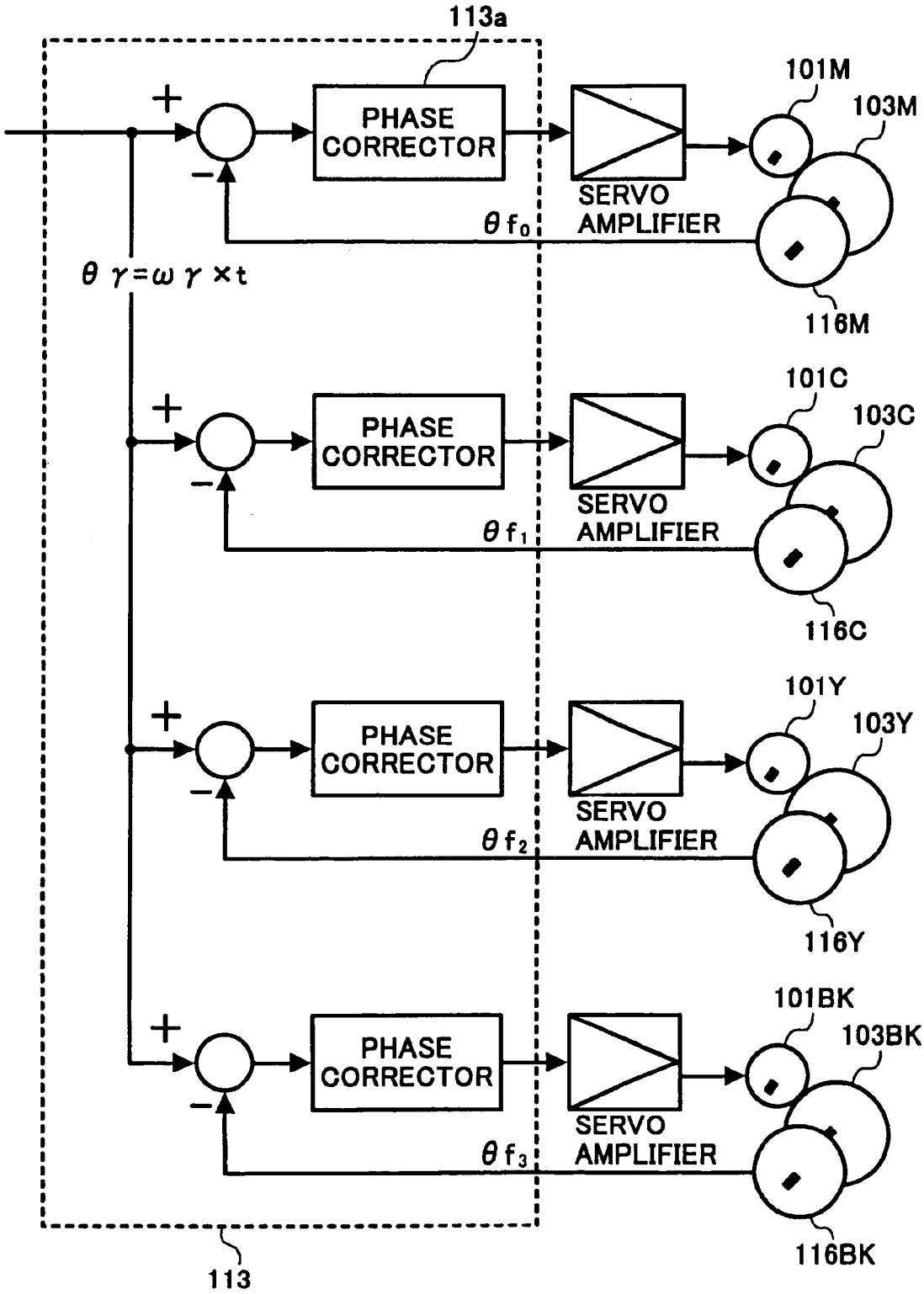
FIG. 15 is a schematic block diagram showing a drive control system configured for a DC motor.

When the four drive motors are implemented as pulse motors, the drive motors share identical drive pulses output from the controller 113 such that they do not lose synchronism. By contrast, when the drive motors are implemented as DC motors, their rotation speeds are controlled by use of continuous pulse trains output from the encoders. However, it is necessary to control the speeds of the DC motors during printing while maintaining the relation indicated by the arrows in FIG. 9. For this purpose, after setting up the relation of FIG. 9, the controller 113 drives the DC motors while counting the pulses output from the encoders, thereby obtaining angle information $\theta fi$ (e.g. i=0 for the M encoder angle information). At this instant, the controller 113 controls each DC motor such that the angle information $\theta fi$ output from the associated encoder is locked to reference angle information $\theta r=\omega r\times t$ where $\omega r$ denotes the target rotation speed of the drum. FIG. 15 shows a specific drive control system or drive control means applicable to the DC motors.

In FIG. 15, if a reference signal $\theta r$ for a feedback control system is so configured as to sharply increase the speed from zero (stop) to $\omega r$, then overshoot increases. To solve this problem, the reference signal $\theta r$ may be configured to first increase the speed to $\omega r$ little by little. Phase correctors 113*a* may be built in the controller 113, as shown in FIG. 15, or may be implemented as an independent DSP (Digital Signal Processor). To control the drive motors, use may be made of a PLL (Phase Locked Loop) control system. Even in a PLL control system, even if feedback control is effected on the basis of the outputs of the encoders, the gain of the control system cannot be increased due to the limited rigidity of gearing between the DC motors and the drums. This also results in a rotation speed variation ascribable to the eccentricity or the cumulative tooth pitch error of the individual driven gear 103. In this respect, the method described above is effective.

As stated above, even when the relation between the phases of rotation speed variations ascribable to the driven gears 103 is disturbed by the switching of a print mode, the illustrative embodiment can match the phases for thereby reducing color misregister. Particularly, when the drive motors are implemented as pulse motors, the rotation speed variations mentioned above directly translate into the rotation speed variations of the drums. However, the illustrative embodiment prevents the amount of color misregister from increasing because the phases of the variations are matched to each other.

Third Embodiment

A third embodiment is identical with the first embodiment except for the drum drive unit. The third embodiment differs from the first and second embodiments in that it causes the drive motors to directly drive the drums without the intermediary of the driven gears.

It is a common practice with a direct drive system to reduce the rotation speed of a drive motor by using a drive transmission mechanism, e.g., gears. For example, Japanese Patent Laid-Open Publication No. 10-63059 mentioned earlier teaches a large flywheel mounted on the shaft of a photoconductive drum in order to reduce high-frequency oscillation particular to the drive transmission mechanism. While this kind of system enhances motor efficiency, gears, for example, included in the drive transmission mechanism cause the rigidity of the mechanism to decrease and bring about rotation speed variations ascribable to, e.g., the eccentricity of the gears. This makes it difficult to effect constant rotation control with accuracy.

Color misregister ascribable to the eccentricity or the cumulative tooth pitch error of the individual driven gear included in the drive transmission mechanism can be reduced by matching the phases of the driven gears, as stated in relation to the second embodiment. However, the rotation speed of the individual drum varies. As a result, at the image transfer position where the belt 40 or the sheet 2 (transfer medium) and the drum 11 contact each other, the variation of a slip ascribable to the rotation speed variation of the drum 11 is superposed on the rotation speed variation of the drum 11, resulting in color misregister, line thickening and other defects.

The direct drive system directly drives the drums without the intermediary of, e.g., the driven gears or similar drive transmission gears to thereby obviate the rotation speed variations of the drums. Although the direct drive system is lower in motor efficiency than the indirect drive system, it obviates the various defects mentioned above. Japanese Patent Laid-Open Publication No. 8-160690, for example, discloses a direct drive system using an ultrasonic motor. However, this kind of direct drive system is high cost because a rotary member must be made freely rotatable when a jamming sheet should be removed. A drive motor applicable to the drive system is generally implemented as a motor with a core, i.e., with coils wound round the slot yoke of a stator or a pulse motor. Such a motor, however, involves, e.g., cogging that would directly translate into a speed variation if the motor were directly connected to the shaft of the drum.

To solve the above problems, the illustrative embodiment uses coreless, brushless motors as the drive motors 101. The motors and encoders share bearings with each other.

Figure 16:
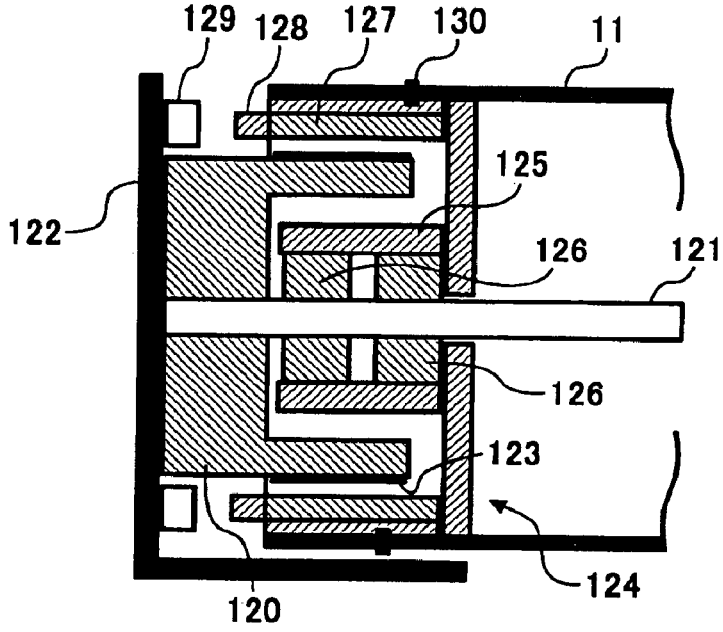
FIG. 16 is a fragmentary section of a direct drive section using an outer rotor type motor and representative of a third embodiment of the present invention.

FIG. 16 shows part of a specific direct drive section in which the drive motor 101 is implemented as an outer rotor type motor having great inertia and expected to give a flywheel effect. As shown, the outer rotor type motor includes a stator 120 and a shaft 121 both of which are affixed to a support plate 122 included in the printer body. A coil portion 123 surrounds the stator 120. An outer rotor 124 is rotatably mounted on the shaft 121 via two bearings 126 supported by a bearing support portion 125. A permanent magnet and a yoke 127 are mounted on the hollow cylindrical portion of the outer rotor 124 that faces the coil portion 123 of the stator 120. An encoder 128 with timing marks is mounted on the end of the hollow cylindrical portion of the outer rotor 124. A reflection type sensor 129 is also mounted on the support plate 122 in order to sense the timing marks of the encoder 128.

The drum 11 may be fitted on and affixed to the circumference of the outer rotor 124 by pins 130 or similar affixing means. The outer rotor type motor with the above configuration allows the encoder 128 or similar precision, multifunciton part to be integrally mounted thereon. Further, because the drum 11 is directly connected to the outer rotor 124, the outer rotor type motor shown in FIG. 16 has high torsional rigidity and therefore sufficiently copes with resonance ascribable to short torsional rigidity, compared to an outer rotor type motor that will be described with reference to FIG. 18 later.

Figure 17:
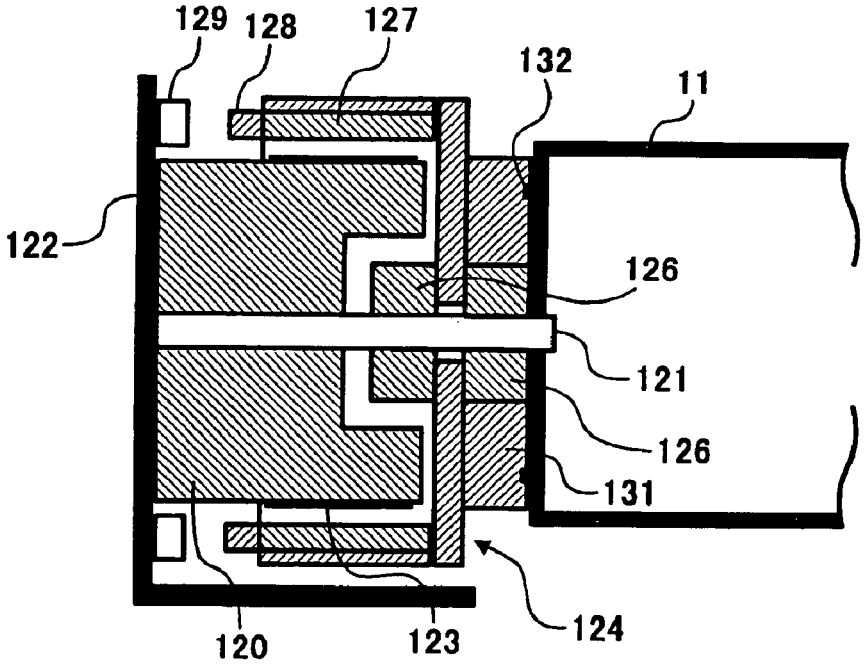
FIG. 17 is a fragmentary section of a direct drive motor representative of a modification of the third embodiment.

FIG. 17 shows another specific direct drive section using an outer rotor type motor. As shown, the drum 11 is connected to the outer rotor 124 on the end face of a drum connecting portion 131 included in the outer rotor 124. More specifically, a plurality of recesses are formed in the end face of the drum connecting portion 131 and mate with a plurality of lugs 132 extending out from the drum 11. This configuration can cope with the problem of the rigidity of a transmission shaft. If an inner rotor type of motor is directly connected to the drum 11, then the portion of the motor connected to the drum 11 has a smaller area than the outer rotor type motor for a given contour and is therefore low in rigidity while failing to implement a desirable flywheel effect.

Figure 18:
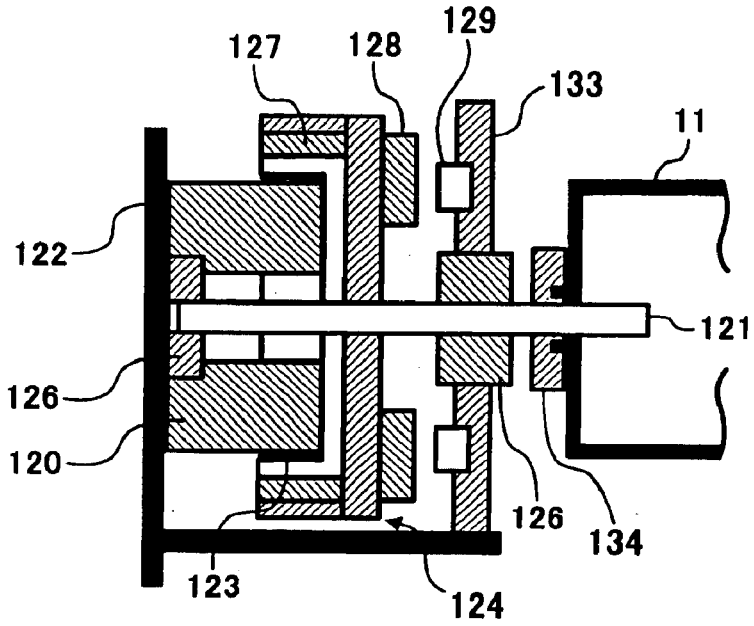
FIG. 18 is a fragmentary section of a direct drive motor representative of another modification of the third embodiment.

An encoder should preferably be designed by taking account of heat. The encoder plate 128, for example, is selected in consideration of heat resistance and should preferably be formed of metal. Further, the encoder plate 128 should preferably be located at a position little susceptible to the heat of the motor. FIG. 18 shows another specific direct drive section in which the encoder 128 is located at such a position.

As shown in FIG. 18, the encoder plate 128 is mounted on the end face of the outer rotor 124 adjoining the drum 11. A support member 133 intervenes between the motor and the drum 11 and supports the transmission shaft 121 via the bearing 126. The sensor 129 for sensing the marks of the encoder plate 128 is mounted on the support member 133. The drum 11 is connected to a drum connecting portion 134 mounted on the shaft 121. In this configuration, the encoder plate 128 is mounted on part of the outer rotor 124 exposed to the outside and is therefore little susceptible to heat generated by the motor. However, because the drum 11 is spaced from the outer rotor 124, the material, thickness and so forth of the shaft 121 should be selected in due consideration of the rigidity of the shaft 121.

Figure 19:
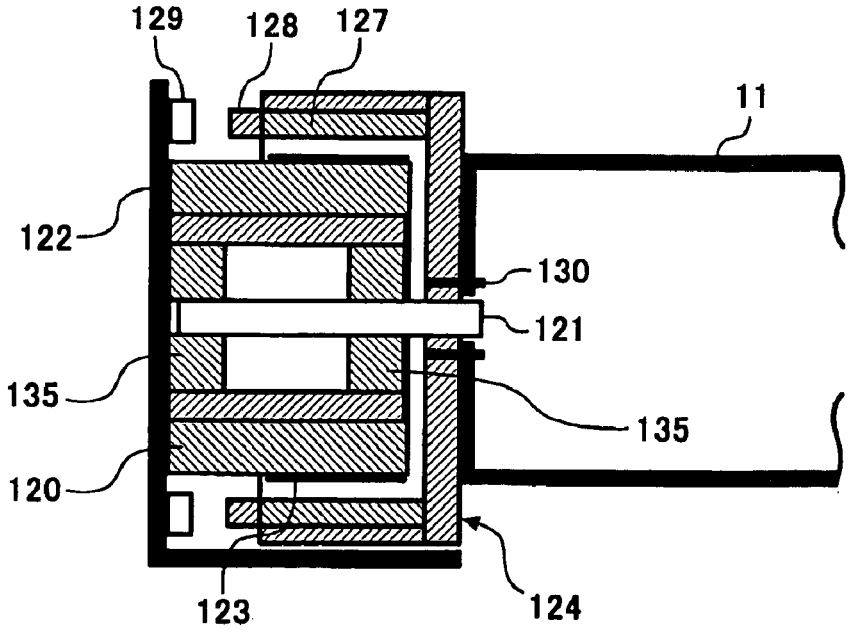
FIG. 19 is a fragmentary section of a direct drive motor representative of still another modification of the third embodiment.

In the configurations shown in FIGS. 16 and 17, use is made of the outer rotor type bearing 126. Alternatively, as shown in FIGS. 18 and 19, use may be made of an inner rotor type bearing 135.

Figure 20:
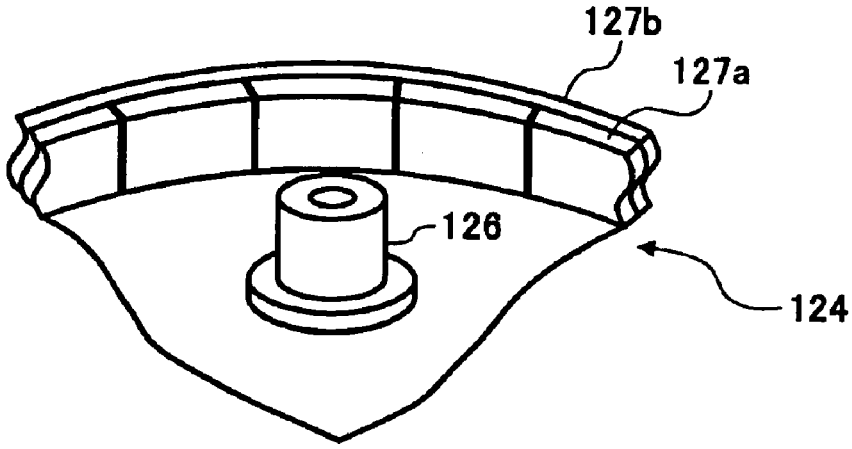
FIG. 20 is a fragmentary perspective view showing an outer rotor included in an outer rotor type coreless, brushless motor.
Figure 21:
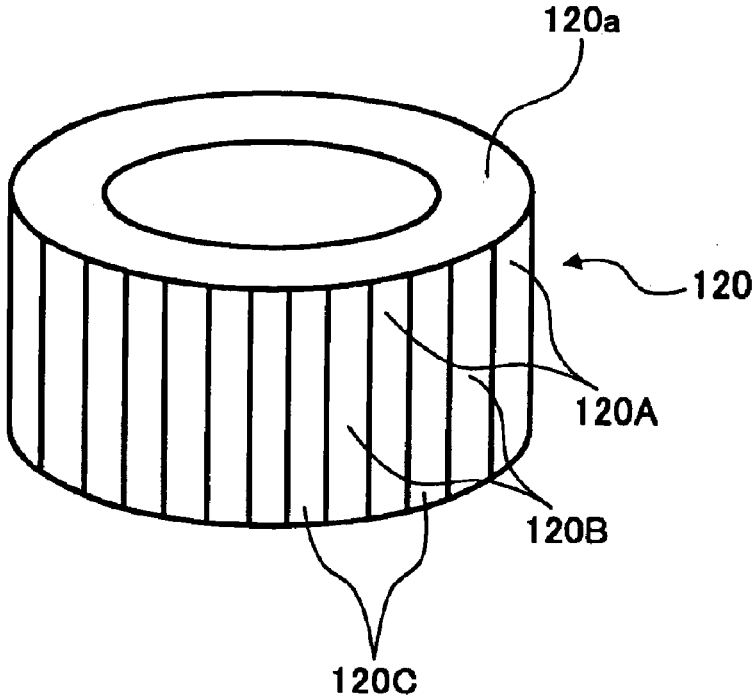
FIG. 21 is a perspective view showing a stator also included in the coreless, brushless motor.

The structure of the outer rotor type coreless, brushless motor applicable to the drive motor 101 will be described in detail hereinafter. FIGS. 20 and 21 respectively show the outer rotor 124 and stator 120 constituting the coreless, brushless motor. As shown in FIG. 20, a permanent magnet 127*a* is arranged on the inner periphery of the outer rotor 124 and has N poles and S poles alternating with each other in the circumferential direction. The permanent magnet 127*a* may be implemented as a single magnet member alternately magnetized to N poles and S poles in the circumferential direction or as a plurality of magnets arranged side by side in the above direction. The yoke 127*b* surrounds the permanent magnet 127*a*. As shown in FIG. 22, the stator 120 has three-phase coils 120A, 120B and 120C arranged on the outer periphery of a yoke 120*a* one above the other.

Figure 22A:
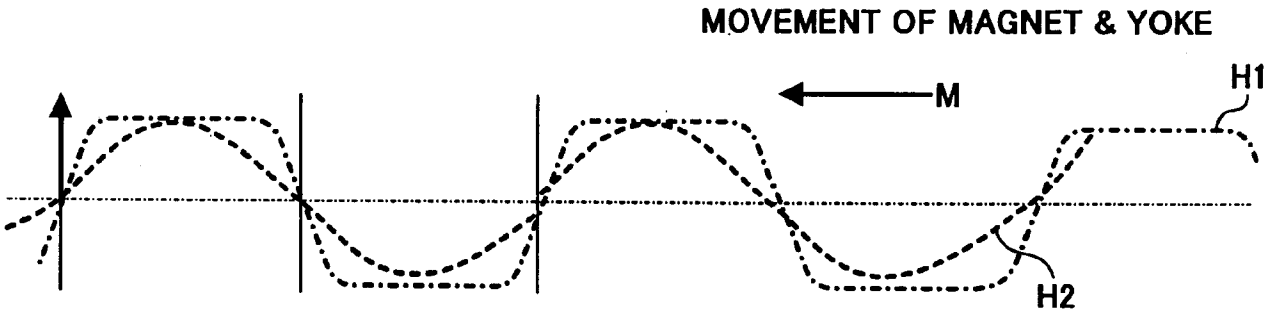
FIG. 22A shows the strengths of a magnetic field formed between the permanent magnet of the outer rotor and the yoke of the stator.
Figure 22B:
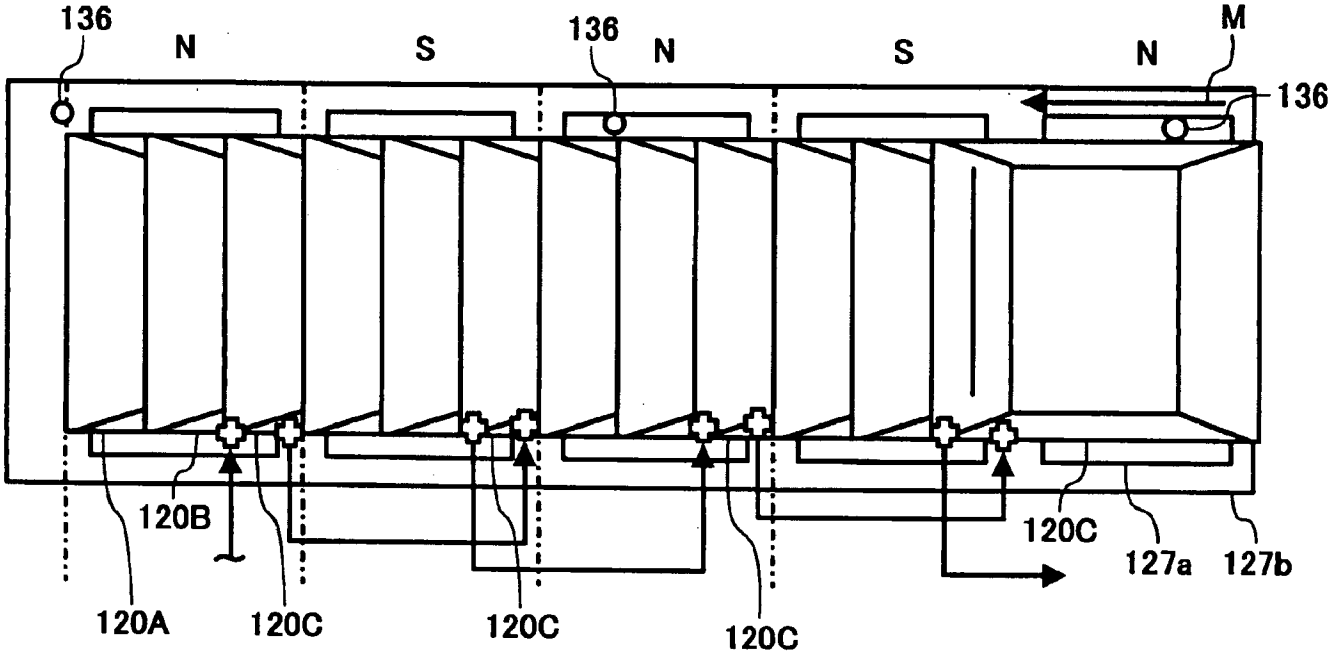
FIG. 22B shows a relation between the magnetic poles of the permanent magnet and the coils of the stator.
Figure 23:
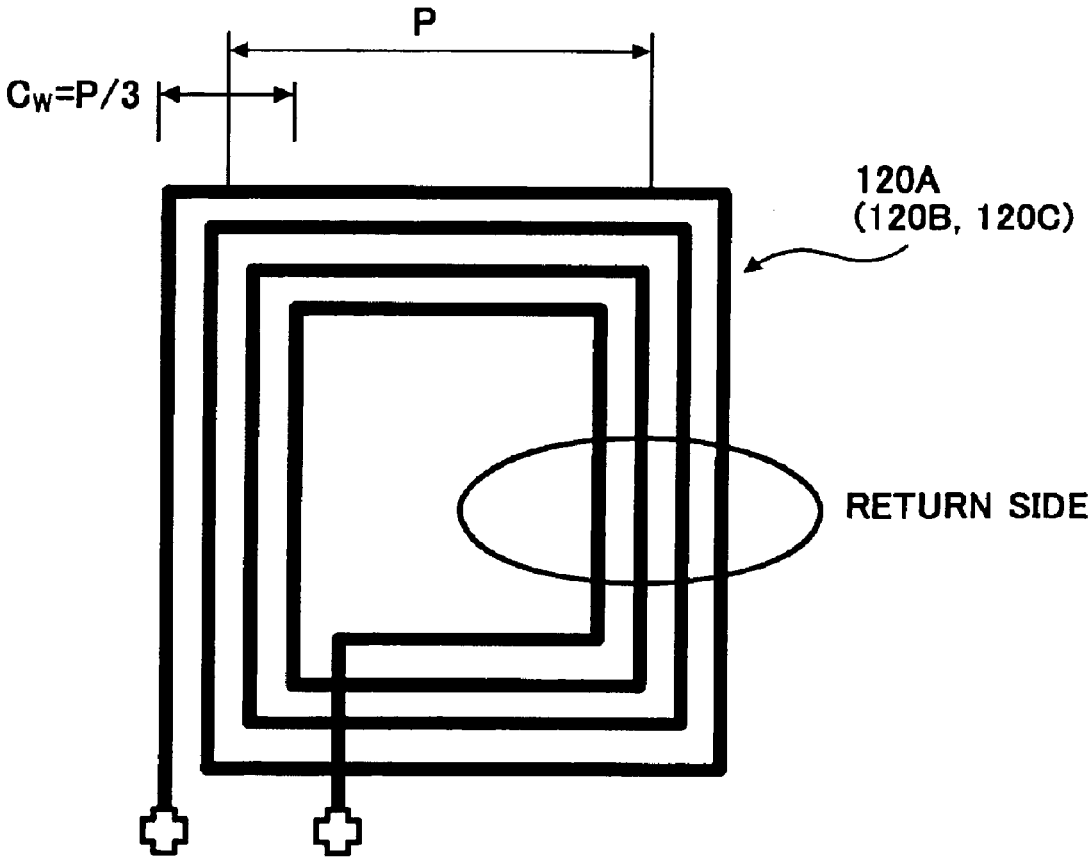
FIG. 23 shows the configuration of one of the coils.

FIG. 22B shows a relation between the poles of the permanent magnet 127*a* included in the outer rotor 124 and the three-phase coils 120A through 120C included in the stator 120. As shown, the coils 120A through 120C are arranged on the outer periphery of the stator 120 at positions shifted in phase from each other in the direction of movement of the outer rotor 124. The permanent magnet 127*a* of the outer rotor 124 surrounds the stator 120 with N poles and S poles alternating with each other and moves in a direction indicated by an arrow M in FIGS. 22A and 22B when the motor is driven. As shown in FIG. 23, assume that S poles or N poles have a pitch of P. Then, the coils 120A through 120C have a width Cw of P/3 in the direction of rotation of the rotor each, and the centers of the widths Cw of adjoining coils are spaced by a distance equal to the pitch P. While the overlap of coils is shown as being interrupted in FIG. 22B to better understand the configuration, the overlap is continuous in practice. Every third coil is connected together to implement a single phase, thereby setting up three different phases. FIG. 22B shows only the connection of the coils 120C. As for the connection of the coils 120C, a current is caused to flow in a particular direction through each of the odd coils and even coils, so that the directions of thrusts are matched. For this purpose, the connection to two coil terminals shown in FIG. 23 is caused to differ from the even coils to the odd coils in consideration of the fact that the direction of interlinked magnetic fields is different from the even coils to the odd coils.

FIG. 22A shows the strength of a shifting field formed between the permanent magnet 127*a* of the outer rotor and the yoke of the stator. In FIG. 22A, a sinusoidal wave H2 and a trapezoidal wave H1 are shown. Although a coreless motor is free from cogging, it is likely to generate a torque ripple even when the current is constant, depending on the variation of the field strength with the elapse of time. By making the shape of the above variation close to the trapezoidal wave as far as possible, it is possible to implement an efficient motor with a minimum of torque ripple, as will be described later more specifically.

Figure 24:
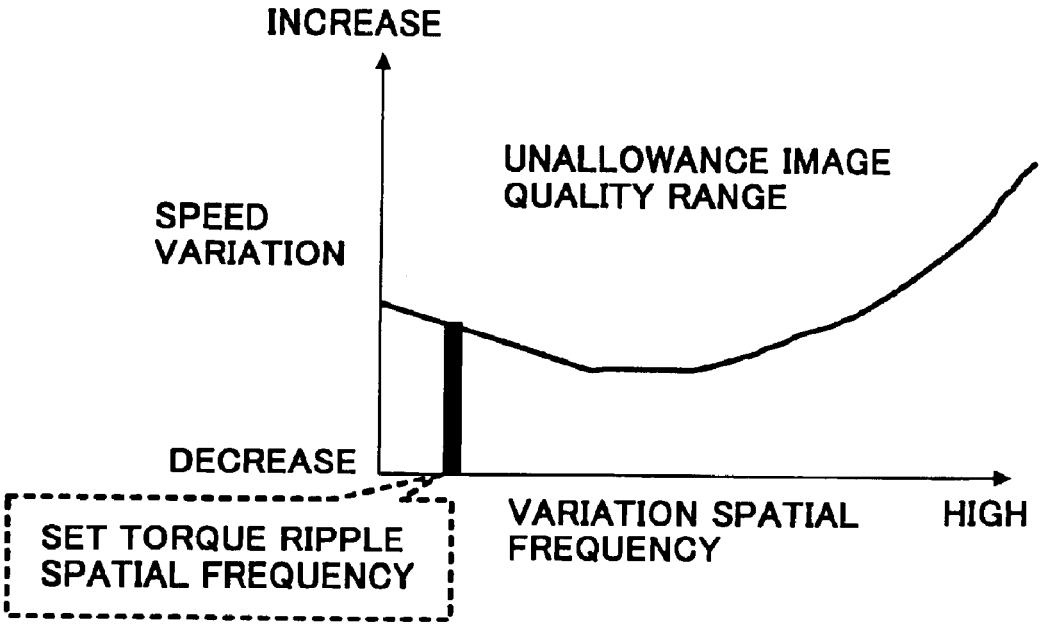
FIG. 24 is a graph showing a relation between the spatial frequency of the speed variation of a drive system and the allowable speed variation.

Generally, as shown in FIG. 24, when the speed variation of the drive system has a low variation spatial frequency, its influence on image quality is not noticeable. As the frequency rises, the extreme value appears where the allowable value of the speed variation decreases. As the frequency further rises, the influence of the speed variation again decreases. In FIG. 24, the ordinate and abscissa indicate the speed variation and variation spatial frequency, respectively. Of course, the smaller the ripple (speed variation), the higher the image quality. In the specific three-phase motor, assuming that the inner periphery of the outer rotor facing the stator has a circumferential length of $L_1$, then $L_1/2P=n$ (natural number) pairs of N and S poles are available. In this case, the fundamental spatial frequency fs of the variation ascribable to torque ripple is expressed as:

$$fs=6n/(\pi D) \quad \text{EQ. (29)}$$

where D denotes the diameter of the drum 11 (see FIG. 2A).

Figure 25:
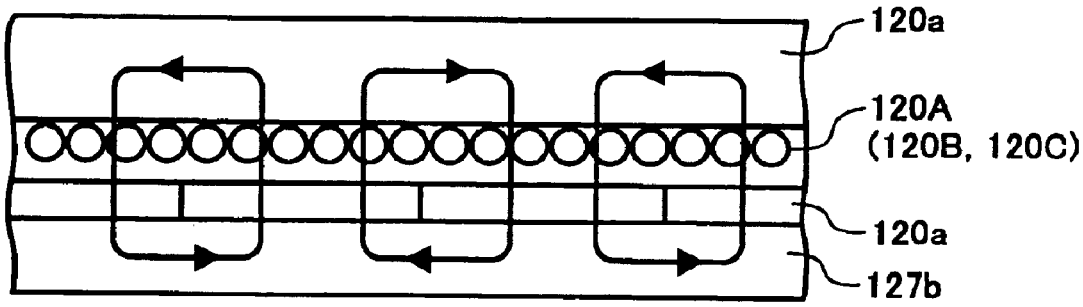
FIG. 25 shows magnetic fluxes formed at the outer rotor and stator.

The smaller the value n, the lower the fundamental spatial frequency fs of torque ripple and therefore the smaller the influence of the variation on image quality. However, if the value n is too small, then the yoke of the outer rotor must be thickened. More specifically, as shown in FIG. 25, when the width of a single magnet increases, the amount of magnetic flux entering the next magnet via the yoke increases, resulting in the need for a broad magnetic path and therefore an increase in the inertia of the outer rotor. As for a printer drive system, however, increasing the inertia is desirable because primary importance is attached to the stability of constant-speed rotation. For a given thrust, the outer rotor type motor has, of course, greater inertia than the inner rotor type motor because its rotary portion is positioned radially outward. In this sense, too, the outer rotor type motor is desirable for a printer.

When the allowable outside diameter of a motor is limited for system reasons, the gap of a magnetic circuit should preferably be as close to the periphery as possible in order to generate a greater torque for a given thrust in the motor efficiency aspect. In this sense, the value n must be increased. It follows that the optimal value n is one close to the upper limit that may implement the allowable velocity variation below the fundamental spatial frequency shown in FIG. 24. While the value n may be further increased to raise the fundamental spatial frequency fs, such a scheme excessively reduces the pole pitch of the magnet as well as the size of the individual coil, making the fabrication of the motor difficult. Moreover, the motor drive frequency rises and aggravates various losses while making control difficult to execute.

FIG. 24 shows a specific, optical torque ripple frequency. When the drive transmission mechanisms uses gears, the torque variation frequency ascribable to the torque ripple or the cogging of the drive motor increases by a gear ratio, making it difficult to set the torque ripple frequency at the low frequency side. Therefore, to set the torque ripple frequency at the high frequency side, the gear ratio must be increased. In FIG. 24, the high-frequency side corresponds to an increase in torque ripple frequency because the allowable speed variation is greater at the high frequency side. A large gear ratio means the intermediary of the drive gears 102A and 102B and driven gears 103M through 103BK; as shown in FIG. 9 specifically, so that the eccentricity and so forth of such gears must be taken into account.

In light of the above, the illustrative embodiment sets the torque ripple at the low-frequency side by contrast to the conventional technology.

Figure 26:
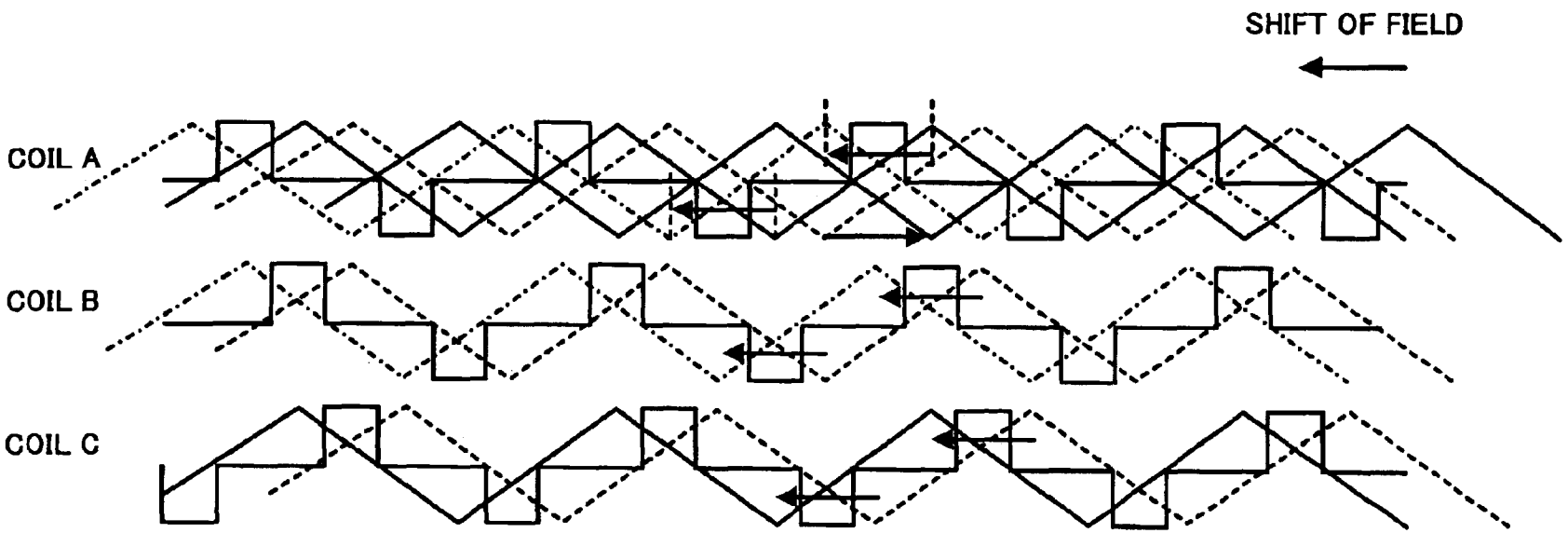
FIG. 26 shows a relation between the position of each coil assigned to a particular phase (rectangular solid line) and the shifting field (triangular wave)

FIG. 26 shows a relation between the positions of the three-phase coils Coil A, Coil B and Coil C (solid rectangular lines) and the shifting fields (represented by triangular waves for the sake of easy description). To facilitate an understanding, FIG. 26 shows only one side of the individual coils (left-hand side in FIG. 23) and shows the even coils and odd coils at the upper side and lower side, respectively. Because the coils on the yoke of the stator do not move, each magnetic field is assumed to move from the right-hand side toward the left-hand side in FIG. 26 while the motor is in rotation.

In FIG. 26, the coil, not shown, at the return side (right-hand side in FIG. 23) is positioned such that it is opposite to the coil at the left-hand side with respect to the direction of the flux interlinked with the flow of a current, so that the resulting thrusts are equal. In the even coil, a rotating thrust is obtained if a current is caused to flow from the time when the zero-crossing point of the rising portion of the field waveform and the coil cross each other to the time when the field moves by 2P/3 to cause the zero-crossing point of the falling portion of the field waveform moves away from the coil, as indicated by arrows in FIG. 26. At this instant, in the odd coil, a current flows from the rise to the fall of the field in the opposite direction to the current of the odd coil because of the previously stated connection of the coils, so that the interlinked flux is also opposite in direction. As a result, the thrust generated by the odd coil is identical in direction with the thrust generated by the even coil. After the field has advanced by P/3 from the above point, a current is caused to flow through the odd coil from the fall to the rise of the field in the opposite direction.

The coils are affixed to the stator yoke, so that the outer rotor moves in the direction opposite to the direction of the thrust. In light of this, a current is caused to flow in the direction based on the left-hand rule.

Figure 27:
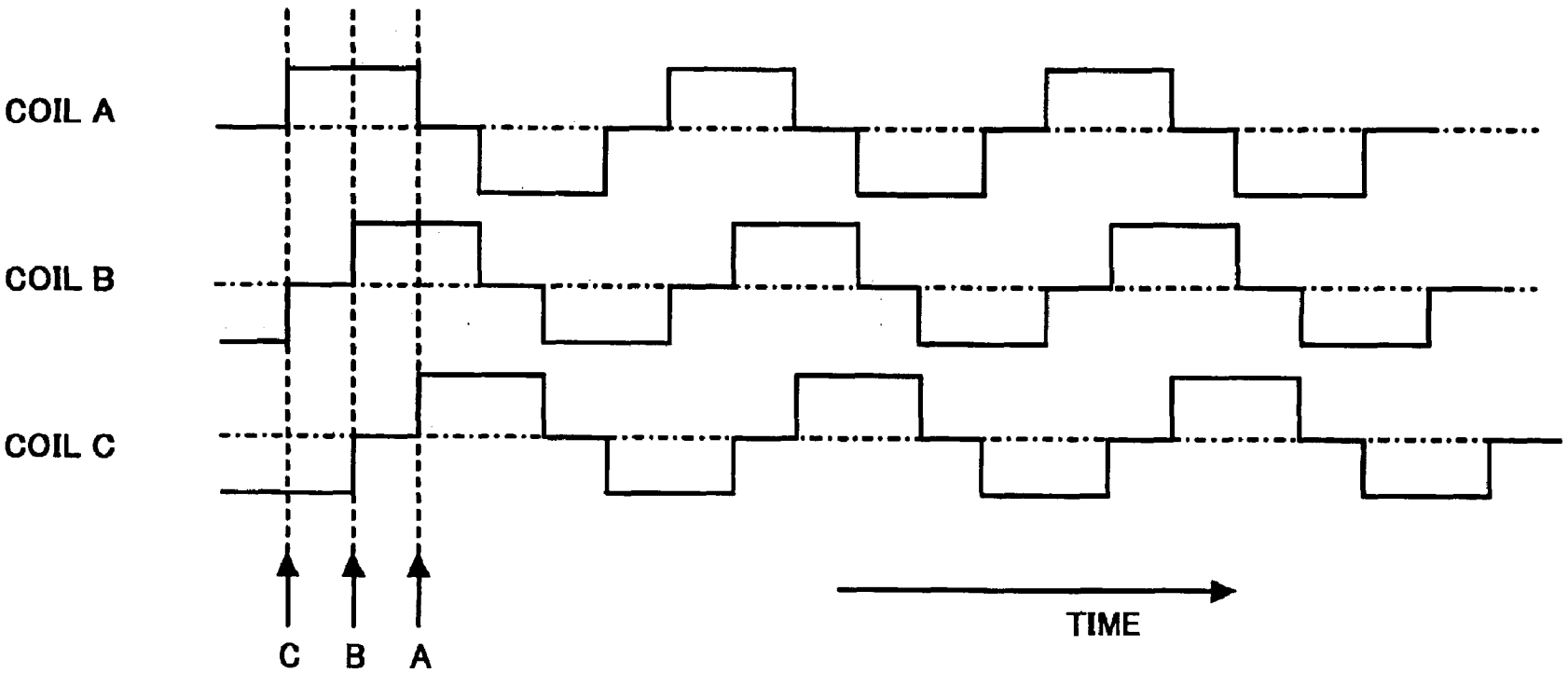
FIG. 27 is a timing chart for describing the ON-OFF timing and direction of a current flowing through each coil.
Figure 28:
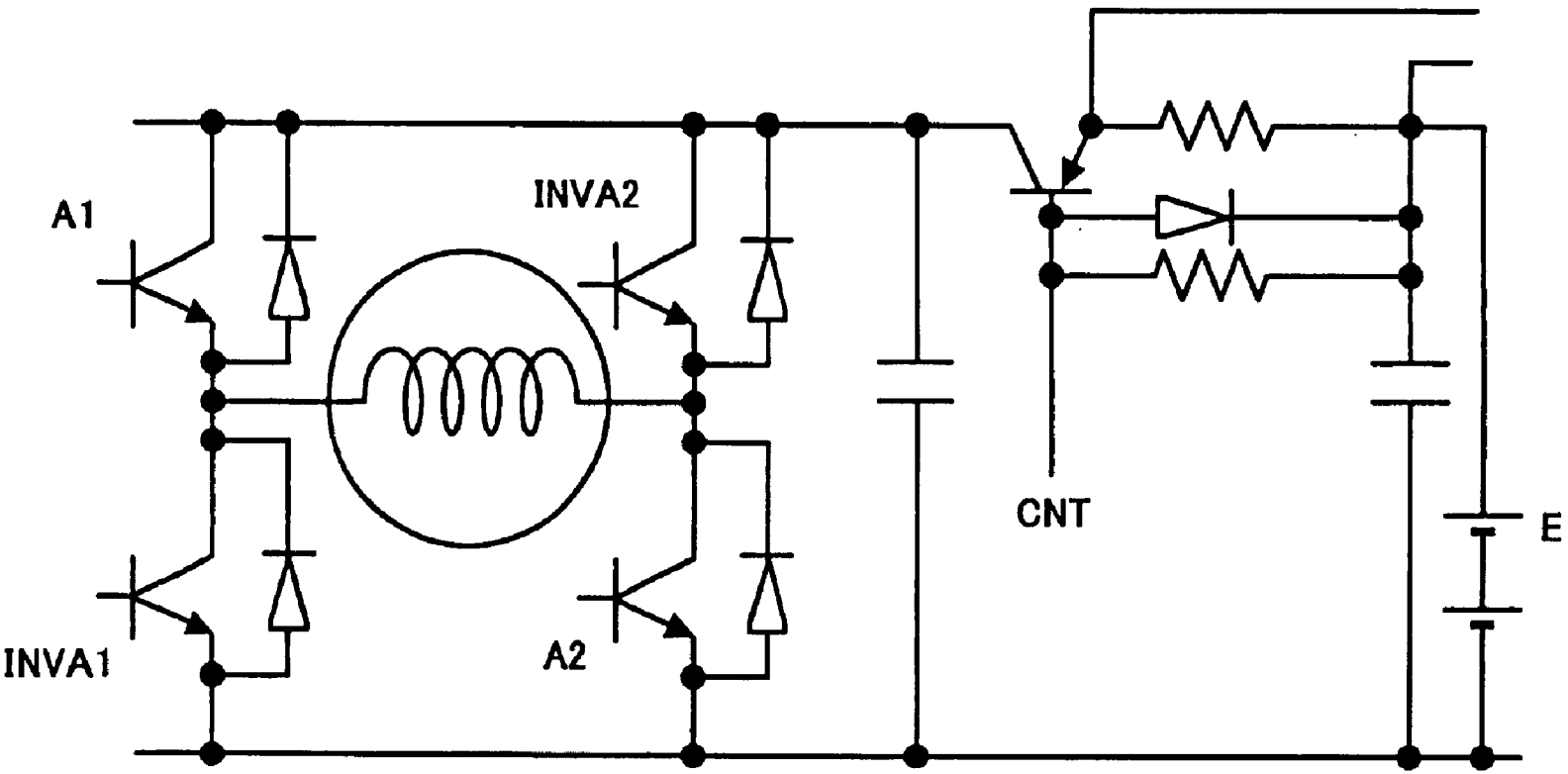
FIG. 28 is a circuit diagram for controlling the ON-OFF timing, direction and value of the current to flow through each coil.

Because the coils of different phases are connected in the configuration shown in FIG. 22B, currents to flow through the coils are turned on and turned off at the timings and in the directions shown in FIG. 27. Such timings and directions can be detected if a single Hall sensor assigned to each phase is positioned at the end of the coil that passes through the sensor. Specific positions of Hall sensors 136 are shown in FIG. 22B. The output of each Hall sensor 136 is proportional to flux strength. It is therefore possible to control the ON-OFF timing and direction of the current to be fed to each coil phase, as shown in FIG. 28. FIG. 28 shows a well-known H type circuit configured to control the ON/OFF timing, direction and value of a current to be fed to a single coil phase (phase A). When inputs A1 and A2 are turned on substantially at the same time, a current flows through the coil. When INVA1 and INVA2 are turned on substantially at the same time, a current flows through the coil in the opposite direction. An input CNT controls the value of the current to be fed to a motor.

Figure 29:
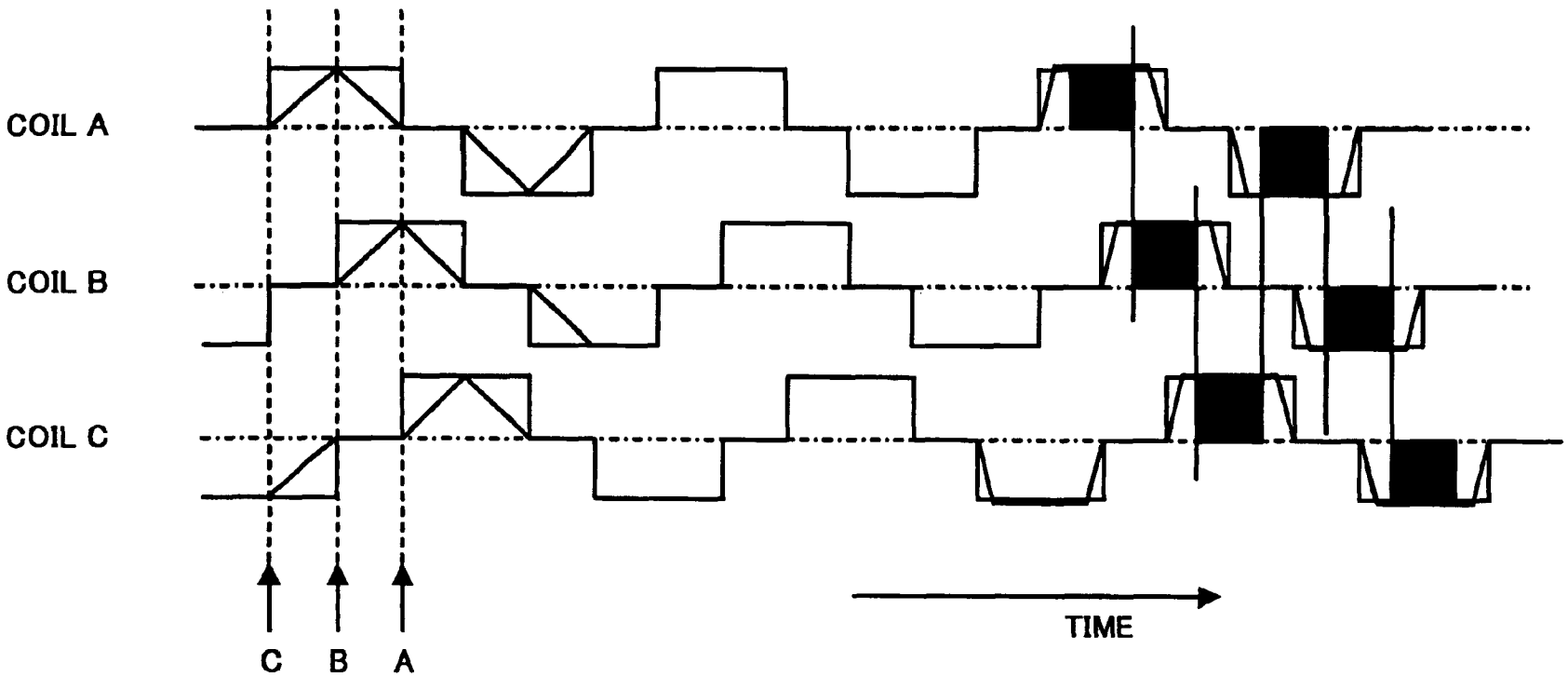
FIG. 29 is a timing chart showing a relation between the ON-OFF timing of the current and the strength of magnetic field linked with the coil with respect to a shifting field having a triangular wave and a shifting field having a trapezoidal wave.

FIG. 29 shows flux strengths interlinked with the coils with respect to the case wherein the shifting field has a triangular waveform and the case wherein it has a trapezoidal waveform by superposing the flux strengths on FIG. 27. As for the triangular wave, while it should be drawn such that the triangular component overlies the DC component, the DC component is not shown in FIG. 29 for the simplicity of illustration. In FIG. 29, assuming that the drive current value is constant, then the product of the current waveform and field itself is the thrust. In the case of an ideal triangular wave although it is difficult to implement, the combined thrust of the three coil phases remains constant at all times. However, because a current constantly flows even through a portion where the field strength is weak, efficiency is lowered accordingly. When the field is close in shaped to a sinusoidal wave, the motor efficiency is lowered while a ripple appears in the combined thrust. A ripple appears even in the case of the trapezoidal wave shown in FIG. 29. However, if currents are caused to flow through the different coil phases independently of each other and if the current switching time between the phases is made as short as possible, then the currents can be driven at portions where the fields are flat, implementing an efficient motor in which a minimum of thrust ripple appears.

The Hall elements 136, FIG. 22B, may be replaced with encoders, i.e., encoder disks each being provided with marks. The number of sensors for sensing such marks should only be the same as the number of the Hall elements, i.e., three in the above specific arrangement. The marks on each encoder disk correspond in position to the fluxes at the gaps of the rotating magnetic circuit.

More specifically, each encoder disk is provided with reflection marks for positive (N) fluxes, but transmits light for negative (S) fluxes although such a relation may be inverted. Use may be made of a transmission type mark sensor. The encoder disk with the marks is mounted to the outer rotor such that the direction of a flux at a gap and the zero-crossing point of the flux coincides with a point where a mark and a portion where no marks are present replace each other. The sensors for the encoders, like the Hall sensors, correspond in position to the coil phases.

In the case of an optical system, a mark sensor does not have to be located at a position interlinked with a flux, so that the positions of the Hall elements do not have to be taken into account in relation to the arrangement of the coils. It is therefore possible to increase the coil length relating to the generation of a thrust for thereby further enhancing motor efficiency. Further, in the optical system, one of the mark sensors can be used as a sensor responsive to the reference angular position of a single rotation (start position sensor). Although this is also true with a Hall sensor, it is difficult with a Hall sensor to sharply raise a waveform for enhancing positional accuracy. As a result, an extra sensor is necessary when high accuracy is required. By contrast, the optical method allows the diameter of a beam for illuminating the encoder disk to be reduced or allows a slit to be positioned at the sensing side, so that a highly accurate reference angular position sensor can be implemented without increasing the number of sensors. In addition, the start position sensor can sense a speed difference (phase shift) greater than a preselected value that may occur between the drums due to a jam or similar overload.

Figure 30A:
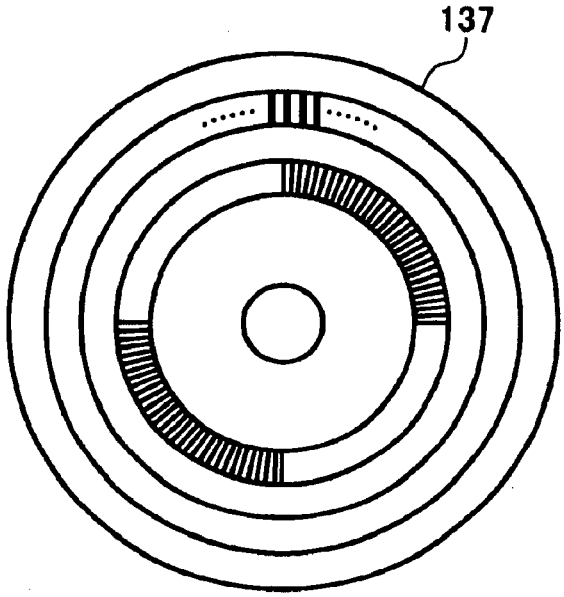
FIG. 30A shows an encoder disk used to sense the position and timing (rotation angle) at which the magnetic field varies.
Figure 30B:
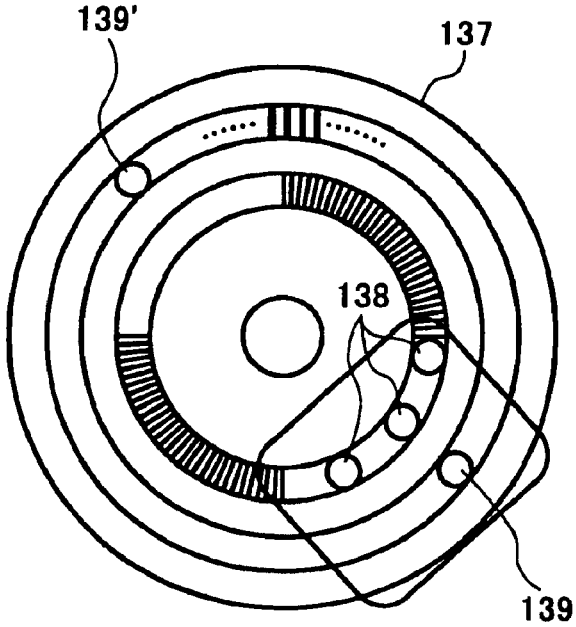
FIG. 30B shows the arrangement of three sensors responsive to the position where the magnetic field varies and a sensor responsive to the timing (rotation angle)

FIG. 30A shows an encoder disk 137 configured to meet a condition of n=2. FIG. 30B shows the positions of three sensors 138 responsive to positions where the field varies and the position of a sensor 139 responsive to a timing rotation angle. One of the three sensors 138 is implemented as a start angular position sensor. Such a concentrated arrangement of sensors simplifies wiring and therefore facilitates mounting. A sensor 139' shown in FIG. 30B will be mounted when the encoder disk 137 has great eccentricity, as well known in the art; timing signals shifted in phase by 180° from each other are sensed at the same time and used for control to thereby cancel the influence of eccentricity.

Figure 31B:
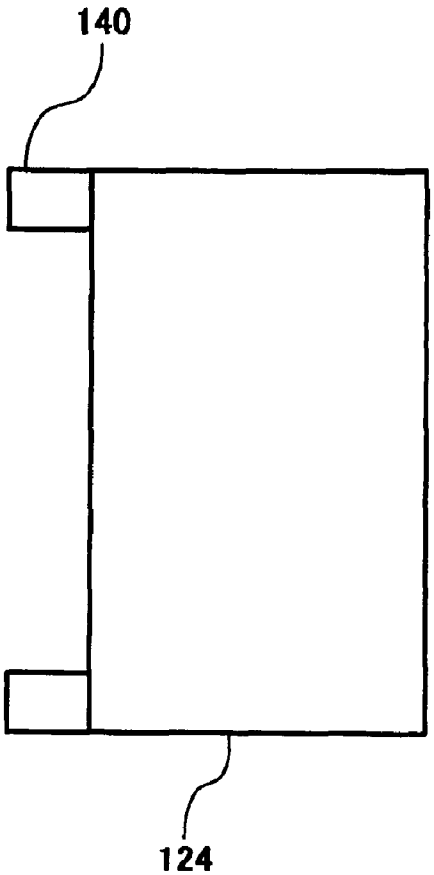
FIG. 31B is a side elevation of the outer rotor.
Figure 31A:
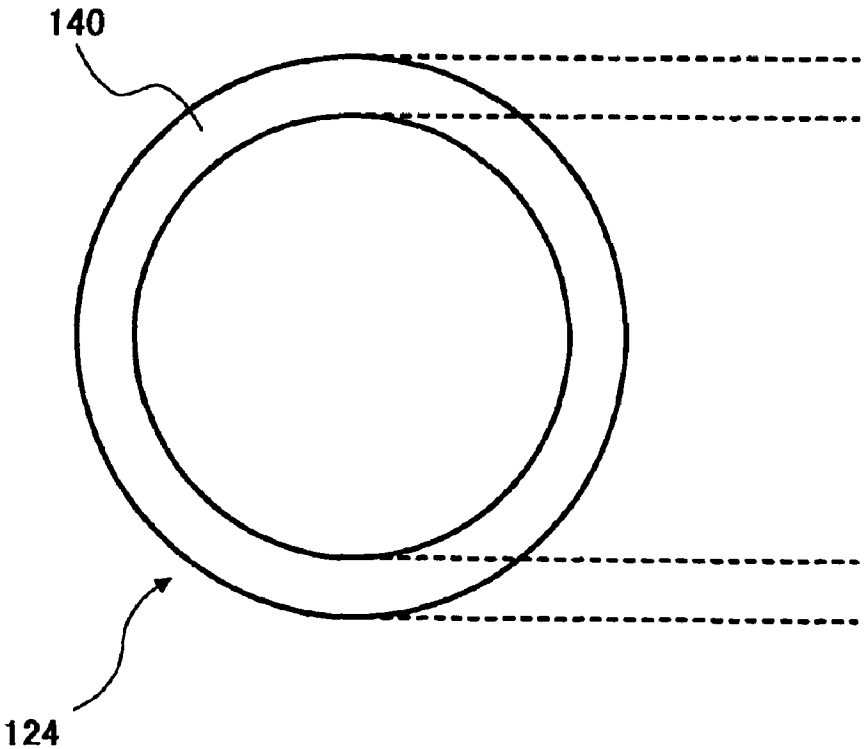
FIG. 31A is a front view of an outer rotor having a flywheel.

As shown in FIGS. 31A and 31B, to enhance the flywheel effect available with the outer rotor type coreless motor, it is preferable to mount a flywheel 140 on the peripheral portion of the outer rotor 124. An inertia moment is produced by multiplying the square of a radius by mass density and then integrating the resulting product. Therefore, it is more preferable to mount the flywheel 140 on the peripheral portion than to mount it on the center portion for a given mass. The outer rotor type motor allows the flywheel 140 to be easily mounted on its peripheral portion while an inner rotor type motor cannot do so without resorting to a sophisticated configuration.

Figure 32:
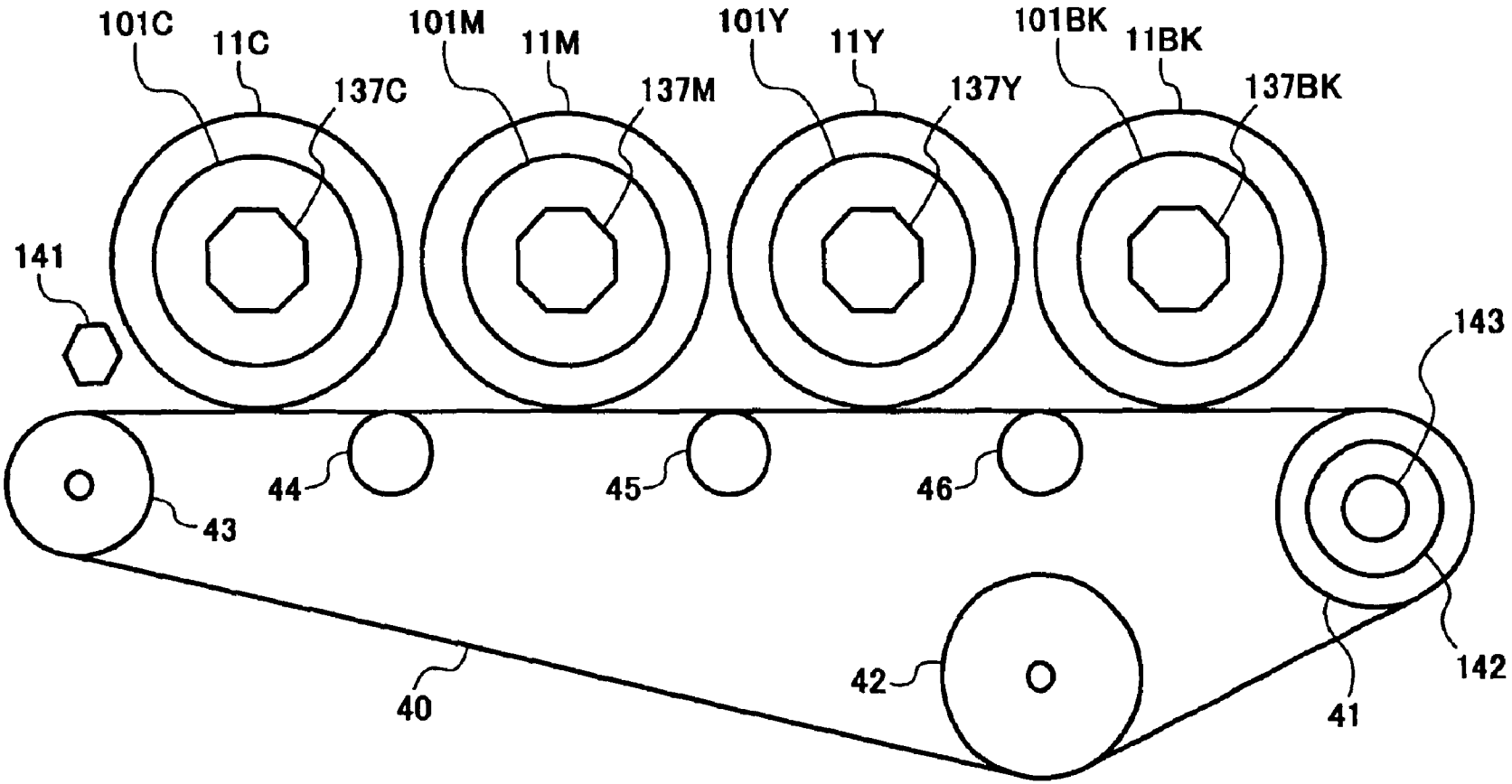
FIG. 32 shows a drum drive unit using a direct drive system.
Figure 33:
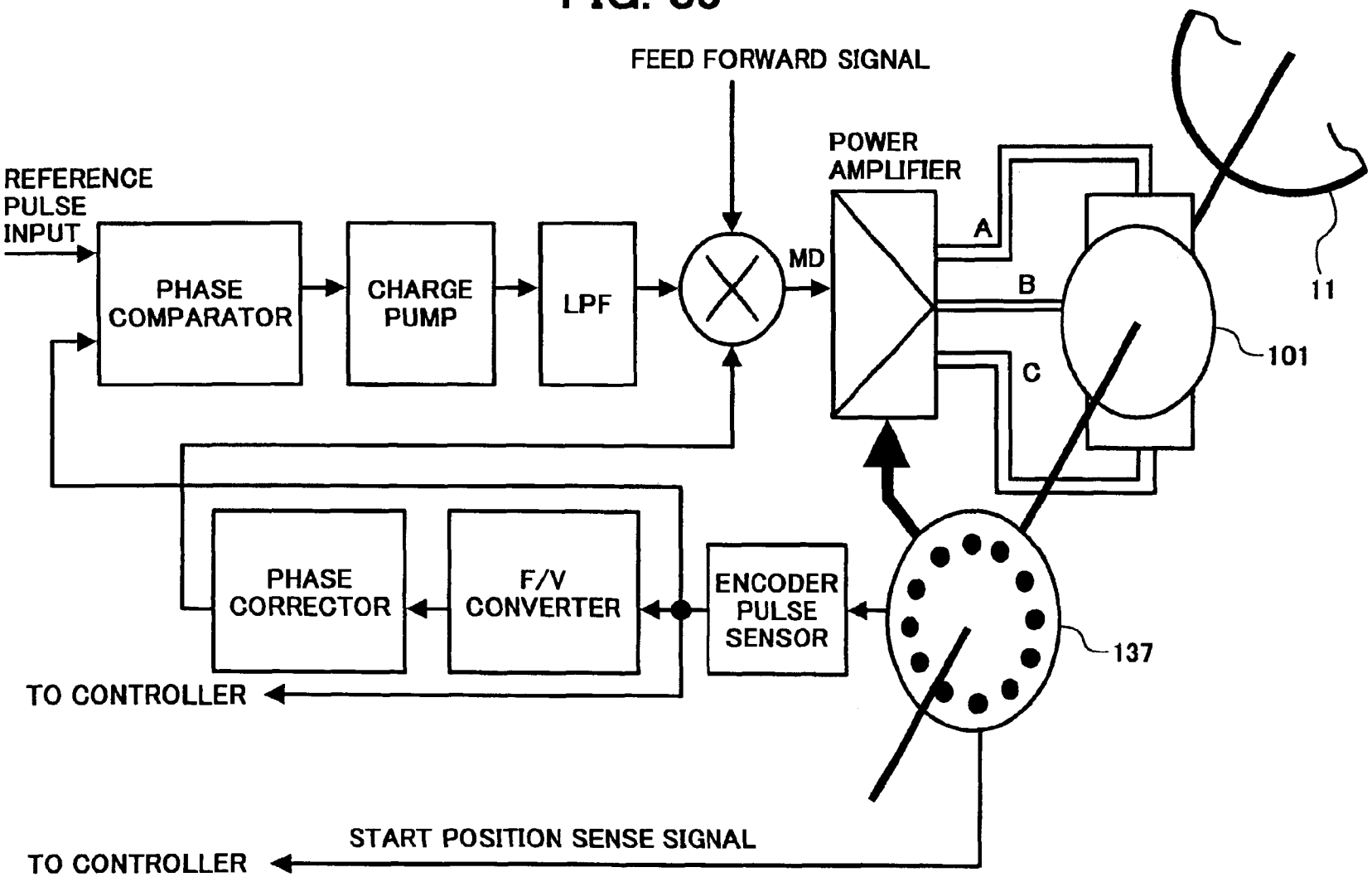
FIG. 33 is a schematic block diagram showing a control system for controlling a single drum and practicable with an outer rotor type coreless, brushless motor.

FIG. 32 shows a drum drive unit using the direct drive system described above. FIG. 33 shows a control system for causing a single drum to rotate at a constant speed with the outer rotor type coreless, brushless motor. In FIGS. 32 and 33, structural elements identical with those shown in FIG. 2 are designated by identical reference numerals and will not be described specifically in order to avoid redundancy. In the drum drive system, to protect the drive motor 101 from a torque ripple, the encoder 137 shown in FIGS. 30A and 30B is used to switch a three-phase power amplifier mainly implemented by three circuits each having the configuration of FIG. 28.

The drum drive unit shown in FIG. 32 uses a PLL system and executes constant-speed control with reference input pulses and encoder output pulses being synchronized to each other. All the drums 11 are controlled by the same reference input pulses and can therefore be accurately controlled. The F/V converter and phase corrector are used to stabilize the control. The feed forward input is used to cause a steady current corresponding to a steady frictional load known beforehand to flow.

How the drum drive unit executes accurate control over the rotation of the drive motor will be described hereinafter. The rotation speed of each drum 11 varies due to changes in load ascribable to the passage of a sheet and developing and cleaning operations. The rotation speed of the drum 11 varies due to aging and varying environment (temperature and humidity) as well. It follows that by monitoring the drive current of the DC motor and feeding it forward at the time of control over the next cycle, it is possible to enhance control accuracy. More specifically, the loop gain of the feedback system is limited by, e.g., the rigidity of the mechanical structure and should not be excessively increased. Therefore, to enhance accuracy with the limited loop gain, if a motor driving force capable of directly overcoming a load variation that can be estimated is generated, feedback control should only be executed by overcoming a load variation corresponding to an error.

As for the feed forward control over the drive motor, feed forward data is changed, e.g., cycle by cycle. When the feed forward data is changed by two or more cycles, the mean value of two or more cycles is used as feed forward data. The feed forward data varies in accordance with the rotation angle or the drum or the position of a sheet being conveyed. The initial data is printed on the production line while feed forward data is written to a flash ROM or similar nonvolatile memory. A current to be fed to the drive motor can be sensed if, in the drive circuit of FIG. 28, a voltage appearing between opposite ends of a resistor directly connected to the coil is sensed. However, it is easier to measure a voltage Vr between the terminals of a sensing resistor Ri shown in FIG. 28. While FIG. 28 shows only a drive circuit assigned to one of three phases, a sum of voltages Vr of the three phases is representative of a voltage Vd proportional to a current i that is fed in accordance with a load variation F in order to drive the drum at a constant speed.

While a servo amplifier shown in FIG. 28 is of a constant current source type, the current i flowing therethrough has a relation of $F=Kt\times i$ where Kt denotes a motor torque constant. The sensed voltage Vd can therefore be used as load variation information F. Information produced by digitizing the sensed voltage Vd should only be sequentially written to the memory of the controller in synchronism with drum rotation angle information output from the encoder.

The controller, not shown in FIG. 33, outputs, among information stored in the memory, information corresponding to the current rotation angle of the drum, converts the information to analog information, and uses the analog information as a feed forward signal. Such control is executed with each drum driveline.

The high-accuracy drive control method described above is similarly applicable to the belt drive control system that controls the drive of the conveying belt 40. The difference is that in the case of the belt drive control system, feed forward information of one period corresponds to one rotation of the belt 40.

Figure 34:
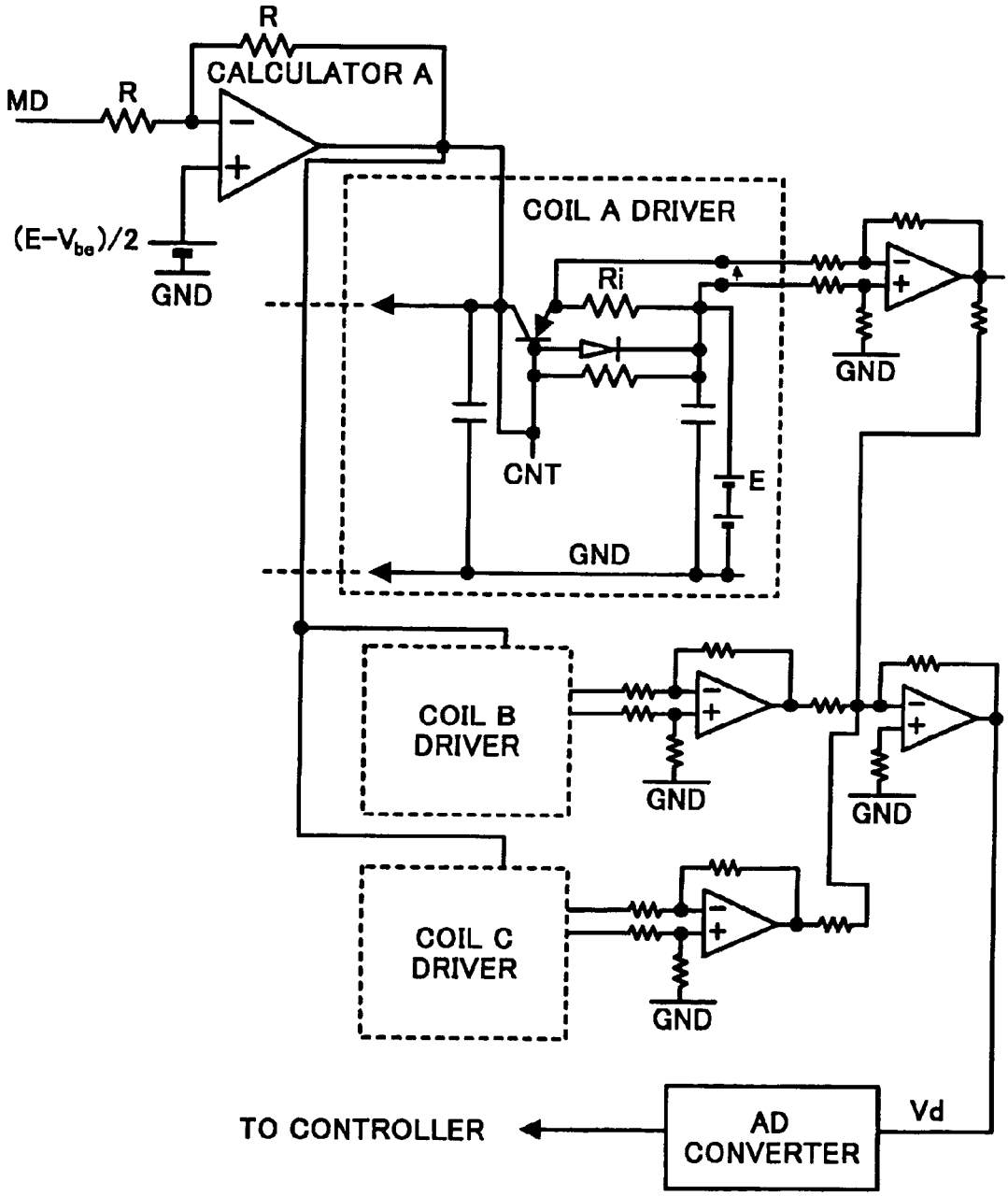
FIG. 34 shows part of the control system of FIG. 33 in detail.

FIG. 34 shows circuitry extending from a servo amplifier drive signal MD shown in FIG. 33 to part of the individual motor coil drive circuit having the configuration of FIG. 28 and the sensing of the voltage Vd. To cause the current i proportional to the drive signal MD to flow, a calculator A adds a DC bias E-Vbe (E denotes a power supply voltage and Vbe denotes the base-emitter voltage of a transistor) to the MD signal and inverting it.

Fourth Embodiment

Figure 35:
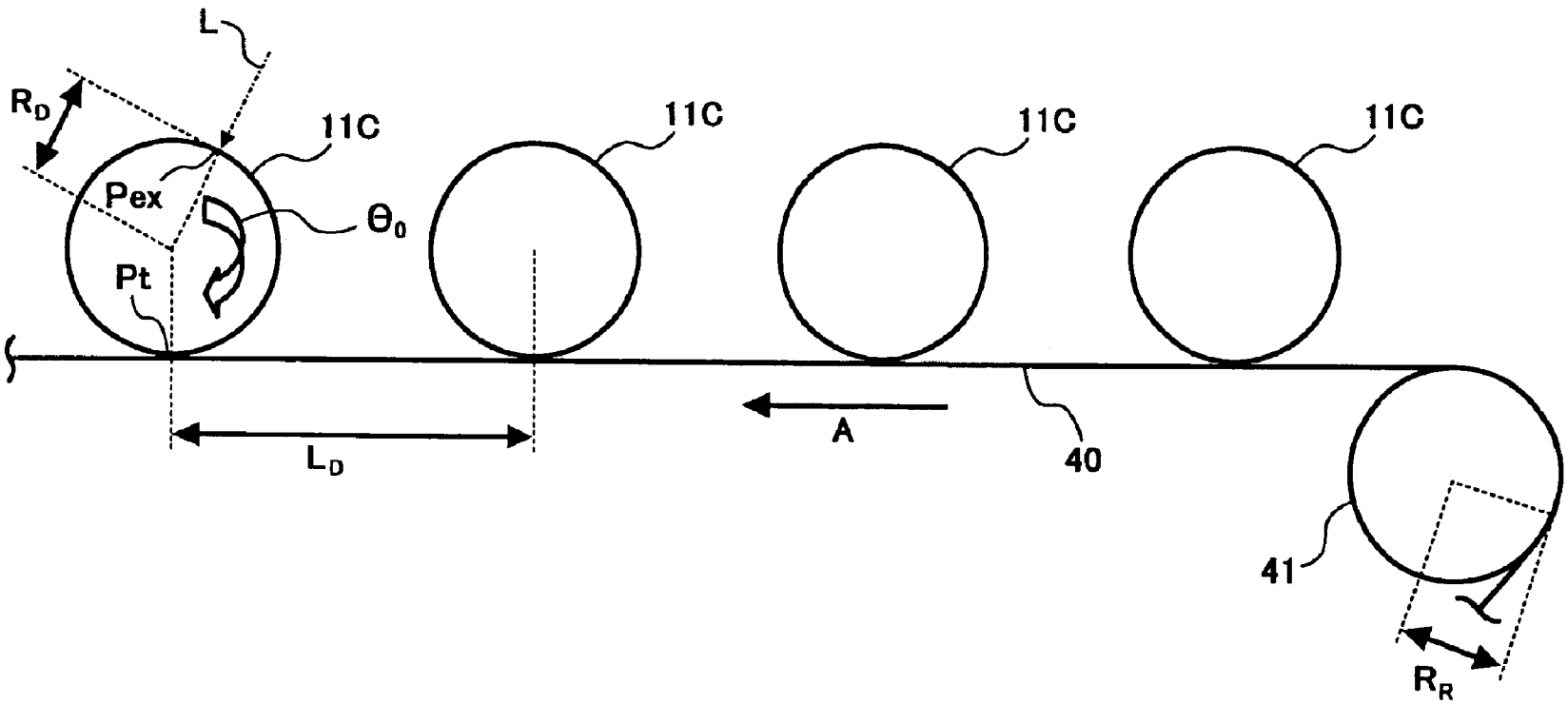
FIG. 35 shows parameters particular to a fourth embodiment of the present invention.

To reduce the influence of the speed variations of the drum 11 and the speed variation of the belt 40 on color misregister, a fourth embodiment determines specific apparatus parameters including the exposure position Pex and the radiuses of the drums. As shown in FIG. 35, the drums 11 and belt 40 are driven by a direct drive system. The eccentricity of any one of the drums 11 causes the nip width (width over which the drum 11 and belt 40 contact each other) and the relative speed between the drum 11 and the belt 40 at the image transfer position Pt to vary. The variation of the nip width translates into the variation of adhesion to act between the drum 11 and the belt 40, causing the load on the belt drive system synchronous to the period of rotation of the drum 11 to vary. The variation of the load occurs at each of the drums 11 at the same period, so that the variation of the combined load is synchronous to one rotation period of the drums 11. As a result, a control error occurs in the belt drive system and causes the belt speed to vary in synchronism with one rotation period of the drums 11. The variation of the belt speed is transferred to the drums 11 and eventually causes the speed of each drum 11 to vary in synchronism with the speed variation of the belt 40. If the speed variations of the drums 11 are not matched to each other, then toner images of different colors are brought out of register on a sheet. This is because although the speed variation phase of the drums 11 are matched, a phase relation between the exposure timing and the speed variation period differs from one drum 11 to another drum 11 due to the unexpected drum distance. Assume that each drum 11 has an angular velocity of ωD while the belt 40 moves at a speed of Vb.

In the illustrative embodiment, to reduce the influence of the rotation speed variation ascribable to, e.g., the eccentricity of each drum 11 and synchronous to the rotation period of the drum 11 on color misregister, the phases of the rotation angle variations of the drums 11 and the phase of color register are matched to each other.

A period of time (period) $T_D$ necessary for each drum 11 to complete one rotation is expressed as:

$$T^D=2\pi/\omega_D \quad \text{Eq. (30)}$$

Assuming that the drum 11 has a diameter D of $2R_D$, then the peripheral speed $V_D$ of the drum 11 is produced by:

$$V_D=\omega_D\times D/2 \quad \text{Eq. (31)}$$

Therefore, $T_D$ and $V_D$ have the following relation:

$$T_D=\pi_D/V_D \quad \text{Eq. (32)}$$

It follows that a period of time $T_B$ necessary for the sheet 2 being conveyed by the belt 40 to move the drum distance $L_D$ at the belt speed Vb is expressed as:

$$TB=LD/Vb \quad \text{Eq. (33)}$$

Therefore, the influence of the rotation speed variation identical in period with one rotation of each drum 11 on color misregister can be reduced if the diameter D of the drum 1 and drum distance $L_D$ are so selected as to satisfy a relation:

$$T_B=N\ (\text{natural number})\times T_D \quad \text{Eq. (34)}$$

More specifically, the drum diameter D and drum distance $L_D$ should only be selected to satisfy:

$$L_D=N\times\pi D\times Vb/V_D \quad \text{Eq. (35)}$$

Assuming that the rotation speed of the drive roller 41 that drives the belt 40 is $\omega_R$, then the rotation period $T_R$ of the drive roller 41 is expressed as:

$$T_R=2\pi/\omega R=2\pi R_R/Vb \quad \text{Eq. (36)}$$

Therefore, a condition that should be satisfied for reducing the influence of one rotation period of the drive roller 41 on color misregister is:

$$T_B=M\ (\text{natural number})\times T_R \quad \text{Eq. (37)}$$

A period of time TΘo necessary for the drum 11 to rotate over the angle Θo from the exposure position Pex to the image transfer position Pt is expressed as:

$$T\Theta o=T_D\times\Theta o/(2\pi) \quad \text{Eq. (38)}$$

Therefore, to reduce color misregister ascribable to the rotation speed variation of the drum 11 occurring in synchronism with the rotation period of the drive roller 41, there should be satisfied:

$$T\Theta o=I\ (\text{natural number})\times T_R \quad \text{Eq. (39)}$$

For example, assuming that there hold N=1, M=2 and I=1, then the peripheral speed $V_D$ of the drum 11 and belt speed Vb are derived from the Eq. (35), as follows:

$$L_D=\pi DVb/V_C \quad \text{Eq. (40)}$$

Also, the Eqs. (33), (36) and (37) derive:

$$L_D=4\pi R_R \quad \text{Eq. (41)}$$

Further, the Eqs. (40) and (41) derive:

$$R_R=(D/4)(Vb/V_D) \quad \text{Eq. (42)}$$

Moreover, the Eqs. (32), (36), (38) and (39) derive:

$$\Theta o=4\pi R_R V_D/(Vb\times D) \quad \text{Eq. (43)}$$

By substituting the Eq. (42) for the Eq. (43), there is obtained:

$$\Theta o=\pi \quad \text{Eq. (44)}$$

In the above specific case, if the exposure position Pex is shifted from the image transfer position Pt by π (rad) and if the diameter of the drum 11 is D, then the radius RR of the drive roller 41 is $(D/4)\cdot(Vb/V_D)$ while the drums distance $L_D$ is $4\pi R_R$. In such conditions, a system causing a minimum of color misregister to occur can be constructed.

So long as the natural numbers N, M and I are not specified, θo is generally expressed as follows. The Eq. (35) derives:

$$L_D=N\pi DVb/V_D \quad \text{Eq. (45)}$$

The Eqs. (32), (34), (36), (37) and (45) derive:

$$L_D=2\pi MR_R \quad \text{Eq. (46)}$$

Further, the Eqs. (45) and (46) derive:

$$R_R=\{ND/(2M)\}(Vb/V_D) \quad \text{Eq. (47)}$$

The Eqs. (32), (36), (38) and (39) derive:

$$\Theta o=4\pi IR_R V_D/(Vb\times D) \quad \text{Eq. (48)}$$

By substituting the Eq. (46) for the Eq. (48), there is obtained the following general expression:

$$\Theta o=2\pi I\times N/M \quad \text{Eq. (49)}$$

In this case, if the exposure position Pex is angularly shifted from the image transfer position Pt by (2πI×N/M) (rad) and if the diameter of the drum 11 is D, then the radius $R_R$ of the drive roller 41 is {ND/(2m)}·(Vb/VD) while the drum distance $L_D$ is $2\pi MR_R$. In such conditions, a system that causes a minimum of color misregister to occur can be constructed.

By using Θo, D (=$2R_D$), $L_D$ and $R_R$ so determined, it is possible to obviate the influence of the speed variations of the drums 11 ascribable to the eccentricity of the drums and the influence of the speed variations of the belt 40 and drums 11 ascribable to the eccentricity of the drive roller 41. Conventional technologies cannot cancel the influence of speed variations ascribable to the eccentricity of the drums 11.

Assume that the belt 40 is indirectly driven by a drive motor via a transmission member, e.g., a gear or a toothed belt. Then, the various conditions D, $L_D$, $R_R$ and Θo stated above are maintained the same. On the other hand, the diameter (or the number of teeth) of the gear or the circumferential length (or the number of teeth) of the toothed belt is selected such that the natural multiple of the period of rotation speed variation ascribable to the eccentricity and cumulative tooth pitch error of the gear or the thickness error and cumulative tooth pitch error of the belt is equal to the rotation period $T_R$ of the drive roller 41. This condition satisfies the Eqs. (34), (37) and (39). Therefore, the natural multiple of the rotation speed variation period of the transmitting member is equal to the period of time TΘo necessary for the drum 11 to rotate over the angle θo, too. Consequently, there can be obviated color misregister ascribable to the gear or the toothed belt.

In the above indirect belt drive system, assume that there does not hold the relation $T_B$=N (natural number)×$T_D$ between the rotation period $T_D$ of the drum 11 and the period of time $T_B$. Even in such a condition, there can be reduced color misregister ascribable to the variation of the gear or that of the toothed belt only if the following relations hold:

$$T_B=M_G \text{ (natural number)}\times TR_G$$

$$T\Theta o=I_G \text{ (natural number)}\times TR_G$$

where TG denotes the variation period of the transmission member of the belt drive system. The indirect belt drive system saves power and cost, compared to the direct belt drive system, and is therefore desirable if the previously stated phase matching satisfies target image quality.

The above relation is also true with the indirect drive of the individual drum 11 although not shown or described specifically.

While the first to fourth embodiments have concentrated on a transfer medium in the form of a sheet to be conveyed by a conveying belt, the present invention is similarly practicable with an intermediate image transfer body implemented as a belt. Also, the present invention is practicable without regard to the number of toner image forming sections, which is four in the illustrative embodiments. Further, the present invention can be implemented as any desired image forming apparatus other than the printer, e.g., a copier or a facsimile apparatus.

As stated above, the first to fourth embodiments achieve various unprecedented advantages, as enumerated below.

(1) A driven transmission member that receives a drive force from a drive source can be positioned relative to a relaying member such that the rotation speed variation of the driven transmission member for one rotation period decreases. It is therefore possible to reduce the dislocation of a toner image transferred from an image carrier to a transfer medium and to reduce the machining cost of the driven transmission member.

(2) Even when a plurality of image carriers each have a rotation speed variation for one rotation period, there can be reduced the misregister of toner images transferred from the image carriers to a transfer medium. This is also true when an image forming apparatus is operable in a mode in which only part of the image carriers is rotated.

(3) Even after the assembly of the image forming apparatus, a relation between the image carriers in relative rotation position can be adjusted such that the toner images transferred from the image carriers are free from misregister.

(4) Even when the phases of rotation speed variations of the image carriers become different from each other with the elapse of time, there can be surely reduced the misregister of toner images transferred from the image carriers to a transfer medium. In addition, sensing means capable of sensing an absolute rotation angle is used to adjust the rotation position relation and control the rotation speed of the individual image carrier at the same time, so that accurate color register is achievable at low cost.

(5) The drive source for driving the individual image carrier is implemented as an outer rotor type motor capable of directly driving the image carrier with a minimum of cogging. This type of motor further promote the accurate drive of the image carrier for thereby freeing toner images from misregister and enhancing image quality.

(6) A flywheel to be mounted on the motor can be reduced in size.

(7) Even when a load acting on the image carrier or similar rotary body or the transfer body varies due to the varying environment, the rotary body or the transfer medium can be accurately driven. This insures high-quality images free from misregister.

(8) Even when the image carriers are driven with peripheral speeds thereof varying in the same phase due to, e.g., eccentricity, there can be obviated misregister ascribable to the peripheral speed variations.

(9) A rotary drive member drives an endless belt, which conveys the transfer medium, or the transfer member implemented as an endless belt in contact therewith. Even when the rotation speed of the rotary drive member varies and causes the moving speed of the transfer medium to vary, there can be obviated the misregister of toner images transferred from the image carriers to the transfer medium. Further, there can be implemented the diameter of the individual image carrier, a relation between the exposure position and the image transfer position of the image carrier and a relation between the distance between the image carriers and the diameter of the rotary drive member that obviate color misregister.

(10) The image forming apparatus can be reduced in size.

(11) The rotary drive member is driven by a drive system including a driven transmission member and superior to a direct drive system using a motor in energy efficiency and cost. Even when the moving speed of the transfer medium varies due to the rotation speed variation of the driven transmission member synchronous to the rotation period of the same, there can be obviated the misregister of toner images transferred from the image carriers to the transfer medium. This is also true when the rotation speed of the driven transmission member varies due to, e.g., eccentricity or when the above drive system is applied to the image carriers.

Fifth Embodiment

This embodiment is directed toward the sixth object stated earlier. To better understand the fifth embodiment, there will be described the variation of a load acting on a conveying belt or an intermediate image transfer belt at an image transfer position. At an image transfer position, a relative speed between a photoconductive drum and a belt contacting each other varies due to the eccentricity and the scatter of the diameter of the drum. Assume that the drum has an ideal diameter free from an error, and that the peripheral speed of the drum and the linear velocity of the belt are identical at the image transfer position. Then, when the diameter of the drum is increased, the peripheral speed of the drum becomes higher than the linear velocity of the belt with the result that a force that pulls the belt acts on the belt. Further, when the drum is eccentric, the peripheral speed of the drum varies at the image transfer position and causes the load acting on the belt to vary. This can be readily understood from the following phenomenon.

Figure 36:
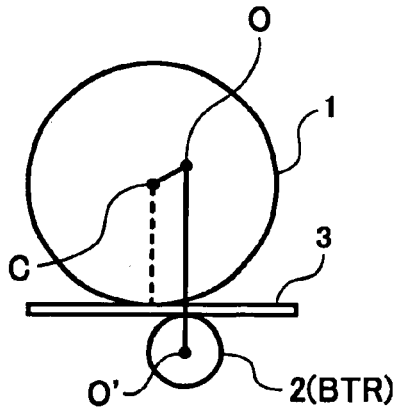
FIG. 36 shows the configuration and operation of a conventional image transfer position.

Assume that the image transfer process uses a BTR (Biased Transfer Roller). Then, as shown in FIG. 36, the axis of a BTR 2 exists on a line O-O' passing through the axis O of a drum 1 and perpendicular to a belt 3. The BTR 2 contacts the drum 1 via the belt 3, forming an image transfer position. Electrostatic adhesion acts at the image transfer position. When the diameter of the drum 1 increases, a nip width over which the belt 3 and drum 1 contact each other increases and moreover varies if the drum 1 is eccentric, i.e., if the axis O is shifted from the center C of a circular section. As a result, the electric adhesion varies at the image transfer position. When the diameter of the drum 1 is increased, the peripheral speed of the DC component and the nip width increase, intensifying the force of the DC component pulling the belt. Further, the eccentricity of the drum 1 causes the peripheral speed of the drum 1 and therefore the electrostatic adhesion to vary, causing the force pulling the belt 3 and ascribable to the drum 1 to vary in an AC fashion.

The above load variation consisting of the DC component and AC component having the same period as the rotation of the drum 1 occurs at each of a plurality of drums. Particularly, as for the AC load variation, the period is usually the same throughout the drums, but the amplitude and phase differ from one drum to another drum because the size of eccentricity and phase depend on the drum. However, the load variation made up of the above components has the same period as the rotation of the drum. Consequently, a belt drive system involves a DC load variation and an AC load variation having the same period as the rotation of the individual drum. Such load variations cannot be known beforehand because the drums, which are sometimes replaced on the market, are different in diameter from each other. In addition, the electrostatic adhesion cannot be known beforehand because it varies with the kind of sheets and environmental conditions including temperature and humidity.

A speed control system is used to maintain the belt speed constant without regard to the load variations. The speed control system needs a feedback circuit having a loop gain great enough to reduce the DC and AC components that cannot be estimated. However, an increase in loop gain directly translates into rigidity required of a belt drive mechanism, i.e., required of the belt. In the case of a tandem printer including four drums, it is difficult to provide the belt, which is long, with high rigidity.

A difference in diameter between the drums causes part of the belt between nearby drums to tense or slacken. More specifically, when the upstream drum and downstream drum in the direction of movement of the belt have a large diameter and a small diameter, respectively, a force that pulls the belt acts on the belt. Conversely, when the upstream drum and downstream drum have a small diameter and a large diameter, respectively, a force that loosens the belt acts on the belt. It follows that even the DC component of the variation of drum peripheral speed causes the belt to tense or slacken, i.e., to oscillate, resulting in misregister.

Another problem is that when a difference in speed (relative speed) between the drum and a sheet or an intermediate image transfer belt increases at the image transfer position, image quality is lowered. More specifically, when a relative speed difference (slip) occurs between the drum and a sheet or an intermediate image transfer body, the line width of an image varies, i.e., increases or decreases by an amount δI representative of a difference between the line width Iw of a toner image on the drum and the line width of the toner image on a sheet or an intermediate image transfer belt. The variation δI is produced by:

$$\delta I=(W+Iw)\cdot\Delta V/Vd \qquad \text{Eq. (50)}$$

where ΔV denotes a difference between the peripheral speed Vd of the drum and the linear velocity of Vb of the belt, and W denotes the nip width.

In the Eq. (50), an increase in relative speed ΔV causes the variation δI to increase, meaning that a toner image is transferred to a sheet or an intermediate image transfer belt while being rubbed. Further, the Eq. (50) indicates that the variation δI varies with the nip width W. The nip width varies with the drum diameter as well; generally, the larger the drum diameter, the larger the nip width.

Figure 37:
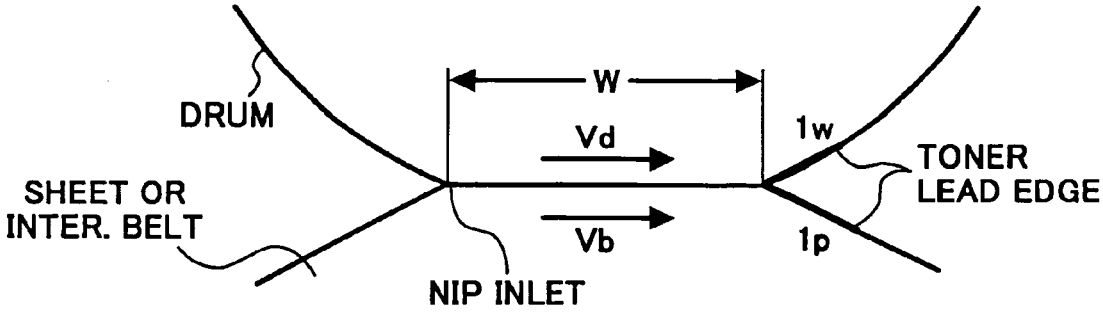
FIG. 37 shows the conditions of the image transfer position for analyzing distortion (increase or decrease in line width) ascribable to image transfer.

The Eq. (50) will be described more specifically with reference to FIG. 37, which shows the image transfer position with the nip width W. As shown, assume that a toner image on a sheet has a width Ip, and that a linear velocity ratio Vb/Vd is α. Then, a period of time T necessary for the toner image to move through the entire nip width W is expressed as:

$$T=(W+Iw)/Vd=(W+Ip)/\alpha Vd \qquad \text{Eq. (51)}$$

A difference between a distance W+Iw from the inlet of the nip to the leading edge of the toner image on the drum and a distance W+Ip from the inlet of the nip to the leading edge of the toner image on a sheet, i.e., Iw−Ip is representative of a difference in line width (increment or decrement) δI. The Eq. (51) therefore derives:

$$\begin{aligned}\delta I &= Iw - Ip = (W + Iw) - (W + Ip) = TVd(1-\alpha)\\ &= (W + Iw)(1-\alpha)\\ &= (W + Iw)(Vd - Vb)/Vd\end{aligned}$$

This is why the Eq. (50) holds.

It has been reported that for a line as thin as 42.3 μm, the line width begins to increase little by little at a point where the speed of an intermediate image transfer body is increased by 0.5% with respect to the speed of a photoconductive drum. This report supports the theory described above.

As for the influence of the eccentricity and the scatter of diameter of the drum on the line width, the results of trial calculations will be described hereinafter. As a practical example, assume that the drum has a diameter of 30 mm, a scatter of diameter of ±30 mm and eccentricity of 30 μm. When the drum is rotated at a constant angular velocity, the peripheral speed of the drum as measured at the image transfer position varies by ±0.3%. The speed variation of the drum and that of the belt are added to such a peripheral speed variation with the result that the variation becomes close to +0.5% reported in the past, resulting in the probability of image deterioration.

Image deterioration ascribable to the variation of the relative speed must be coped with in consideration of the increasing demand for higher image quality. While production technologies may be improved to reduce the diameter error of the drum and increase eccentricity accuracy, such a scheme needs prohibitive costs. Moreover, because the drum wears due to repeated operation and must be replaced in due course, an expensive drum, of course, increases the user's maintenance cost.

The illustrative embodiment relates to an image forming apparatus of the type including means for scanning an image carrier with a light beam modulated in accordance with image data in the main scanning direction to thereby write the image data, and transferring the resulting image from the image carrier to a transfer medium moving in the direction of movement of the image carrier. The transfer medium moves while being pressed against the image carrier, which is implemented as a photoconductive drum. The transfer medium is either one of a sheet to be conveyed by a conveying belt or conveying means and an intermediate image transfer belt.

In the illustrative embodiment, to improve image quality, distortion likely to occur in an image transferred to the transfer medium, i.e., the thickening of lines is minimized. Further, the misregister of images transferred from consecutive drums to the transfer medium is obviated. For these purposes, a relative speed variation between the drums and the belt at the image transfer position is reduced. In addition, the variation of a load to act on the belt drive system is reduced.

Figure 38:
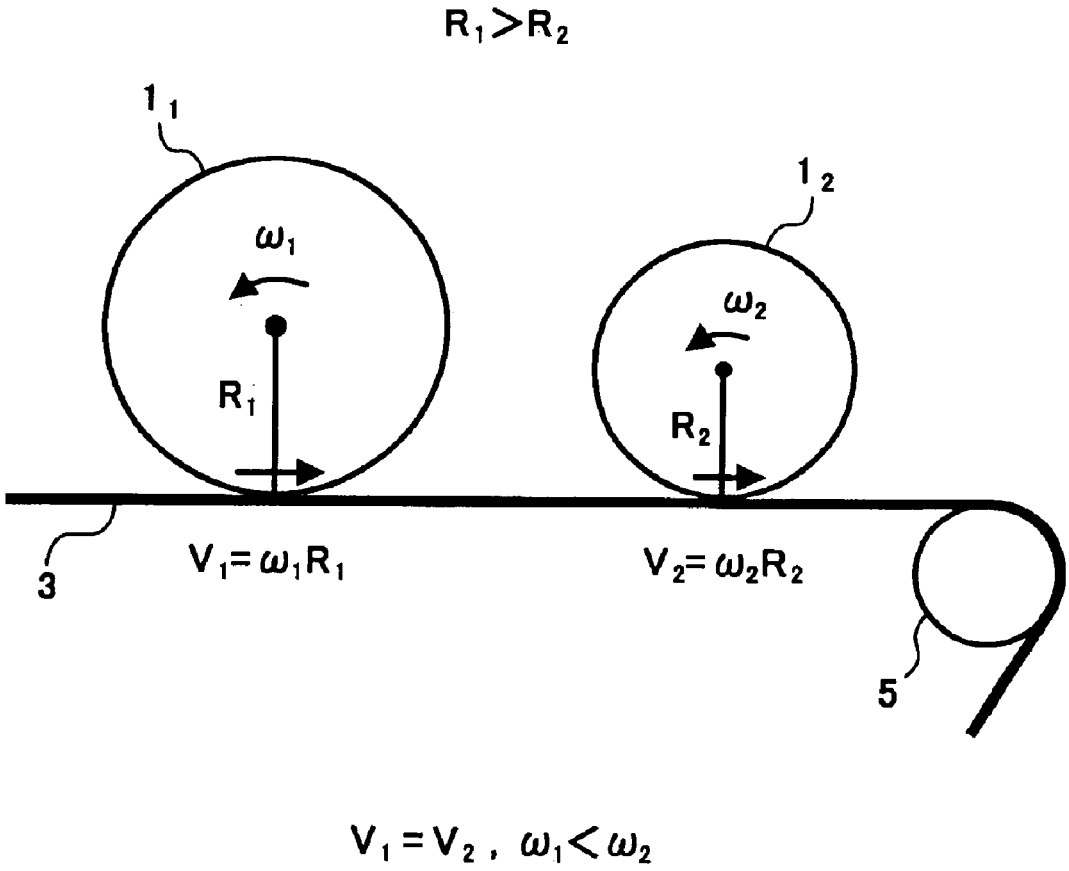
FIGS. 38 and 39 demonstrate the principle of a fifth embodiment of the present invention.

FIG. 38 demonstrates the principle of the illustrative embodiment. As shown, photoconductive drums $\mathbf{1}_1$ and $\mathbf{1}_2$ each contact a belt (conveying belt or intermediate image transfer belt) 3 at a respective image transfer position. The belt 3 is driven by a drive roller 5. The drums $\mathbf{1}_1$ and $\mathbf{1}_2$ respectively have different radiuses $R_1$ and $R_2$, and each is driven independently of each other. The drums $\mathbf{1}_1$ and $\mathbf{1}_2$ have the same mean peripheral speed; a mean peripheral speed refers to the mean value of periodical variations of peripheral speed to occur in synchronism with the rotation when the axis of rotation is eccentric. More specifically, assuming that the drums $\mathbf{1}_1$ and $\mathbf{1}_2$ respectively have peripheral speeds $V_1$ and $V_2$, then a relation of $V_1=V_2$ is set up to maintain a preselected relation between the drum peripheral speeds relative to the belt 3 at the image transfer positions.

For the above purpose, the drums $\mathbf{1}_1$ and $\mathbf{1}_2$ each are rotated at a particular angular velocity matching with the radius, so that their relative speeds can be identical with each other. More specifically, assuming that the drums $\mathbf{1}_1$ and $\mathbf{1}_2$ respectively have angular velocities $\omega_1$ and $\omega_2$, then $\omega_1$ and $\omega_2$ are selected such that the following relation holds:

$$V_1(=\omega_1 R_1)=V_2(=\omega_2 R_2)$$

When the radius $R_1$ is larger than the radius $R_2$ as in the specific case shown in FIG. 38, the angular velocity $\omega_1$ is lower than the angular velocity $\omega_2$.

However, assume that the angular velocities of the drums 11 and 12 are different from each other, as stated above, in the conventional system that assigns an identical exposure (writing) timing to a plurality of drums. Then, images are brought out of register when transferred from the drums. To solve this problem, the illustrative embodiment assigns a particular exposure timing to each drum in accordance with the angular velocity of the drum, so that images transferred from the drums are brought into accurate register on a transfer medium being conveyed by conveying means. This will be described more specifically with reference to FIG. 39.

Figure 39:
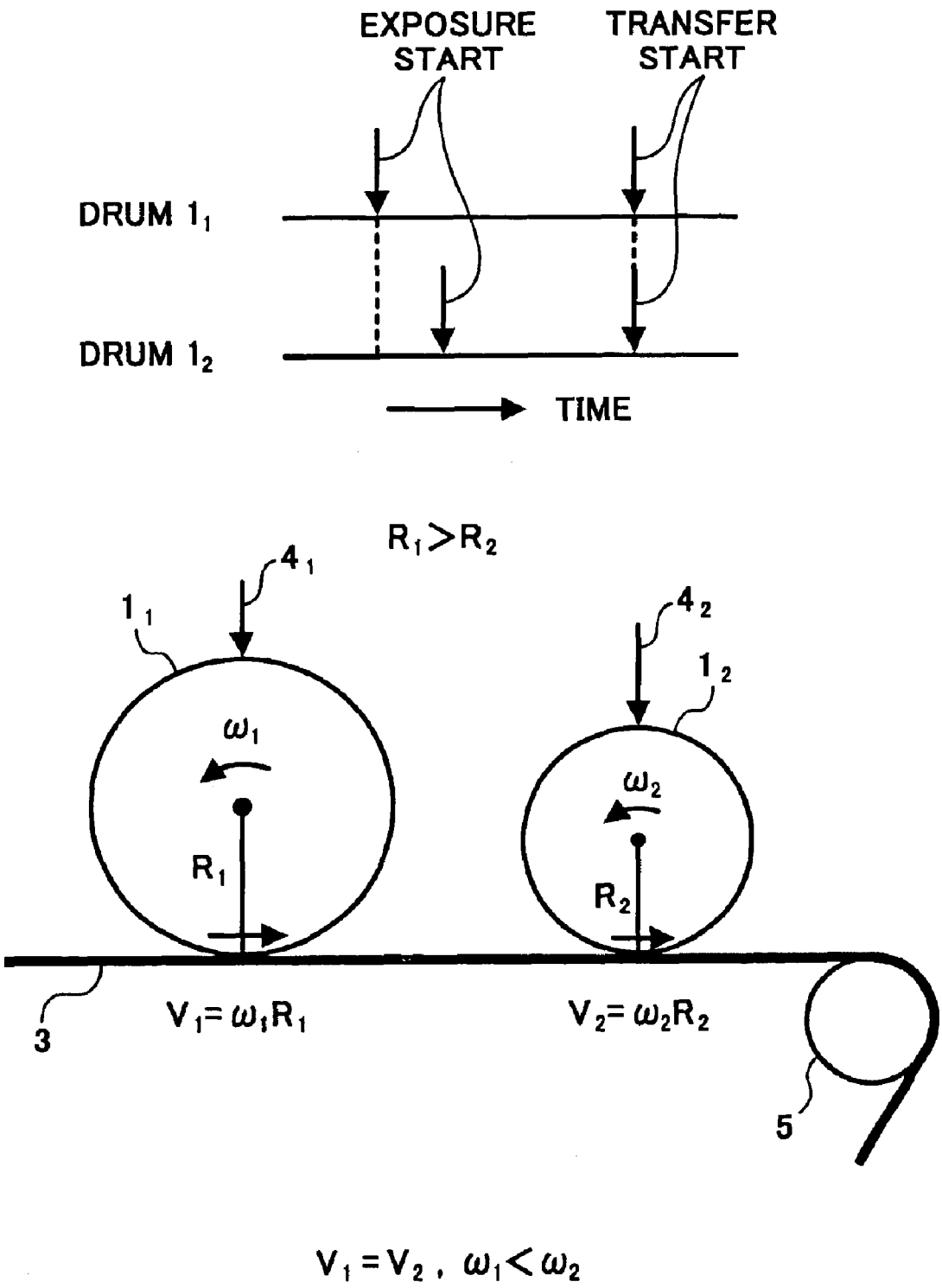

As shown in FIG. 39, the drums $\mathbf{1}_1$ and $\mathbf{1}_2$ are different in radius from each other as in FIG. 38 and respectively driven at the angular velocities $\omega_1$ and $\omega_2$ that set up $V_1=V_2$. In the specific case shown FIG. 38, $R_1>R_2$ and therefore $\omega_1<\omega_2$ holds, as stated above. An optical writing unit scans the drums $\mathbf{1}_1$ and $\mathbf{1}_2$ with light beams $\mathbf{4}_1$ and $\mathbf{4}_2$, respectively, in the main scanning direction, thereby writing image data in the drums $\mathbf{1}_1$ and $\mathbf{1}_2$. At this instant, to obviate misregister, a particular exposure timing is assigned to each of the drums $\mathbf{1}_1$ and $\mathbf{1}_2$, so that images can be transferred from the drums $\mathbf{1}_1$ and $\mathbf{1}_2$ to the same position on the belt 3 being driven by the drive roller 5. More specifically, in FIG. 39, because the angular velocity of the drum $\mathbf{1}_1$ having a large radius is low, the interval between the exposure and the image transfer is long. In this case, the image data must be sent to the exposing unit at an advanced timing to thereby start exposure. As for the other drum $\mathbf{1}_2$ having a small radius and therefore a high angular velocity, the image data must be sent to the exposing unit at a delayed timing.

In any case, the operations described above are determined on the assumption that the drum diameters are not identical, so that it is necessary to see the drum radiuses. Generally, the drums are replaced even after the printer or similar image forming apparatus has been purchased. The drum radiuses can therefore be automatically measured inside the image forming apparatus or measured on the production line. The drum diameters measured on the production line may be indicated by barcode labels adhered to preselected portions of the drums. If such barcode labels are available, then the apparatus body should only read them with a barcode reader disposed therein.

The principle of measurement of the drum diameters inside the image forming apparatus will be described hereinafter. To measure the drum radiuses, the drum drive system is not operated while only the belt drive system is operated to drive the conveying belt or the intermediate image transfer belt for thereby measuring the rotation of each drum for the distance of movement of the belt. For this measuring system, there are required sensing means for determining the rotation angle of each drum and sensing means for determining the distance of movement of the belt. With this system, it is possible to measure the radius of each drum by determining the distance of movement of the belt for one rotation of each drum.

To determine the distance of movement of the belt, a rotary encoder may be directly connected to the drive roller that drives the belt. Alternatively, a timing mark may be put on the end portion of the belt and read by a linear encoder. As for the rotation angle of each drum, a rotary encoder is directly connected to the shaft of the drum. The rotary encoder connected to the shaft of each drum can be used to accurately control the rotation of the drum while the rotary encoder of the linear encoder connected to the drive roller can be used for the accurate constant movement of the belt. Therefore, such encoders do not increase the cost of the apparatus.

In another specific system, the drums are driven via gears while the motors are controlled via encoders associated therewith. In such a system, a sensor that outputs a single pulse for one rotation should preferably be mounted on the shaft of each motor, so that the drum radius can be measured in terms of the number of pulses output from the linear encoder or the rotary encoder of the belt drive system for one rotation of the drum.

Figure 40:
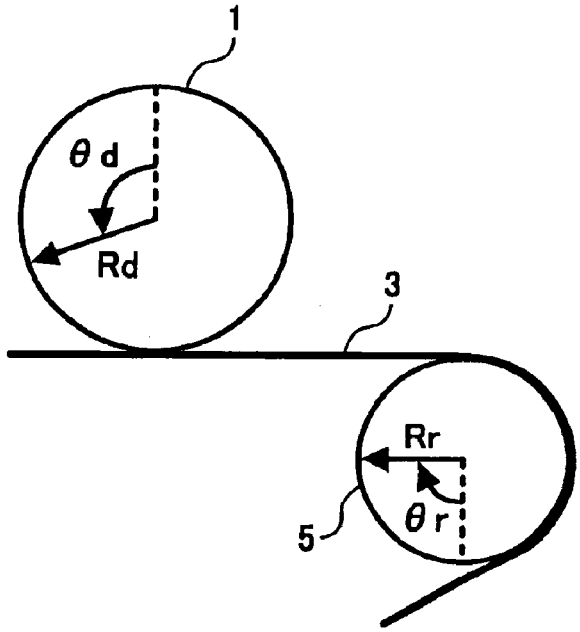
FIG. 40 shows the principle of drum radius measurement.

An exemplary procedure for measuring a drum radius with the above principle will be described hereinafter with reference to FIG. 40. As shown, assume that the drive roller 5 for driving the belt 3 has a radius Rr including an error ΔRr and rotates by an angle θr, that the drum 1 has a radius Rd including an error ΔRd and rotates by an angle θd. Then, when the thickness of the belt 3 is neglected, the distance Lb by which the belt 3 moves is expressed as:

$$Lb=(Rr+\Delta Rr)*\theta r \quad \text{Eq. (52)}$$

To measure the radius of the drum 1, the drum 1 rotates by being driven by the belt 3. Assuming that slip does not occur between the drum 1 and the belt 3, then there hold the following relations:

$$Lb=(Rd+\Delta Rd)*\theta d \quad \text{Eq. (53)}$$

$$Lb(Rd+\Delta Rr)*\theta r=(Rd+\Delta Rd)*\theta d \quad \text{Eq. (54)}$$

First Measuring Method

A first specific method of measuring the drum radius to be described hereinafter uses a rotary encoder included in the belt drive system and measures the error of the radius of the drum radius. More specifically, the first method determines the rotation angle of the drum when the belt drive system moves by one rotation of the drive roller. (θr=2π), thereby determining a radius error ΔRd:

$$\begin{aligned}\theta d &= 2\pi(Rr+\Delta Rr)/(Rd+\Delta Rd) \\ &= 2\pi Rr/(Rd+\Delta Rd)+\Delta\theta d\end{aligned} \quad \text{Eq. (55)}$$

where $$\Delta d=2\pi Rd/(Rd+\Delta Rd)$$

$$Rd+\Delta Rd=2\pi Rr/(\theta d-\Delta\theta d)\approx(2\pi Rr/\theta d)(1+\Delta d/\theta d) \quad \text{Eq. (56)}$$

Assuming that the drive roller radius is ideal (ΔRr=0), then ΔRd' calculated from the measured data θd is:

$$\Delta Rd'=(2\pi Rr/\theta d)-Rd \quad \text{Eq. (57)}$$

Therefore, the measurement error ϵ of the drive roller radius is:

$$\epsilon=\Delta Rd-\Delta Rd'=2\pi Rr\Delta\theta d/\theta d^2 \quad \text{Eq. (58)}$$

Assuming that the relative speed between the drum peripheral speed and the belt speed is constant, then the exposure timing is corrected on the basis of the drum radius error ΔRd determined by the first specific method, as follows.

Assume that the rotation angle between the exposure position and the image transfer position of the drum 1 is θet, and that the angular velocity of the drum 1 is ωd. Then, a period of time Tet necessary for the drum 1 to rotate by the angle θet is expressed as:

$$Tet=\theta et/\omega d \quad \text{Eq. (59)}$$

When the drive roller 5 is caused to rotate at a constant speed ωr and the thickness of the belt 3 is neglected, the belt 3 moves at the following linear velocity Vb:

$$Vb=\omega r*Rr \quad \text{Eq. (60)}$$

Therefore, to control the drum 1 such that the relative speed between the drum peripheral speed Vd and the belt speed Vb is ΔV (=Vd−Vb), the angular velocity ωd should be:

$$\begin{aligned}\omega d &= Vd/(Rd+\Delta Rd) \\ &= (\Delta V+\omega r*Rr)/(Rd+\Delta Rd)\end{aligned} \quad \text{Eq. (61)}$$

While the constant relative speed difference ΔV is sometimes necessary (Δ≠0) for image transfer reasons in order to enhance image quality, V is zero if the difference ΔV is not necessary. FIGS. 38 and 39 show the case wherein ΔV is zero.

The angular velocity ωd included in the Eq. (61) is measured by the first method and determined by the calculated ΔRd, so that the following equation holds:

$$\begin{aligned}Tet &= \theta et(Rd+\Delta Rd)/(\Delta V+\omega r*Rr) \\ &= \theta et*Rd/(\Delta V+\omega r*Rr)+\theta et*\Delta Rd/(\Delta V+\omega r*Rr)\end{aligned} \quad \text{Eq. (62)}$$

Assuming that Tet when the drum radius is ideal is Tetr, then Tetr is expressed as:

$$Tetr=\theta et*Rd/(\Delta V+\omega r*Rr) \quad \text{Eq. (63)}$$

The variation ΔTet of Tet ascribable to the variation ΔRd of the drum radius is:

$$\Delta Tet=\theta et*\Delta Rd/(\Delta V+\omega r*Rr) \quad \text{Eq. (64)}$$

It follows that if image data are sent with the period of time ΔTet being shifted from the scanning timing corresponding to the ideal drum radius, then image transfer can be effected at the same timing as the ideal drum. That is, when the drum radius is large, image data should only be sent earlier by ΔTet.

In the above condition, if the drive roller radius Rr has an error ΔRr, then the measured drum radius has an error ϵ. The drum rotation speed ωd is determined by assuming a drum diameter Rd+ΔRd including the error ϵ. Therefore, as for the error δT of the period of time ΔTet, there holds a relation:

$$\begin{aligned}\Delta Tet &= \theta et*(\Delta Rd'+\varepsilon)/(V+\omega r*Rr) \\ &= \theta et*\Delta Rd'/(\Delta V+\omega r*Rr)+\theta et*\varepsilon/(\Delta V+\omega r*Rr)\end{aligned} \quad \text{Eq. (65)}$$

and therefore $$\delta T=\epsilon*\theta et/(\Delta V+\omega r*Rr) \quad \text{Eq. (66)}$$

While the above procedure has measured the drum radius in terms of a drum rotation angle (θd) corresponding to the drive roller rotation ($\theta r=2\pi$), there may alternatively be measured a drive roller rotation angle $\theta t$ corresponding to a preselected drum rotation angle, e.g., one drum rotation $\theta d=2\pi$.

Second Measuring Method

A second specific method puts marks (scale) on the end of the conveying belt or that of the intermediate image transfer belt at preselected intervals as timing sensing marks. By sensing the marks, the second method causes the belt drive system to operate at a constant linear velocity. Because the distance of movement of the belt can be sensed by sensing the marks, a drum diameter can be determined by measuring a drum rotation angle when the belt has moved by a preselected distance or by measuring a distance of movement of the belt when the drum has rotated by a preselected angle, e.g., one rotation.

The distance of movement of the belt can be measured by counting the timing marks put on the end of the belt. This method differs from the first method in that it is not susceptible to the error of the drive roller diameter and is therefore free from the error $\delta T$ of the period of time $\Delta Tet$ even when the exposure timing is corrected by the above procedure.

The increment or the decrement $\delta I$ of the line width is represented by the Eq. (50). Therefore, as the relative speed difference $\Delta V$ of the individual drum decreases, the amount $\delta I$ and therefore the scatter of the amount $\delta I$ among the drums decreases, improving image quality. Should the relative speed difference V be not reduced, the amount I would become susceptible to both of the relative speed difference V and nip width W. By reducing $\Delta V$, it is possible to reduce the influence of the nip width W as well.

The foregoing description has concentrated on how the relative speed difference $\Delta V$ should be reduced to zero ($\Delta V=0$). Next, a method of protecting image quality from degradation when the variation of the nip width W ascribable to the error of the drum radius becomes the increment or the decrement $\delta I$ and effects image quality will be described.

If the relative speed difference can be reduced to zero ($\Delta V=0$), then its influence on the increment or the decrement $\delta I$ of the nip width or line width W is canceled because of the relation represented by the Eq. (50). However, there is a case wherein the relative speed difference cannot be reduced to zero ($\Delta V\neq 0$) for printing process reasons, as known in the art. For example, there is a case wherein image quality falls unless image formation has a relative speed difference $\Delta V$ lying in a certain range. In such a case, to maintain the amount $\delta I$ constant without regard to the variation of the nip width W, the speed difference $Ve=\Delta V$ is set in accordance with the drum radius to thereby maintain image quality constant. More specifically, when the drum radius and therefore the nip width is large, the angular velocity of the drum is so varied as to reduce the speed difference $\Delta V$.

Assume that when the drum radius is ideal, the nip width is Wi, the relative speed difference is $\Delta Vi$, and the drum peripheral speed is Vdi, then the increment or the decrement $\delta Ii$ of the line width is expressed as:

$$\delta Ii=(Wi+Iw)\cdot\Delta Vi/Vdi \qquad \text{Eq. (67)}$$

$\delta Ii$ included in the Eq. (67) is maintained constant to reduce the degradation of image quality. For this purpose, a relation between the drum radius R ($=Rd+\Delta Rd$) and the nip width W ($Wi+\Delta Wi$) is determined by experiments beforehand. That is, there is determined beforehand:

$$\Delta Wi=f(\Delta Rd) \qquad \text{Eq. (68)}$$

Maintaining the amount $\delta Ii$ constant means maintaining the following constant:

$$\delta Ii=(Wi+\Delta Wi+Iw)\cdot\Delta V/Vd \qquad \text{Eq. (69)}$$

Therefore, there holds:

$$\Delta V=C1/\{C2+f(\Delta Rd)\} \qquad \text{Eq. (70)}$$

It should be noted that if the drum is rotated at an angular velocity $\omega di$ implementing a relative speed difference $\Delta V$ for $C1=\delta Ii(wr*Rr)$ and $C2=Wi+Iw-\delta Ii$, then the amount $\delta Ii$ can be maintained constant. There holds:

$$\omega di=(\Delta V+\omega r*Rr)/(Rd+\Delta Rd) \qquad \text{Eq. (71)}$$

Because the relative speed difference $\Delta V$ relates to the size of the load to act on the belt drive system, the reference nip width Wi relating to, e.g., the rigidity of the belt should be so selected as to prevent $\Delta V$ from increasing.

Generally, even if the pixels of a yellow toner image forming part of a full-color image are not high quality, they are not conspicuous. In light of this, the control for reducing the relative speed difference may be executed with the drum assigned to a yellow toner image in place of the relative speed difference control that copes with the degradation of image quality ascribable to the variation of nip width. This successfully reduces the load to act on the belt drive system and enhances accurate control over the belt control system, thereby enhancing image quality as a whole.

Further, the system described above allows conventional conditions for obviating the influence of eccentricity on line width to be set, so that the eccentricity of the drums do not result in misregister in the event of image transfer. More specifically, misregister does not occur because the system makes the drum peripheral speed at the moment of exposure and the drum peripheral speed at the moment of image transfer equal. Of course, when the drum speed is varied, as stated above, the exposure timing should be varied.

Figure 41:
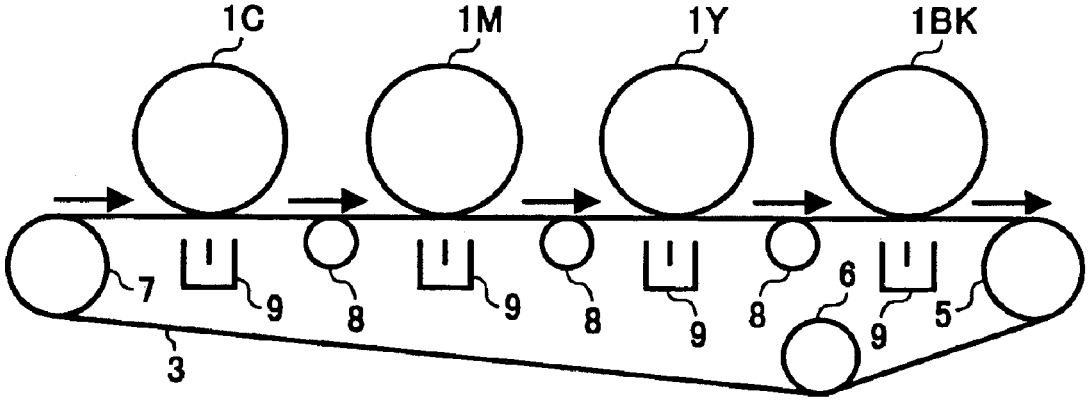
FIG. 41 shows a configuration relating to a sheet conveying section included in the fifth embodiment.

The fifth embodiment based on the principle described above will be described with reference to FIG. 41. In FIG. 41, conventional structural elements not relevant to the understanding of the illustrative embodiment are not shown. The illustrative embodiment is implemented as a tandem color image forming apparatus. As shown, the image forming apparatus includes an endless conveying belt (simply belt hereinafter) 3 passed over a drive roller 5, a driven roller 7, and a tension roller 6. The tension roller 6 is freely rotatable and biased against the belt 3 by a spring, not shown, to thereby prevent the belt 3 from slackening. The belt 3, which forms a sheet path, is pressed against drums 1C, 1M, 1Y and 1BK at preselected image transfer positions. Press rollers 8 each are interposed between nearby ones of the drums 1C through 1BK for helping the belt 3 be pressed against the drums. The press rollers 8 are also freely rotatable and biased against the belt 3 by springs. Image transfer chargers 9 are respectively positioned beneath the image transfer positions where the belt 3 contacts the drums 1C through 1BK.

When a belt motor, not shown, drives the drive roller 5 at a constant speed, the drive roller 5 causes the belt 3 to move at a constant speed to thereby convey a sheet of recording medium not shown. When the drums 1C through 1BK are not driven, they rotate by being driven by the belt 3.

The illustrative embodiment is similarly applicable to an image forming apparatus of the type including an intermediate image transfer belt, although not shown or described because it is conventional.

Essential structural elements of the illustrative embodiment will be described hereinafter. In the illustrative embodiment, the angular velocity of the individual drum is controlled in order to make the increment or the decrement δIi of line width constant at each drum by causing the peripheral speed of the drum and the moving speed of the belt coincide at the image transfer position or by varying the speed difference ΔV, as stated earlier. For this purpose, the illustrative embodiment includes drum radius sensing means having the following specific configuration.

Figure 42:
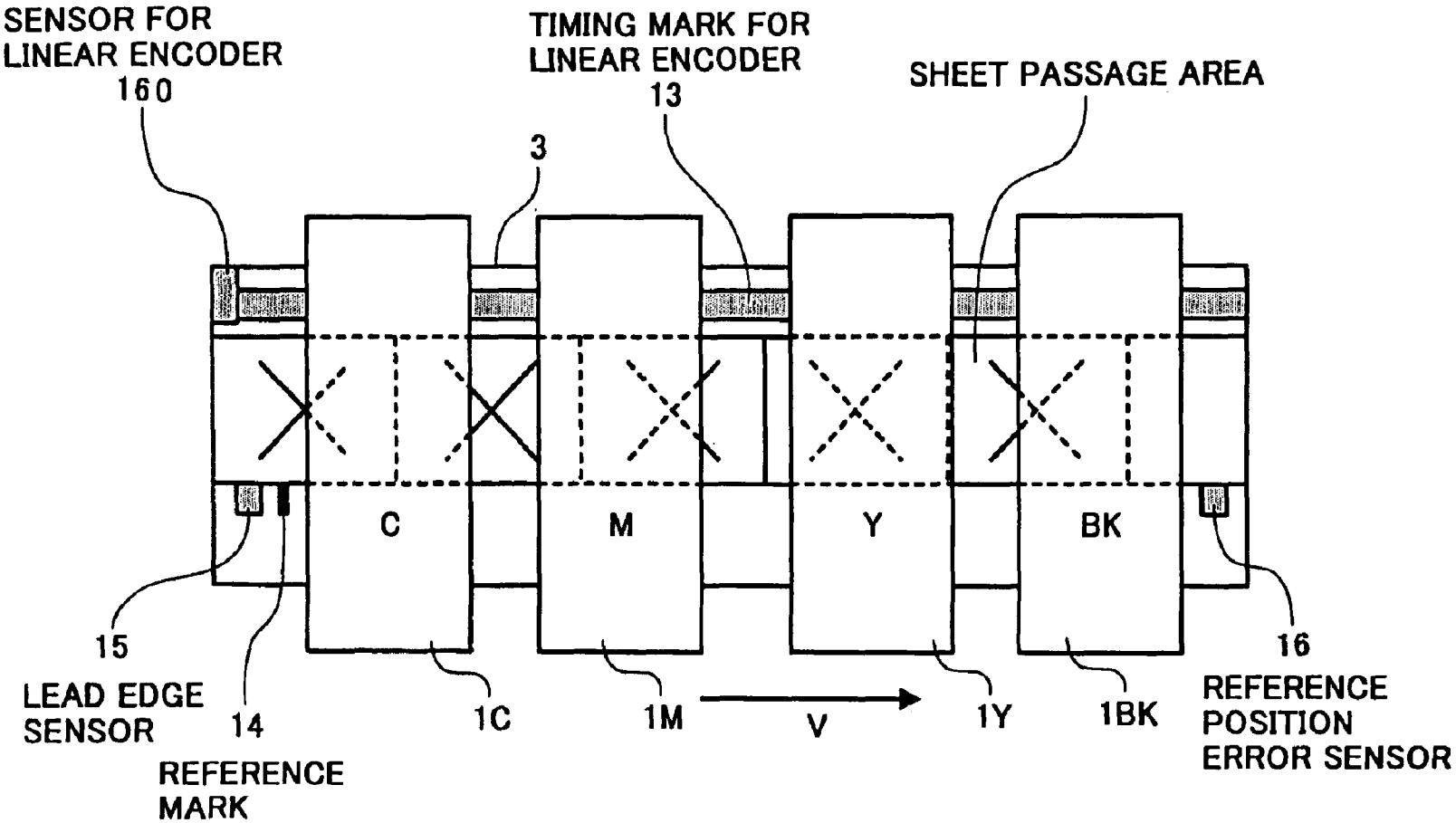
FIG. 42 shows a specific device including means for sensing the movement of a belt included in the fifth embodiment.

FIG. 42 shows a specific device including means for sensing the movement of the belt 3. In FIG. 42, the drums 1C through 1BK and belt 3 are shown in a top plan view. As shown, the belt 3 conveys a sheet positioned at its center in the widthwise direction at a speed V in a direction indicated by an arrow. The drums 1C through 1BK are arranged at preselected intervals in the direction of movement of the belt 3. The sheet is sequentially pressed against the drums 1C through 1BK, so that toner images are transferred from the drums 1C through 1BK to the sheet one above the other.

Marks (scale) 13 are positioned at preselected intervals on the edge portion of the belt 3 where the sheet P is absent. A sensor 160 affixed to the apparatus body senses the marks 13. With such sensing means, it is possible to measure the radius of each drum without resorting to an encoder otherwise attached to the individual drum, i.e., only if a sensor capable of sensing the reference position of rotation is available. Such a sensor outputs a single pulse for one rotation of the belt 3. More specifically, the belt drive system is driven to drive the belt 3 while causing the drums to follow the movement of the belt 3 without any slip. In this condition, there are counted the output pulses of the sensor 160 responsive to the marks 13 of the linear encoder, which correspond to one period of rotation of the drum that can be measured by the sensor capable of sensing the reference position of rotation. Assuming that the belt 3 moves the distance Lb for one rotation of the drum, then the drum radius R is equal to $Lb/2\pi$.

During the above measurement, to allow the belt 3 to rotate the drum without any slip, the drum is charged to guarantee friction between the belt and the drum or the drum drive system is driven to reduce the load to act on the belt drive system. The latter scheme is auxiliary control for reducing the load on the belt drive system; driving the belt and drum with the belt drive system is the major control.

A reference mark 14 is positioned on the belt 3 for determining the reference position of the belt 3. A leading position sensor 14 and a reference position error sensor 16 each sense the reference mark 14 as a timing signal relating to the movement of the belt 3. The timing signal is used for the correction of the positional error of the drum distance, which will be described later specifically.

Assume that an encoder responsive to a rotation angle is mounted on the shaft of the individual drum. Then, by sensing the rotation angle θi of the encoder when the belt 3 is moved by a length $L=2\pi Rd$ corresponding to the circumferential length of an ideal drum radius Rd, it is possible to determine the drum radius R by $R=L/\theta i$.

While the drum radius R may be measured on the production line and written to a flash memory or similar memory built in the apparatus, such a method is not desirable because drums are sometimes replaced on the market. The barcode scheme stated earlier is not desirable either, because it is not practicable without a costly bar code reader installed in the apparatus.

A specific configuration of the drive system essential with the illustrative embodiment will be described hereinafter. The drive system includes means for measuring drum radius and controlling angular velocity drum by drum, as stated earlier.

Figure 43:
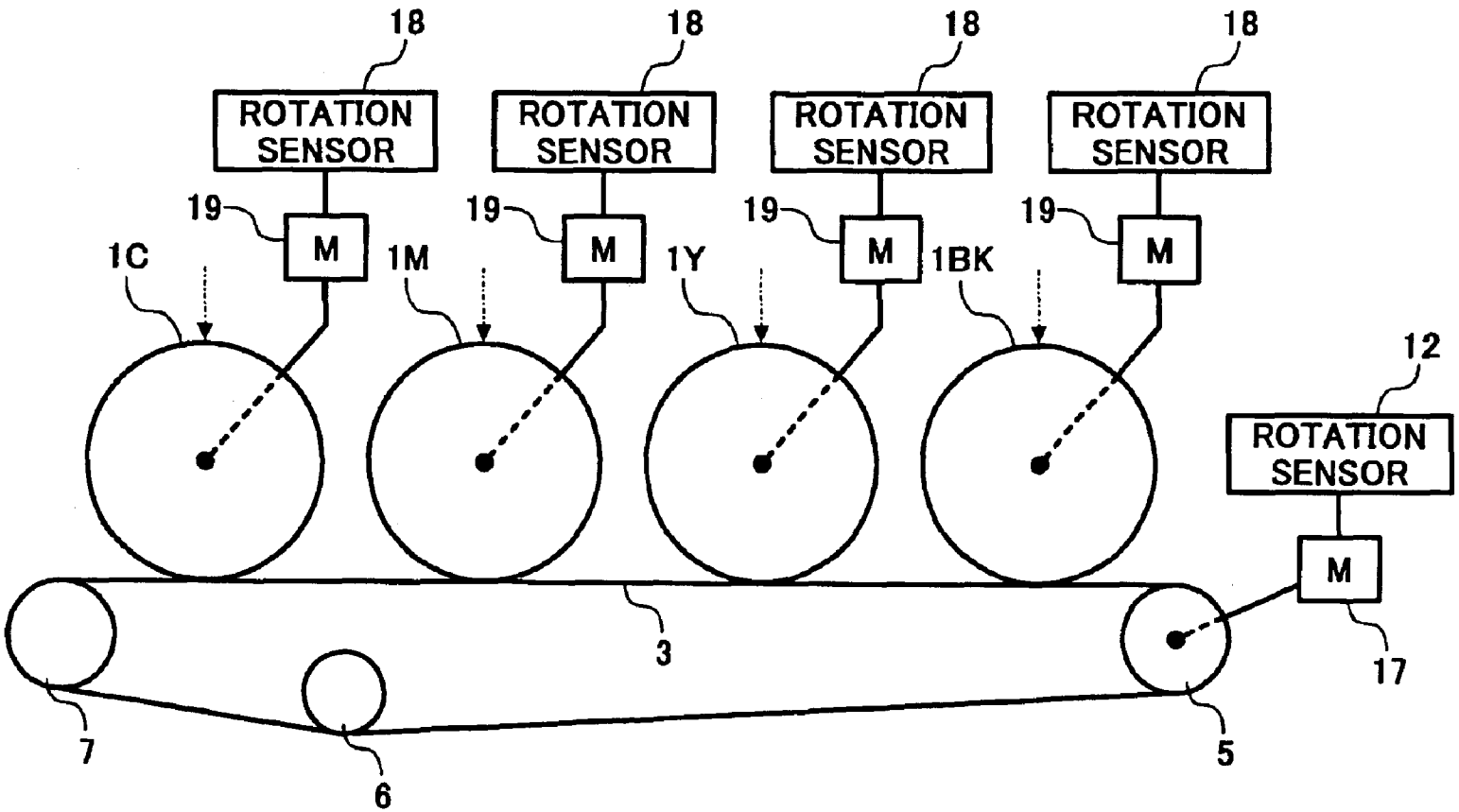
FIG. 43 shows a drive system relating to image transfer.

Specifically, as shown in FIG. 43, a rotation sensor or encoder 18 is attached to each of the drums 1C through 1BK. An encoder 12 responsive to a rotation angle is mounted on the shaft of the drive roller 5 in order to sense the position of the belt 3. If desired, the encoder 12 may be replaced with the linear encoder responsive to the marks put on the belt 3, as shown in FIG. 42. A drive motor 19 is assigned to each of the drums 1C through 1BK. The rotation of the motor 19 may be transmitted to the associated drum either directly or by way of gears or similar drive transmitting members. This is also true with a drive motor 17 assigned to the drive roller 5.

An exclusive light source unit and an exclusive scanning optics are assigned to each of the drums 1C through 1BK for scanning the associated drum, although not shown specifically. A laser diode included in the light source unit emits a laser beam modulated in accordance with image data toward a polygonal mirror included in the scanning optics. The polygonal mirror steers the incident laser beam to thereby scan the surface of the drum, which is moving in the subscanning direction, in the main scanning direction. At this instant, a mirror motor causes the polygonal mirror to rotate at a constant speed. As for the subscanning direction, the laser beam is incident to the drum at a fixed angular position to thereby fix the exposing (writing) position on the drum.

The operation of the drive system shown in FIG. 43 will be described hereinafter. When a power switch, not shown, provided on the apparatus is turned on, the radius of the individual drum is measured as an initial step. More specifically, the motor 17 drives the belt 3 via the drive roller 5 without a sheet being fed. At this instant, each drum is charged to cause adhesion to act between the belt 3 and the drum or the drum drive motor 19 is energized to drive the drum, too.

When the rotation sensor 18 senses one rotation of the associated drum, the radius of the drum is measured in terms of the number of output pulses of the linear encoder 15, FIG. 42, sensed by the sensor 11, as stated earlier. If desired, the phase of the pulse intervals may be additionally measured to enhance accuracy.

A target rotation (angular) speed of the drum is determined in accordance with the measured drum radius. More specifically, a controller, not shown, calculates a target rotation speed that reduces the increase of line width (distortion) and obviates misregister in accordance with the previously stated calculation procedure. The controller writes the target rotation speeds of the individual drums in a memory in the form of a lookup table and reads them out during actual image formation.

The illustrative embodiments corrects the positional error of the drum distance with the following specific procedure on the basis of the target drum speeds and the correction of image generation timing. In the arrangement shown in FIG. 42, assume that the drums 1C through 1BK each are held at an ideal position. Then, based on the timing at which the leading position sensor 15 positioned at the end of the belt 3 senses the reference mark 14 positioned on the belt 3, the illustrative embodiment records on the individual drum main scanning data that causes a test mark to be transferred over the reference mark.

The sensor 11 for the linear encoder sensor responsive to the belt movement senses the timing marks 13 of the belt 3. The resulting pulse signal representative of a belt speed is compared with a reference signal based on the output pulses of a reference oscillator, so that the belt 3 is controlled to a constant speed.

The mirror motor assigned to the polygonal mirror is also controlled to a preselected speed by, e.g., a PLL control system also using the reference signal based on the output pulses of the reference oscillator. Assume that a plurality of polygonal motors are used, and each is driven by a particular mirror scanning mechanism. Then, it is necessary to match the phases of the laser beams each being steered by a particular polygonal mirror to scan a particular drum in the main scanning direction. To meet this requirement, the illustrative embodiment positions a sensor (main scan start signal sensor) responsive to a laser beam arrived at a position corresponding to the end of the associated drum. The illustrative embodiment shifts the rotation phases of the four polygonal mirrors in such a manner as to match the phases of pulses output from the four main scan start signal sensors.

Figure 44:
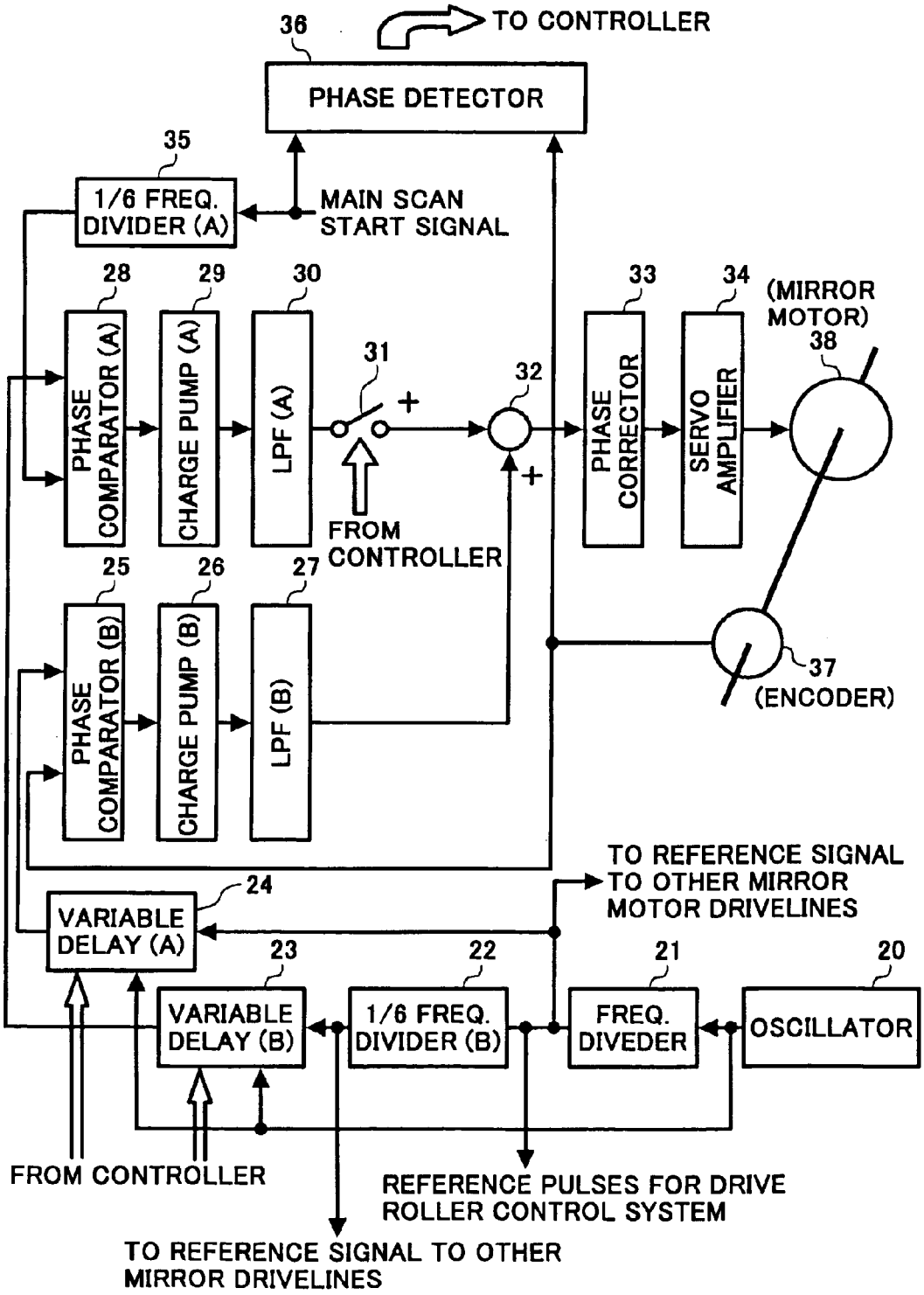
FIG. 44 is a schematic block diagram showing circuitry for controlling a motor, which drives a polygonal mirror, in order to synchronize main scanning.

FIG. 44 shows specific control circuitry for executing the above control over the polygonal mirrors. In FIG. 44, each polygonal mirror is assumed to have six faces while an encoder 37 is assumed to output six pulses for one rotation. As shown, a phase comparator (B) 25, a charge pump circuit (B) 26, an LPF (Low-Pass Filter) (B) 27, a summation device 32, a phase corrector 33, and a servo amplifier 34 constitute a PLL control circuit. First, this PLL control circuit controls a polygonal motor 38 to a target rotation speed. Initially, a delay set in a variable delay circuit (A) 24 is zero. A phase error detector 36 is configured to output a phase error δ between a main scan start signal pulse and the output pulse of the encoder 37. In this condition, by monitoring the output of the phase error detector 36, the controller varies the delay of the variable delay circuit (A) 24 stepwise and selects a delay corresponding to the phase difference δ, thereby insuring the stable control state of the rotation control system.

Subsequently, the controller closes the switch 31 (ON) while maintaining the zero delay of the variable delay circuit (B) 24. Why the delay of the variable delay circuit (A) 24 is increased stepwise is that a phase difference between the next main scan start signal pulse and the output pulse of a ⅙ frequency divider (B) 22 should be reduced, i.e., such pulses should be synchronized for the control over the polygonal motor 38. Otherwise, a long period of time would be necessary for the next operation to be stabilized, and it would be difficult to stabilize steady rotation. That is, the stepwise increase of the delay prevents the system controlled by the output of the LPF (B) 27 and the system controlled by the output of an LPF (A) 30 from becoming contradictory to each other.

A phase comparator (A) 28, a charge pump circuit (A) 29) and the LPF (A) 30 constitute a control system that operates after the turn-on of the switch 31. This control system executes control such that the main scan start signal pulse is synchronous to a reference signal generated within the circuitry of FIG. 44, i.e., a signal produced by dividing the oscillation frequency of an oscillator 20 by frequency dividers 21 and 22. The four polygonal motors are therefore synchronous to the reference signal generated in the circuitry of FIG. 44, so that the scanning phases of the laser beams incident to the drums are matched to each other.

In the specific circuitry shown in FIG. 44, the phase of the main scan start signal is compared with the phase of the signal output from the ⅙ frequency divider 35. This protects the control system from slight errors in the timing at which the light beam sequentially reflected by the six faces of the polygonal mirror reaches the main scan start signal sensor due to some errors of the six faces. Therefore, the reference input to the phase comparator (A) 28 is divided by the ⅙ frequency divider (B) 22 with respect to the reference input to the phase comparator (B) 25.

Figure 45:
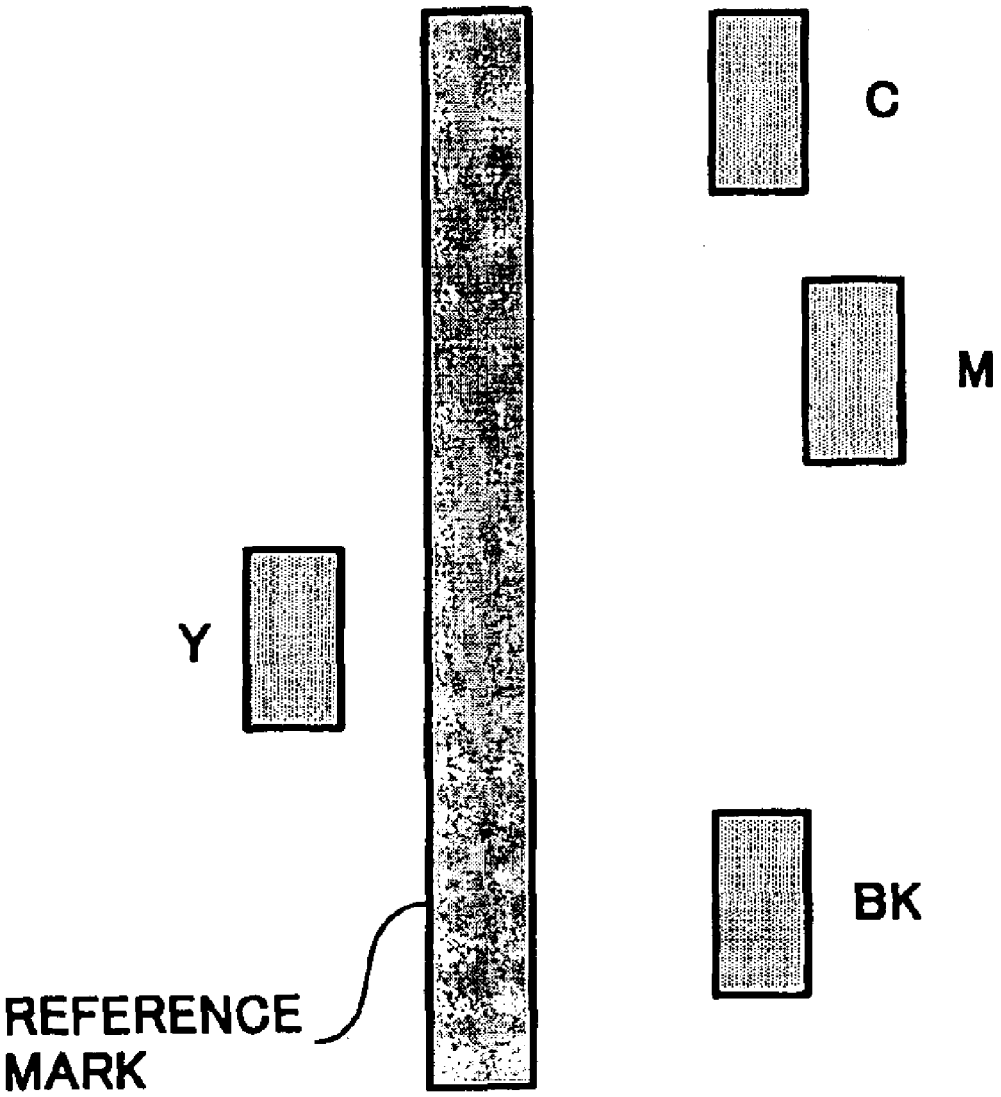
FIG. 45 shows a specific reference mark and specific color-by-color test marks used to correct the positional error of a drum distance.

On the assumption that an error between the drums is zero, as stated above, a test mark signal is generated at the exposure timing, so that test marks are recorded color by color. FIG. 45 shows specific color-by-color test marks C through BK recorded on the belt 3. The reference position error detector 16, FIG. 42, detects the errors of the test marks C through BK with respect to the reference mark. Subsequently, the exposure timings are so corrected as to obviate the detected errors, so that the positional errors of the drums can be corrected. If the error between the drums is not the natural multiple of the pitch of main scanning lines on the drum in the subscanning direction, then the variable delay circuit (B) 23 varies the reference signal representative of the main scan start timing for thereby effecting correction more delicately than the pitch in the subscanning direction.

Further, to stabilize the control system, the above delay is fed to the variable delay circuit (A) 24 at the same time. This delay is also fed stepwise so as to prevent the control system from becoming unstable. Of course, the image data to be written in the drum are corrected in correspondence to the delay. In this manner, the illustrative embodiment generates image data in accordance with the corrected timing derived from the positional error of the drum, thereby insuring a full-color image free from color misregister.

Figure 46:
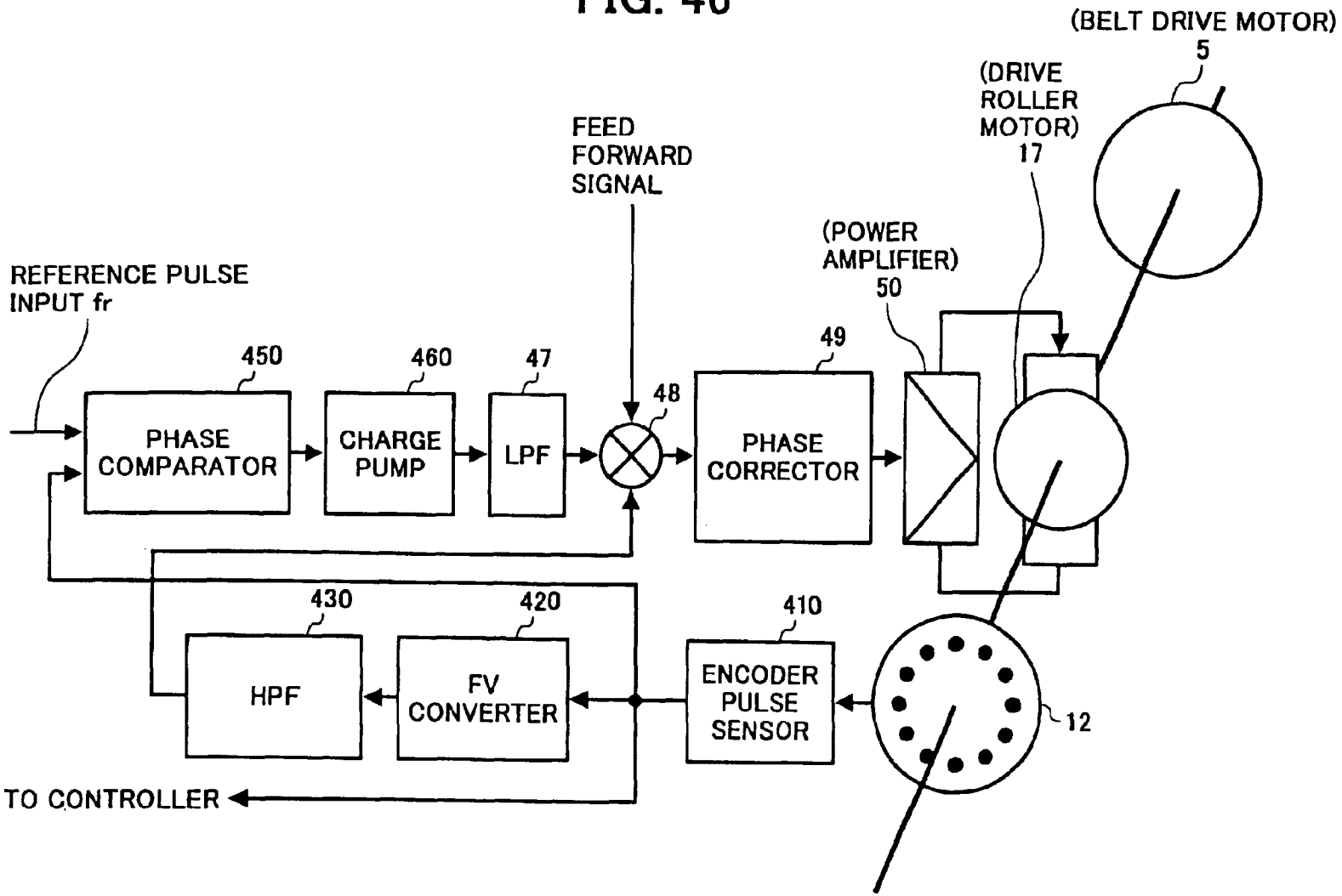
FIG. 46 is a schematic block diagram showing circuitry for causing a drive roller assigned to a conveying belt at a constant speed.

FIG. 46 shows specific control circuitry for controlling the drive of the belt 3. Briefly, the control circuitry controls the speed of the belt 3 by using the encoder 12 directly connected to the drive roller 5 and the drive motor 17 although a gearing may be associated with the drive motor 17 or the encoder 12. The operation of the control circuitry is as follows. Assuming that the target belt speed is V and that the radius of the drive roller 5 is Rr, then the rotation speed ωr of the drive motor 17 is ωr=V/Rr. Assuming that the encoder 12 outputs Nr pulses for one rotation of the drive roller 5, then pulses output from of the encoder 12 when the belt is moving at the speed V have a frequency fr expressed as:

$$fr=Nr\cdot\omega r/(2\pi)=Nr\cdot V/(2\pi Rr) \qquad \text{Eq. (72)}$$

In the circuitry of FIG. 46, pulses (clock) having a frequency identical with the above frequency fr is input to a phase comparator 450. The phase comparator 450 compares the phase of the input pulses with the phase of the output of an encoder pulse detector 410 and delivers the resulting phase difference to an LPF 47 via a charge pump circuit 460. The LPF 47 feeds its output, which is an analog voltage signal, to a power amplifier 50 via a phase corrector 49. The power amplifier 50 drives the drive motor 17 assigned to the belt 3. The circuitry executes constant speed control in accordance with the conventional PLL system.

Further, the output of the encoder pulse detector 41 is input to a frequency-to-voltage (F/V) converter 420, which converts the pulse frequency to a voltage signal proportional to the angular velocity of the drive roller 5. The voltage signal is bed back to the input of the power amplifier 50 via an HPF (High-Pass Filter) 430, thereby improving the control characteristic of the speed control system. In addition, the controller inputs a feed forward signal to the power amplifier 50. More specifically, when the timing and amount of a load variation around the belt 3 is known beforehand, a feed forward signal that overcomes the load variation is input to the power amplifier 50 to thereby further promote accurate control.

Figure 47:
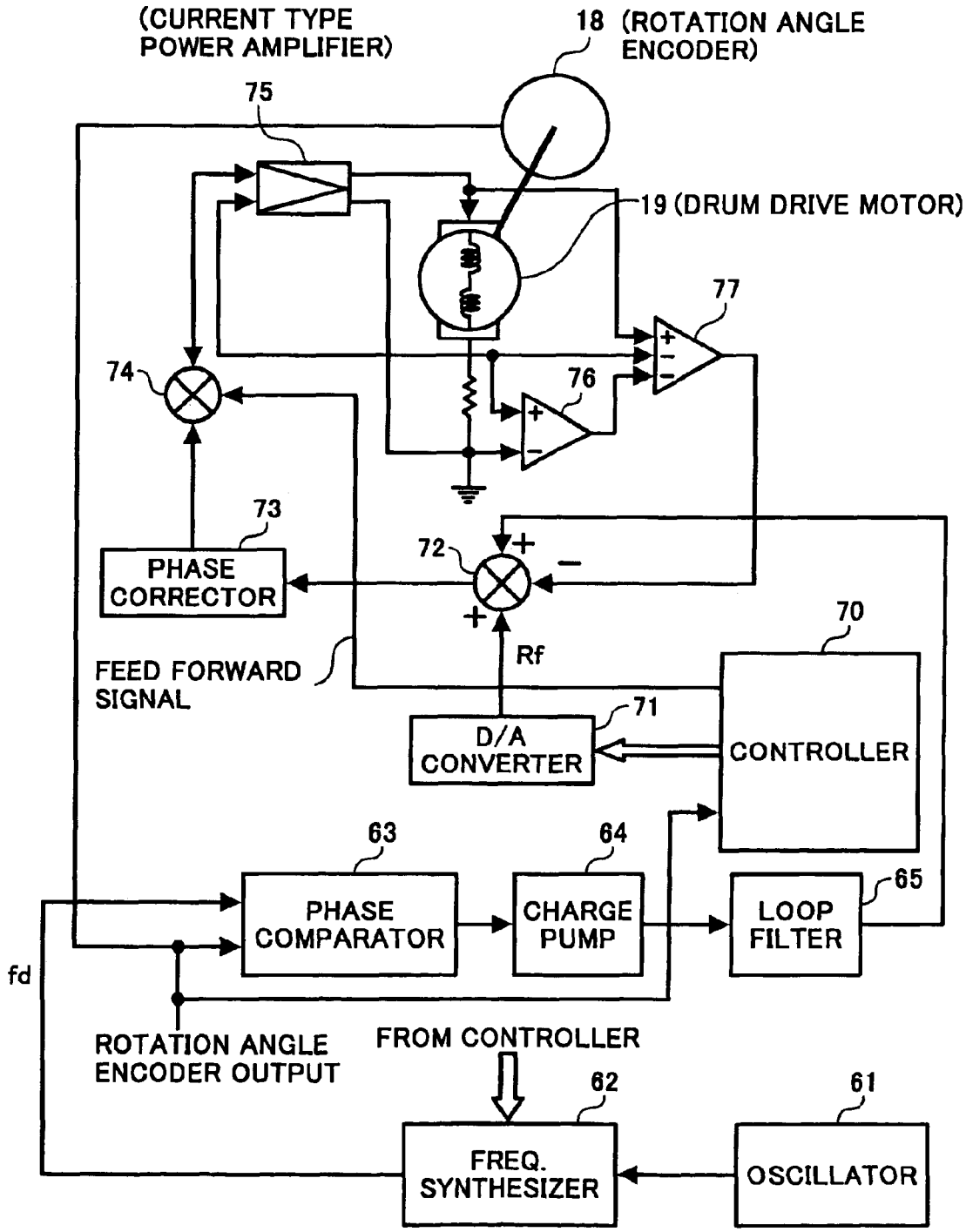
FIG. 47 is a schematic block diagram showing circuitry for causing the drum to rotate at a constant speed in accordance with a set value.

FIG. 47 shows specific circuitry for controlling the drive of the drum by using the rotation angle encoder 18 mounted on the shaft of the individual motor or the output shaft of the drive motor 19. The control is executed in accordance with the previously stated principle of control over the drum rotation speed. More specifically, the circuitry controls the drum rotation to the target drum speed derived from the measured drum radius, as stated earlier.

Another specific method of determining the target drum speed is as follows. First, assume that the rotation angle encoder 18 mounted on the drum shaft outputs No pulses when the drum completes one rotation. To measure the drum radius, the output of the linear encoder provided on the belt 3 is detected when the drum completes one rotation. The number of pulses of this instant is assumed to be N, and a phase representative of an interval between consecutive pulses is assumed to be $2\pi P$ ($0<P<1$). Then, the output of the linear encoder 13 when the drum completes one rotation is represented by N+P. At this time, the drum radius R is produced by:

$$R=L(N+P)/(2\pi) \quad \text{Eq. (73)}$$

where L denotes the interval between the timing marks shown in FIG. 42. This gives a drum radius.

For example, assuming that the drum peripheral speed is V, then the drum should only rotate at an angular velocity ωd expressed as:

$$\omega d=V/R=V\cdot 2\pi/\{L(N+P)\} \quad \text{Eq. (74)}$$

It follows that the pulses output from the encoder 18 mounted on the drum shaft in the above condition has a frequency fd produced by:

$$fd=No\cdot\omega d/(2\pi)=V\cdot No/\{L(N+P)\} \quad \text{Eq. (75)}$$

In the circuitry of FIG. 47, a controller 70 sets the target angular velocities ωd determined drum by drum by the above procedure in a frequency synthesizer 62. The frequency synthesizer 62 converts the oscillation frequency of an oscillator 61 to a pulse frequency fd corresponding to the target angular velocity ωd. As a result, the reference input fd determined is input to the PLL control system.

In the circuitry of FIG. 47, to control the drive of the individual drum, the phase of the reference input fd and that of the output pulses of the rotation angle encoder 18 are compared in phase comparator 63. The resulting phase difference is passed through a charge pump circuit 64 and a loop filter 65 to become an analog voltage signal. The analog voltage signal is input to a power amplifier 75, which drives the drum drive motor 19, via a phase corrector 73 and summators 72, 74. This configuration executes constant speed control based on the conventional PLL scheme. With the procedure described above, it is possible to realize high image quality.

When the timing and amount of load variation around the drum is known beforehand, feed forward control is executed with the individual drum for enhancing control accuracy. For this purpose, the controller 70 outputs a feed forward signal.

For more stable control, a speed feedback system is added in which a signal proportional to the rotation speed of the drum is detected out of the drum drive motor 19. That is, in the circuitry of FIG. 47, the PLL system executes control with the output pulses of the rotation angle encoder 18, so that the speed feedback system is added in order to correct a variation to occur in the pulse interval. More specifically, the controller 70 generates reference speed data corresponding to the set speed V and feeds it to a DA (Digital-to-Analog) converter 71. The output of the DA converter 71 is compared with the output of a sensor 77 responsive to a counter electromotive force proportional to the speed of the drum drive motor (DC motor) 19. The counter electromotive force of the motor is produced by subtracting the internal resistance of the motor from the voltage of the motor terminal.

The current type power amplifier 75 included in the circuitry serves to improve the characteristic of the control system. The phase corrector 73 serves to further improve the characteristic of the control system.

An alternative arrangement available with the illustrative embodiment for obviating color misregister will be described hereinafter. In the illustrative embodiment, the rotation speed of the individual drum is controlled in order to match the peripheral speeds of the drums, thereby maintaining the load to act on the belt constant. By contrast, the alternative arrangement implements the constant load with a simpler method and thereby reduces the oscillation of the belt ascribable to the varying load, thereby obviating misregister at the image transfer position.

Generally, even when the drums are different in radius, they are arranged without regard to the difference in radius, bringing about the problem stated earlier. Consequently, a difference in peripheral speed between the drums causes the belt to periodically tense and slacken, resulting in misregister. In light of this, the alternative arrangement sequentially arranges the drums in the incrementing order or the decrementing order with respect to radius in the direction of movement of the belt. In this condition, when the drums are rotating at the same, constant angular velocity, the belt either tenses or slackens between nearby drums and therefore oscillates little. This successfully obviates misregister at the image transfer position.

As stated above, the fifth embodiment achieves various unprecedented advantages, as enumerated below.

(1) The drums move at the same mean peripheral velocity at the respective image transfer positions and therefore without any difference in relative speed with respect to a transfer medium. This reduces the increase of line width in toner images transferred to the transfer medium one above the other, thereby reducing the degradation of image quality. Further, the moving speed of the transfer medium and the mean peripheral speed of each drum at the image transfer position are free from a relative speed, i.e., identical with each other, so that the load on the belt drive system varies little and insures high image quality.

(2) A speed difference corresponding to the radius of the individual drum is provided between the mean peripheral speed of the drum and the moving speed of the transfer medium, as measured at the image transfer position. Therefore, when the above speed difference is required for image forming process reasons, the increase of line width ascribable to the variation of the nip width, which is ascribable to a drum radius error, can be made constant or reduced to thereby reduce the degradation of image quality.

(3) Means for measuring the radiuses of the individual drums is disposed in the apparatus and allows the target angular velocity of each drum to be determined in accordance with the measured radius. The rotation speed of the individual drum is then controlled to the respective target angular velocity. Therefore, even when the drums are replaced on the market, the above advantage (2) is achievable.

(4) An exposure timing assigned to each drum is varied in accordance with the angular velocity of the drum. This further enhances the quality of an image transferred to the transfer medium.

(5) A plurality of drums are sequentially arranged in the incrementing or decrementing order with respect to radius in the direction of movement of the transfer medium. This readily reduces the oscillation of the transfer medium ascribable to the load acting on the transfer medium and thereby protects the image from distortion.

Various modifications will become possible for those skilled in the art after receiving the teachings of the present disclosure without departing from the scope thereof.

What is claimed is:

1. An image forming apparatus comprising:

a rotatable image carrier; and image carrier driving means for driving said image carrier;

said image carrier driving means comprising an outer rotor type motor configured to directly drive said image carrier and including a rotor formed with a connecting portion to which said image carrier is removably connectable.

2. An image forming apparatus as claimed in claim 1, wherein:

said image carrier driving means includes a rotor provided with a flywheel.

3. An image forming apparatus as claimed in claim 1, further comprising:

obtaining means for obtaining load variation information for one rotation period of said rotatable image carrier or for one rotation period of an endless belt, which is driven to rotate in contact with said rotatable image carrier; and drive control means for controlling said image carrier drive means by feed forward control in accordance with the load variation information output from said obtaining means.

* * * * *